US008710770B2

(12) United States Patent
Woytowitz

(10) Patent No.: US 8,710,770 B2
(45) Date of Patent: Apr. 29, 2014

(54) SYSTEMS AND METHODS FOR PROVIDING POWER AND DATA TO LIGHTING DEVICES

(75) Inventor: Peter John Woytowitz, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 181 days.

(21) Appl. No.: 13/230,665

(22) Filed: Sep. 12, 2011

(65) Prior Publication Data

US 2013/0026953 A1 Jan. 31, 2013

Related U.S. Application Data

(60) Provisional application No. 61/511,934, filed on Jul. 26, 2011.

(51) Int. Cl.
*H05B 37/02* (2006.01)

(52) U.S. Cl.
USPC ..... 315/307; 315/308; 315/151; 315/312

(58) Field of Classification Search
USPC ..... 315/307, 308, 312, 294, 291
See application file for complete search history.

(56) References Cited

U.S. PATENT DOCUMENTS

| | | | |
|---|---|---|---|
| 5,909,429 | A | 6/1999 | Satyanarayana et al. |
| 5,947,587 | A | 9/1999 | Keuper et al. |
| 6,013,988 | A | 1/2000 | Bucks et al. |
| 6,016,038 | A | 1/2000 | Mueller et al. |
| 6,094,014 | A | 7/2000 | Bucks et al. |
| 6,127,783 | A | 10/2000 | Pashley et al. |
| 6,147,458 | A | 11/2000 | Bucks et al. |
| 6,150,774 | A | 11/2000 | Mueller et al. |
| 6,157,093 | A | 12/2000 | Giannopoulos et al. |
| 6,166,496 | A | 12/2000 | Lys et al. |
| 6,194,839 | B1 | 2/2001 | Chang |
| 6,201,353 | B1 | 3/2001 | Chang et al. |
| 6,211,626 | B1 | 4/2001 | Lys et al. |
| 6,234,648 | B1 | 5/2001 | Börner et al. |
| 6,246,594 | B1 | 6/2001 | Matsuda et al. |
| 6,249,088 | B1 | 6/2001 | Chang |
| 6,250,774 | B1 | 6/2001 | Begemann et al. |
| 6,292,901 | B1 | 9/2001 | Lys et al. |
| 6,304,464 | B1 | 10/2001 | Jacobs et al. |
| 6,340,864 | B1 | 1/2002 | Wacyk |

(Continued)

FOREIGN PATENT DOCUMENTS

DE 20 2012 100 843 U1 5/2012

OTHER PUBLICATIONS

PCT International Search Report and Written Opinion for PCT/US2012/048202, dated Nov. 27, 2012.

*Primary Examiner* — Douglas W Owens
*Assistant Examiner* — Amy Yang
(74) *Attorney, Agent, or Firm* — Knobbe, Marten, Olson & Bear, LLP

(57) ABSTRACT

Systems and methods are provided for lighting systems, including high output lighting systems for various environments. The lighting systems include a lighting controller for driving lighting modules and transmitting a data signal to the lighting modules. The data signal varies between logical states. The lighting controller provides a low loss rectified power signal. The lighting controller further provides data within the power signal by forming a positive polarity rectified power waveform corresponding to data in a first state and a negative polarity rectified waveform signal corresponding to data in a second state using substantially loss-less circuitry.

32 Claims, 29 Drawing Sheets

(56) References Cited

U.S. PATENT DOCUMENTS 6,340,868 B1 1/2002 Lys et al.
6,384,545 B1 5/2002 Lau
6,411,046 B1 6/2002 Muthu
6,445,139 B1 9/2002 Marshall et al.
6,459,919 B1 10/2002 Lys et al.
6,507,159 B2 1/2003 Muthu
6,510,995 B2 1/2003 Muthu et al.
6,513,949 B1 2/2003 Marshall et al.
6,528,954 B1 3/2003 Lys et al.
6,552,495 B1 4/2003 Chang
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,608,453 B2 8/2003 Morgan et al.
6,609,813 B1 8/2003 Showers et al.
6,617,795 B2 9/2003 Bruning
6,621,235 B2 9/2003 Chang
6,630,801 B2 10/2003 Schuurmans
6,636,003 B2 10/2003 Rahm et al.
6,639,368 B2 10/2003 Sheoghong
6,676,284 B1 1/2004 Wynne Willson
6,692,136 B2 2/2004 Marshall et al.
6,720,745 B2 4/2004 Lys et al.
6,724,159 B2 4/2004 Gutta et al.
6,734,639 B2 5/2004 Chang et al.
6,741,351 B2 5/2004 Marshall et al.
6,777,891 B2 8/2004 Lys et al.
6,788,011 B2 9/2004 Mueller et al.
6,796,680 B1 9/2004 Showers et al.
6,801,003 B2 10/2004 Schanberger et al.
6,806,659 B1 10/2004 Mueller et al.
6,831,569 B2 12/2004 Wang et al.
6,853,150 B2 2/2005 Clauberg et al.
6,859,644 B2 2/2005 Wang
6,922,022 B2 7/2005 Bucks et al.
6,930,452 B2 8/2005 De Krijger et al.
6,932,477 B2 8/2005 Stanton
6,933,685 B2 8/2005 Gutta et al.
6,965,205 B2 11/2005 Piepgras et al.
6,969,954 B2 * 11/2005 Lys ..... 315/155
6,992,803 B2 1/2006 Chang
6,998,594 B2 2/2006 Gaines et al.
7,030,572 B2 4/2006 Nijhof et al.
7,031,920 B2 4/2006 Dowling et al.
7,038,398 B1 5/2006 Lys et al.
7,038,399 B2 5/2006 Lys et al.
7,064,498 B2 6/2006 Dowling et al.
7,071,762 B2 7/2006 Xu et al.
7,118,248 B2 10/2006 Wynne Willson
7,132,804 B2 11/2006 Lys et al.
7,139,617 B1 11/2006 Morgan et al.
7,140,752 B2 11/2006 Ashdown
7,161,311 B2 1/2007 Mueller et al.
7,161,313 B2 1/2007 Piepgras et al.
7,161,556 B2 1/2007 Morgan et al.
7,178,941 B2 2/2007 Roberge et al.
7,180,252 B2 2/2007 Lys et al.
7,186,003 B2 3/2007 Dowling et al.
7,202,608 B2 4/2007 Robinson et al.
7,202,613 B2 4/2007 Morgan et al.
7,202,641 B2 4/2007 Claessens et al.
7,204,622 B2 4/2007 Dowling et al.
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,253,566 B2 8/2007 Lys et al.
7,255,458 B2 8/2007 Ashdown
7,256,554 B2 8/2007 Lys
7,262,559 B2 8/2007 Tripathi et al.
7,267,461 B2 9/2007 Kan et al.
7,274,160 B2 9/2007 Mueller et al.
7,300,192 B2 11/2007 Mueller et al.
7,308,296 B2 12/2007 Lys et al.
7,314,289 B2 1/2008 Montagne
7,319,298 B2 1/2008 Jungwirth et al.
7,323,676 B2 1/2008 Duijve
7,329,998 B2 2/2008 Jungwirth
7,344,279 B2 3/2008 Mueller et al.
7,350,936 B2 4/2008 Ducharme et al.
7,352,138 B2 4/2008 Lys et al.
7,352,339 B2 4/2008 Morgan et al.
7,353,071 B2 4/2008 Blackwell et al.
7,354,172 B2 4/2008 Chemel et al.
7,358,679 B2 4/2008 Lys et al.
7,358,681 B2 4/2008 Robinson et al.
7,358,706 B2 4/2008 Lys
7,358,929 B2 4/2008 Mueller et al.
7,358,961 B2 4/2008 Zwanenburg
7,394,210 B2 7/2008 Ashdown
7,420,335 B2 9/2008 Robinson et al.
7,423,387 B2 9/2008 Robinson et al.
7,432,668 B2 10/2008 Zwanenburg et al.
7,443,209 B2 10/2008 Chang
7,449,847 B2 11/2008 Schanberger et al.
7,453,217 B2 11/2008 Lys et al.
7,459,864 B2 12/2008 Lys
7,462,997 B2 12/2008 Mueller et al.
7,463,070 B2 12/2008 Wessels
7,482,565 B2 1/2009 Morgan et al.
7,482,760 B2 1/2009 Jungwirth et al.
7,490,953 B2 2/2009 Holten et al.
7,495,671 B2 2/2009 Chemel et al.
7,502,034 B2 3/2009 Chemel et al.
7,511,436 B2 3/2009 Xu
7,511,437 B2 3/2009 Lys et al.
7,520,634 B2 4/2009 Ducharme et al.
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,573,209 B2 8/2009 Ashdown et al.
7,573,210 B2 8/2009 Ashdown et al.
7,573,729 B2 8/2009 Elferich et al.
7,589,701 B2 9/2009 Sempel
7,598,681 B2 10/2009 Lys et al.
7,598,684 B2 10/2009 Lys et al.
7,598,686 B2 10/2009 Lys et al.
7,619,370 B2 11/2009 Chemel et al.
7,652,236 B2 1/2010 Cortenraad et al.
7,654,703 B2 2/2010 Kan et al.
7,656,366 B2 2/2010 Ashdown
7,658,506 B2 2/2010 Dowling
7,659,673 B2 2/2010 Lys
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,703,951 B2 4/2010 Piepgras et al.
7,710,369 B2 5/2010 Dowling
7,712,926 B2 5/2010 Matheson
7,714,521 B2 5/2010 Qian
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,764,026 B2 7/2010 Dowling et al.
7,766,489 B2 8/2010 Duine et al.
7,766,518 B2 8/2010 Piepgras et al.
7,777,427 B2 8/2010 Stalker, III
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,828,465 B2 11/2010 Roberge et al.

(56) References Cited

U.S. PATENT DOCUMENTS

| | | | | |
|---|---|---|---|---|
| 7,845,823 | B2 | 12/2010 | Mueller et al. | |
| 7,850,347 | B2 | 12/2010 | Speier et al. | |
| 2003/0132721 | A1 | 7/2003 | Jacobs et al. | |
| 2003/0133292 | A1 | 7/2003 | Mueller et al. | |
| 2004/0052076 | A1 | 3/2004 | Mueller et al. | |
| 2005/0041161 | A1 | 2/2005 | Dowling et al. | |
| 2005/0236998 | A1 | 10/2005 | Mueller et al. | |
| 2005/0275626 | A1 | 12/2005 | Mueller et al. | |
| 2006/0002110 | A1 | 1/2006 | Dowling et al. | |
| 2006/0076908 | A1 | 4/2006 | Morgan et al. | |
| 2006/0114201 | A1 | 6/2006 | Chang | |
| 2006/0232219 | A1 | 10/2006 | Xu | |
| 2006/0262521 | A1 | 11/2006 | Piepgras et al. | |
| 2007/0145915 | A1 | 6/2007 | Roberge et al. | |
| 2007/0153514 | A1 | 7/2007 | Dowling et al. | |
| 2007/0230159 | A1 | 10/2007 | Cortenraad et al. | |
| 2008/0043464 | A1 | 2/2008 | Ashdown | |
| 2008/0089060 | A1 | 4/2008 | Kondo et al. | |
| 2008/0094005 | A1 | 4/2008 | Rabiner et al. | |
| 2008/0136334 | A1 | 6/2008 | Robinson et al. | |
| 2008/0136350 | A1 | 6/2008 | Tripathi et al. | |
| 2008/0140231 | A1 | 6/2008 | Blackwell et al. | |
| 2008/0164826 | A1 | 7/2008 | Lys | |
| 2008/0164827 | A1 | 7/2008 | Lys | |
| 2008/0164854 | A1 | 7/2008 | Lys | |
| 2008/0167734 | A1 | 7/2008 | Robinson et al. | |
| 2008/0183081 | A1 | 7/2008 | Lys et al. | |
| 2008/0203928 | A1* | 8/2008 | Frumau et al. | 315/151 |
| 2008/0239675 | A1 | 10/2008 | Speier | |
| 2008/0253119 | A1 | 10/2008 | Paulussen et al. | |
| 2008/0265797 | A1 | 10/2008 | Van Doorn | |
| 2008/0272743 | A1 | 11/2008 | Ackermann et al. | |
| 2008/0278092 | A1 | 11/2008 | Lys et al. | |
| 2008/0278941 | A1 | 11/2008 | Logan et al. | |
| 2008/0298054 | A1 | 12/2008 | Paulussen et al. | |
| 2009/0002981 | A1 | 1/2009 | Knibbe | |
| 2009/0021175 | A1 | 1/2009 | Wendt et al. | |
| 2009/0021182 | A1 | 1/2009 | Sauerlaender | |
| 2009/0072761 | A1 | 3/2009 | Wessels | |
| 2009/0128059 | A1 | 5/2009 | Joosen et al. | |
| 2009/0134817 | A1 | 5/2009 | Jurngwirth et al. | |
| 2009/0168415 | A1 | 7/2009 | Franciscus Deurenberg et al. | |
| 2009/0179587 | A1 | 7/2009 | Van Der Veen et al. | |
| 2009/0179596 | A1 | 7/2009 | Willaert et al. | |
| 2009/0189448 | A1 | 7/2009 | Verschueren | |
| 2009/0195063 | A1 | 8/2009 | Joseph et al. | |
| 2009/0224695 | A1 | 9/2009 | Van Erp et al. | |
| 2009/0230884 | A1 | 9/2009 | Van Doorn | |
| 2009/0231878 | A1 | 9/2009 | Van Duijneveldt | |
| 2009/0243517 | A1* | 10/2009 | Verfuerth et al. | 315/315 |
| 2009/0278473 | A1 | 11/2009 | Van Erp | |
| 2009/0284174 | A1 | 11/2009 | Sauerlander et al. | |
| 2009/0303467 | A1 | 12/2009 | Ashdown et al. | |
| 2009/0315485 | A1* | 12/2009 | Verfuerth et al. | 315/320 |
| 2009/0321666 | A1 | 12/2009 | Hilgers | |
| 2010/0007600 | A1 | 1/2010 | Deurenberg et al. | |
| 2010/0026191 | A1 | 2/2010 | Radermacher et al. | |
| 2010/0045478 | A1 | 2/2010 | Schulz et al. | |
| 2010/0072901 | A1 | 3/2010 | De Rijck et al. | |
| 2010/0072902 | A1 | 3/2010 | Wendt et al. | |
| 2010/0079085 | A1 | 4/2010 | Wendt et al. | |
| 2010/0079091 | A1 | 4/2010 | Deixler et al. | |
| 2010/0084985 | A1* | 4/2010 | Woytowitz | 315/210 |
| 2010/0084995 | A1 | 4/2010 | Baaijens et al. | |
| 2010/0091488 | A1 | 4/2010 | Ijzerman et al. | |
| 2010/0094439 | A1 | 4/2010 | Van De Meulenhof et al. | |
| 2010/0096967 | A1 | 4/2010 | Marinus et al. | |
| 2010/0102732 | A1 | 4/2010 | Peeters et al. | |
| 2010/0117543 | A1 | 5/2010 | Van Der Veen et al. | |
| 2010/0117656 | A1 | 5/2010 | Snelten | |
| 2010/0118531 | A1 | 5/2010 | Montagne | |
| 2010/0127633 | A1 | 5/2010 | Geerts et al. | |
| 2010/0134041 | A1 | 6/2010 | Radermacher et al. | |
| 2010/0134042 | A1 | 6/2010 | Willaert | |
| 2010/0148689 | A1 | 6/2010 | Morgan et al. | |
| 2010/0158061 | A1 | 6/2010 | Schulz et al. | |
| 2010/0165618 | A1 | 7/2010 | Vissenberg et al. | |
| 2010/0171771 | A1 | 7/2010 | Otte et al. | |
| 2010/0181936 | A1 | 7/2010 | Radermacher et al. | |
| 2010/0188007 | A1 | 7/2010 | Deppe et al. | |
| 2010/0194293 | A1 | 8/2010 | Deurenberg et al. | |
| 2010/0231133 | A1 | 9/2010 | Lys | |
| 2010/0231363 | A1 | 9/2010 | Knibbe | |
| 2010/0244707 | A1 | 9/2010 | Gaines et al. | |
| 2010/0244734 | A1 | 9/2010 | Van Herpen et al. | |
| 2010/0264834 | A1 | 10/2010 | Gaines et al. | |
| 2010/0271843 | A1 | 10/2010 | Holten et al. | |
| 2010/0289532 | A1 | 11/2010 | Wendt et al. | |
| 2010/0301780 | A1 | 12/2010 | Vinkenvleugel | |
| 2010/0308745 | A1 | 12/2010 | Delnoij | |
| 2011/0025205 | A1 | 2/2011 | Van Rijswick et al. | |
| 2011/0025230 | A1 | 2/2011 | Schulz et al. | |
| 2011/0035404 | A1 | 2/2011 | Morgan et al. | |
| 2011/0175553 | A1* | 7/2011 | Sampsell | 315/312 |

* cited by examiner

MOSFET Full Wave Rectifier Waveforms

Bridge Waveforms

Bias Circuit for MOSFET Drivers

| | |
|---|---|
| FIG. 17A-1 | FIG. 17A-2 |
| FIG. 17A-3 | FIG. 17A-4 |

| | |
|---|---|
| FIG. 17B-1 | FIG. 17B-2 |
| FIG. 17B-3 | FIG. 17B-4 |

SYSTEMS AND METHODS FOR PROVIDING POWER AND DATA TO LIGHTING DEVICES

RELATED APPLICATIONS

This application claims the benefit of priority under 35 U.S.C. §119(e) of U.S. Provisional Patent Application No. 61/511,934 filed on Jul. 26, 2011, and entitled "SYSTEMS AND METHODS FOR PROVIDING POWER AND DATA TO LIGHTING DEVICES," and is related to U.S. application Ser. No. 12/564,840, filed Sep. 22, 2009, entitled "Low Voltage Outdoor Lighting Power Source and Control System", the entireties of which are incorporated herein by reference.

BACKGROUND

Traditionally, outdoor lighting systems include a plurality of lamps connected to a transformer. There may be one or more "legs" or sets of wires coming out of the transformer, each connected to at least one light. A timer box connects to the transformer. The user programs the on/off times and all of the lights energize in unison, such that all lights connected to a particular transformer turn ON or OFF together regardless of which leg they are on.

Some manufacturers provide lighting systems with addressable lighting modules. The timer box of the traditional lighting system is replaced with a lighting controller that supplies the lighting modules with a separate power and data signal. Each lighting module has an address and is independently addressable by the lighting controller via the data signal. These networked lighting systems provide the lighting modules with two sets of wires instead of the one or more legs. One set provides a power signal to illuminate the lamps or LEDs and a second set provides the lighting module with a data signal. The user programs the lighting controller to turn-on and turn-off lights at individual addresses such that a single light can turn-on or turn-off independently of the other lights in the network, when, for example, the data signal carries the address of a particular light.

In some instances, the power signal is the output of a low voltage power transformer which is connected directly to the lighting modules to power the lamps or LEDs. For example, a primary AC to 12 VAC transformer accepts 120 VAC and outputs 12 VAC, where the 12 VAC power signal electrically couples directly to the lighting modules and powers the lamps/LEDs.

In other instances, the power signal is the output of a DC switching power supply. For example, a DC switching power supply accepts 120 VAC and outputs 12 VDC, where the 12 VDC power signal electrically couples directly to the lighting modules and powers the lamps/LEDs.

Other manufacturers of addressable lighting systems send power and data to the lighting modules on the primary power wires. The user programs the lighting controller to turn-on and turn-off lights at individual addresses such that a single light can turn-on or turn-off independently of the other lights in the network. In some instances, these lighting systems use a high frequency carrier, such as 125 KHZ, and superimpose this signal on the power line. This approach requires fairly large inductors, or complex Digital Signal Processors (DSPs) to decode the data contained in the carrier. One such commercially available system is the X10 control system originally developed by Pico Electronics of Glenrothes, Scotland.

In other instances, these lighting systems amplify the data signal to the level that can be used to power the lighting modules. For example, a PWM stepper motor driver chip can amplify a 0 volt to 5 volt transistor-transistor logic (TTL) data signal to positive 24 volts to reflect a logical one and negative 24 volts to reflect a logical zero. The amplified data signal electrically couples to the lighting module, where the voltage is sufficient to supply power to the lamps/LEDs while maintaining the logical data values of the data stream.

SUMMARY

Based on the foregoing, each of the present manufacturing solutions suffers from a variety of drawbacks. In the context of individually addressable lighting networks with low voltage power transformers they often employ special wiring or cabling. In particular, one wire and its return are needed for electrical power, while a second wire path comprising two or more wires is needed for data. For example, using a low voltage power transformer directly coupled to the lamps/LEDs to supply power prevents the data from being carried on the same power lines and, thus requires the two sets of wires. Accordingly, the owner of an existing set of lights must take significant effort to rewire in order to have a digitally controlled lighting environment.

In the context of lighting networks using a single wire for a power and a data signal, problems can occur when using a switching power supply to supply power to the lighting modules. Switching power supplies are inefficient when compared to a well-designed core and coil power transformer. The inefficient transformation of the primary AC power to a power waveform usable by the lighting modules creates heat. The heat, in turn, creates the need for a large enclosure to prevent the lighting controller circuitry from overheating. For example, a 300 watt switching power supply that has an efficiency of 85% wastes 45 watts in heat.

In contrast, in an embodiment of the present disclosure, a full-wave rectifier coupled to a bridge circuit provides a polarity controlled, sinusoidal power signal to power a plurality of lighting modules. The rectifier and bridge circuit include MOSFETs and each MOSFET has an integral body diode. When the full-wave rectifier MOSFETs are enabled at the appropriate point in time, such as when the body diodes would be conducting, they create a very low-loss switch. For example, for a MOSFET having a resistance of approximately 1 milliohm when it is enabled, conducting 25 amperes needed to power the plurality of lighting modules would lose approximately 25 millivolts of the signal. The corresponding power lost to heat is approximately 0.625 watts. In contrast, a standard rectifier would drop approximately 0.7 volts and dissipate approximately 17.5 watts.

In embodiments of the present disclosure using the output of a primary AC to 12 VAC 300 watt transformer to feed the circuitry, preferably the power lost to heat in the circuitry is less than approximately 2.0%. More preferably, the power lost to heat is between approximately 1% and approximately 2%. Even more preferably, the power lost to heat is between approximately 0.2% and approximately 1%, and most preferably, the power lost to heat is less than approximately 0.2%.

In other embodiments, the advantages of the rectifier and bridge of the present disclosure creating a very low-loss switch can be viewed from the drop in voltage across the rectifier. A transformer in the full-wave rectifier receives the primary AC signal and transforms the primary AC signal into a secondary AC power waveform. The full-wave rectifier coupled to a bridge circuit provides a polarity controlled, sinusoidal power signal to power a plurality of lighting modules. Preferably, the power waveform current is more than approximately 4 amperes and the power waveform voltage drop across the rectifier is less than approximately 0.2 volts and at full load the voltage drop across the rectifier, from the output of the transformer to the output of the rectifier, is approximately 25 millivolts. In another embodiment, the voltage drop across the rectifier is more preferably between approximately 0.1 volts and approximately 0.2 volts, yet more preferably between approximately 0 volts and approximately 0.1 volts, and most preferably between approximately 5 millivolts and approximately 30 millivolts. In yet other embodiments, the power waveform current is more preferably more than 10 amperes, yet more preferably more than 50 amperes, and most preferably more than 75 amperes. One basis for the above ratings is the wattage used for outdoor lighting systems. Typical systems are about 60 watts or higher. If such power requirements should be reduced due to technology advances, such as, for example, power requirements for lighting sources, or the like, one of ordinary skill will understand from the disclosure herein that the forgoing ranges may also change accordingly.

The low-loss full-wave rectified power waveform from the full-wave rectifier is communicated to the inputs of the bridge circuit. The bridge circuit outputs the full-wave rectified waveform with either a positive polarity or a negative polarity, thus having the ability to reconstruct the original sinusoidal output of the transformer, or alter its polarity to send data. The control signal from a processor in the lighting controller couples to the MOSFET drivers of the bridge circuit. The control signal enables certain of the gates in the bridge circuit at certain points in time to encode a data signal by varying the polarity of the power waveform.

In one embodiment, the control signal enables certain of the gates in the bridge circuit when the data is a logical 1-bit and others of the gates when the data is a logical 0-bit. This, in turn, causes the bridge circuit to output the positive polarity rectified waveform when the data stream is a 1-bit and causes the bridge circuit to output a negative polarity rectified waveform when the data stream is a 0-bit. In other embodiments, the bridge circuit outputs the negative polarity rectified power signal when the data is a 1-bit and outputs the positive polarity rectified power signal when the data is a 0-bit.

In one embodiment, the lighting system includes a controller having a data signal including data bits. The data bits have a first state and a second state for sending commands and addresses to at least one lighting module.

The lighting system further includes a MOSFET full-wave rectifier circuit for receiving a 12 VAC RMS power signal having first and second power waveforms and rectifying the 12 VAC RMS power signal. The MOSFET full-wave rectifier includes a first MOSFET coupled in series with a second MOSFET and a third MOSFET coupled in series with a fourth MOSFET where the series combination of the first and second MOSFETs electrically couple in parallel with the series combination of the third and fourth MOSFETs. Each MOSFET is associated with a gate signal and the gate signals electrically couple to an output of a comparator comparing the first and second power waveforms, via driver circuitry. The gates associated with the second and third MOSFETs are enabled when the first power waveform is greater than the second power waveform and the gates associated with the first and fourth MOSFETs are enabled when the second power waveform is greater than the first power waveform.

The lighting system further includes a MOSFET bridge circuit for receiving the full-wave rectified waveform and providing a two-wire data/power signal to the at least one lighting module. The MOSFET bridge circuit includes a fifth MOSFET coupled in series with a sixth MOSFET and a seventh MOSFET coupled in series to an eighth MOSFET, where the series combination of the fifth and sixth MOSFETs couple in parallel with the series combination of the seventh and eighth MOSFETs. Each MOSFET is associated with a gate signal and the gate signals electrically coupled to the control signal. The gates associated with the sixth and seventh MOSFETs are enabled when the control signal is in the first state and the gates associated with the fifth and eighth MOSFETs are enabled when the control signal is in the second state, such that the MOSFET bridge circuit outputs the rectified waveform having a positive polarity when the control signal is in the first state and outputs the rectified waveform having a negative polarity when the control signal is in the second state. The two-wire data/power signal includes the positive and negative polarity rectified waveforms corresponding to the state of the control signal.

In another embodiment, a lighting system includes a controller having a data signal including data bits. The data bits have a first state and a second state for sending commands and addresses to at least one lighting module.

The lighting system further includes a MOSFET full-wave/bridge circuit for receiving a 12 VAC RMS power signal having first and second waveforms, rectifying the 12 VAC RMS power signal and providing a two-wire data/power signal to the at least one lighting module. The first and second power waveforms provided by a transformer having a center tap. The MOSFET full-wave/bridge circuit including a first MOSFET coupled in series with a second MOSFET and a third MOSFET electrically coupled in series with a fourth MOSFET where the series combination of the first and second MOSFETs electrically couple in parallel with the series combination of the third and fourth MOSFETs. Each MOSFET is associated with a gate signal and the gate signals electrically couple to the control signal. The gates associated with the third and fourth MOSFETs are enabled when the control signal is in the first state and the gates associated with the first and fourth MOSFETs are enabled when the control signal is in the second state, such that the MOSFET full-wave/bridge circuit outputs the rectified waveform having a positive polarity when the control signal is in the first state and outputs the rectified waveform having a negative polarity when the control signal is in the second state. The two-wire data/power signal includes the positive and negative polarity rectified waveforms corresponding to the state of the control signal.

In another aspect, systems and methods directed toward a user interface panel are disclosed. In an embodiment, a lighting controller includes an operator interface panel which allows operator input to program the timing, dimming/brightness, color, and zones of the lighting system. In one embodiment, the user enters a chronologic schedule including a lighting group, a time, an intensity, a color, and the like. The program queues the user entered events and transmits the commands at the scheduled times.

With respect to color, in an embodiment, the colors are assigned a number and the user enters the number associated with the desired color. In another embodiment, the user designs a custom color by inputting the red, green and blue percentages. In some cases a percentage of white can also be mixed with the red, green, and blue. Other user interfaces may include a color wheel with pointer sections, a scrollable list or color palette, or the like. The lighting controller then sends commands to the lighting modules with the user specified color percentages to create the custom color. In another embodiment, the lighting controller includes a thin film transistor liquid crystal display (TFT LCD) or the like, to display the color associated with the color number or the custom color. In another embodiment, the light controller may have a small red/green/blue LED, separate from the display, that can be driven with the proper percentages to mimic the color emitted by the lighting fixtures.

In one embodiment, the user has the ability through the lighting controller to set on or off times around an event, such as create a lighting event around sunrise or sunset. For example, the user could use dusk as a reference time and have a zone of lights turn on at dusk minus two hours or dusk plus two hours. In one embodiment, the lighting controller includes a photocell and determines events such as dusk or dawn through the input from the photocell. In another embodiment, the user enters latitude and longitude information for his location. The lighting controller looks up or calculates the astronomical events based on the entered location values. In yet another embodiment, the lighting controller displays a map and the user indicates on the map his location. The lighting controller automatically displays the latitude and longitude and determines the astronomical events based on the displayed location values.

In another aspect, systems and methods relating to commanding the lighting modules through a remote device are disclosed. In another embodiment, the lighting system further includes a remote device and a wireless receiver. The remote device permits the user to adjust the lighting while in the illuminated area as an alternative to using the user interface panel in the lighting controller. The remote interacts with the lighting module via an optical or other link and interacts with the lighting controller via the receiver to allow the user to mix the color coefficients, assign lights to zones, control brightness, control on/off, or the like. The lighting controller receives the user requests through a wired or other connection to the receiver and sends commands to the lighting module through the two wire data/power path. For example, from the user's point of view, he points the remote at the desired lighting module and selects the change zone command. After a short time period, the selected lighting module is a member of a different lighting zone.

Certain embodiments relate to a lighting system including a lighting controller and at least one lighting module having an address and including a light emitting diode (LED). The LED is configured to transmit optically the address or other status information of the lighting module by turning on when transmitting a 1-bit and turning off when transmitting a 0-bit in the address. The lighting controller electrically couples to the lighting module through a two-wire path carrying a power/data signal.

The lighting system further includes a remote device including an optical sensor and an RF transmitter. The optical sensor is configured to receive the address from the lighting module, and user request from the user interface of the remote device. The RF transmitter is configured to transmit an RF signal corresponding to the address and the request.

The lighting system further includes a wireless receiver electrically coupled to the lighting controller and configured to receive the RF transmission from the remote device. The wireless receiver down converts the RF transmission to a baseband signal corresponding to the address and request. The wireless receiver is further configured to electrically send the baseband signal corresponding to the address and the request to the lighting controller.

The lighting controller encodes a command corresponding to the user's request for the at least one lighting module associated with the address onto the power/data signal.

For purposes of summarizing the disclosure, certain aspects, advantages and novel features of the embodiments have been described herein. It is to be understood that not necessarily all such advantages may be achieved in accordance with any particular embodiment of the invention. Thus, the inventions may be embodied or carried out in a manner that achieves or optimizes one advantage or group of advantages as taught herein without necessarily achieving other advantages as may be taught or suggested herein.

BRIEF DESCRIPTION OF THE DRAWINGS

Throughout the drawings, reference numbers are re-used to indicate correspondence between referenced elements. The drawings, associated descriptions, and specific implementation are provided to illustrate embodiments and not to limit the scope of the disclosure.

DETAILED DESCRIPTION OF THE PREFERRED EMBODIMENT

The features of the inventive systems and methods will now be described with reference to the drawings summarized above.

Figure 1:
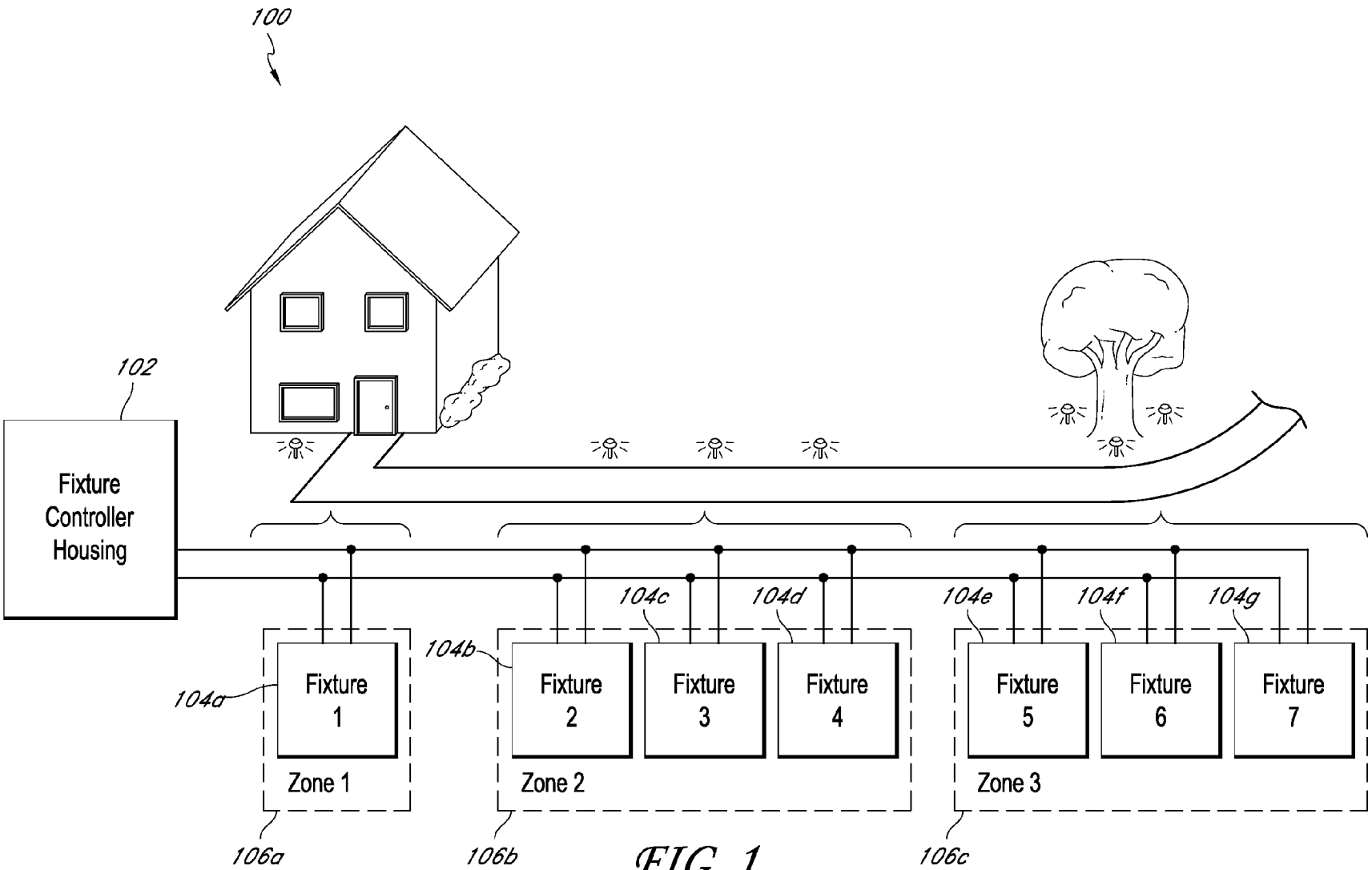
FIG. 1 illustrates an exemplary lighting system, according to certain embodiments.

FIG. 1 illustrates an exemplary lighting system 100. The lighting system 100 comprises a lighting controller housing 102 connected to a plurality of lighting fixtures or modules 104 through a two-wire interface. The lighting controller housing 102 houses a lighting controller including a power supply and user interface panel, as described in further detail below. The lighting fixtures 104 are grouped into zones 106.

In the example illustrated in FIG. 1, zone 1 106*a* comprises lighting fixture 1 104*a*, which provides illumination to a portion of the house exterior. Zone 2 106*b* comprises lighting fixtures 2, 3, 4 104*b*, 104*c*, 104*d*, respectively, which illuminate the path, while zone 3 106*c* comprises lighting fixtures 5, 6, 7, 104*e*, 104*f*, 104*g*, respectively, which provide accent lighting for the tree. In other embodiments, the lighting system 100 can be configured with more or less zones 106 and/or with more or less lighting fixtures 104 in each zone 106.

Typically, the lighting fixtures 104 in each zone 106 turn ON or OFF together, but unlike some traditional lighting systems, each zone 106 can be controlled independently of the other zones 106. In one example for the lighting system 100 illustrated in FIG. 1, zone 1 106*a* turns ON at dusk and turns OFF at dawn to illuminate the front door of the house. Zone 2 106*b* turns ON at dusk and turns OFF at 9 PM to illuminate the path. Finally, zone 3 turns on at 7 PM and turns OFF at 10 PM to provide accent lighting in the yard.

In one embodiment, the lighting system 200 is a residential outdoor lighting system. In other embodiments, the lighting system 200 is used for outdoor commercial purposes to illuminate the outside of hotels, golf courses, amusement parks, and the like, and for indoor commercial purposes to illuminate hotel interiors, office building interiors, airport terminals, and the like. In further embodiments, the lighting system 200 is used to illuminate housing developments. In yet further embodiments, the lighting system 200 is used to illuminate art work in residences, in museums, or the like. Many possibilities exist for the lighting system 200 to one skilled in the art from the disclosure herein. The lighting functions ON/OFF include a plurality of lighting functions, such as, for example, timing control, dimming, brightness, color, hue, zone allocation, intensity, and the like.

Figure 2:
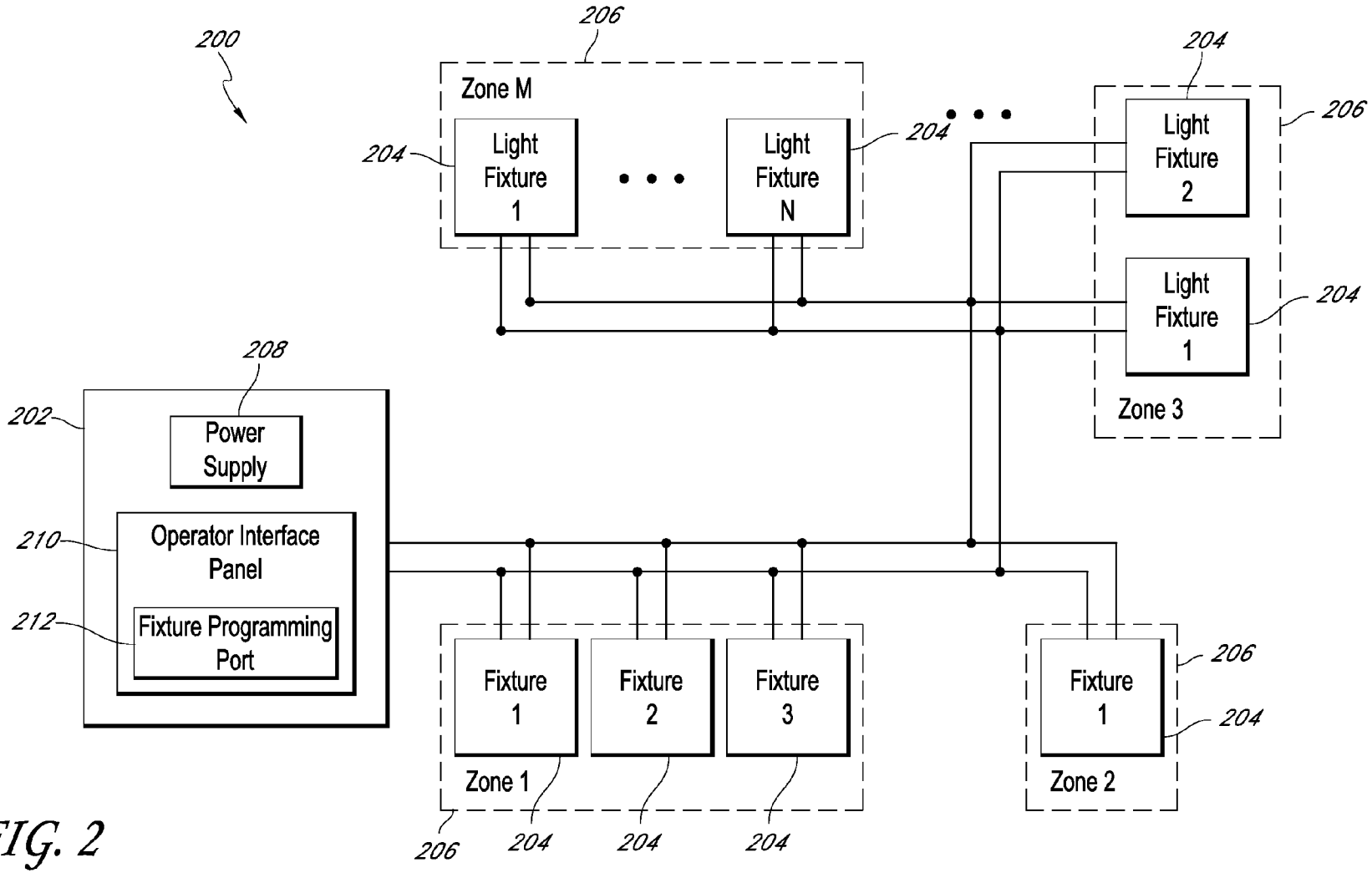
FIG. 2 is a block diagram of an exemplary lighting system, according to certain embodiments.

FIG. 2 is a block diagram of an exemplary lighting system 200 comprising a lighting controller 202 and a plurality of lighting modules 204. The lighting controller 202 comprises a power supply 208 and an operator interface 210 which includes a fixture programming port 212. A lighting controller housing houses the power supply 208 and the operator interface 210. The size of the lighting controller housing depends on the size of the power supply 208 and the operator interface 210 contained within it. In an embodiment, the lighting controller housing has a height that ranges from approximately 11 inches to approximately 15 inches, a width that ranges from approximately 7 inches to approximately 9 inches, and a thickness that ranges from approximately 5 inches to approximately 7 inches. The lighting controller 202 electrically couples to the lighting modules 204 through a two-wire path carrying a power/data signal. The lighting modules 204 electrically connect in parallel to the two-wire path and are grouped into M zones 206. In the illustrated embodiment, zone 1 comprises three lighting modules 204, zone 2 comprises a single lighting module 204, and zone 3 comprises two lighting modules 204. Further, the lighting controller 202 controls up to M zones 206, where in the illustrated embodiment, zone M includes N lighting modules 204. Each zone 206 can be independently energized such that the lighting modules 204 in each zone 206 can turn ON or OFF independently of the lighting modules 204 in the other zones 206.

Controller 202 is shown housing the power supply 208, the operator interface 210, and the fixture programming port 212. In other embodiments, the power supply 208, the operator interface 210, and the fixture programming port 212 may be separate devices or any two of the power supply 208, the operator interface 210, and the fixture programming port 212 may be housed in the same housing.

Figure 3:
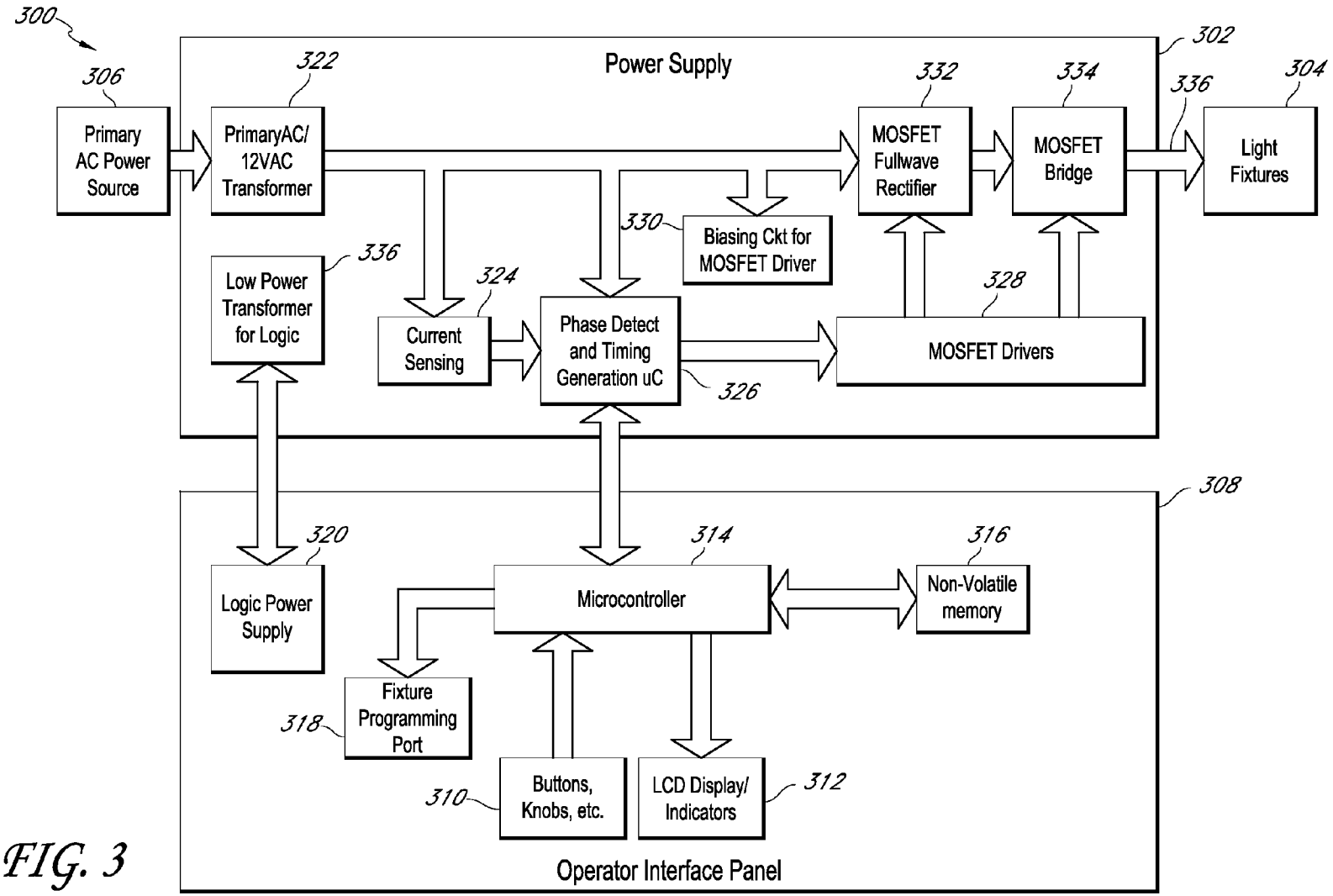
FIG. 3 is a block diagram of an exemplary lighting controller, according to certain embodiments.

FIG. 3 is a block diagram of an exemplary lighting controller 300 comprising a power supply 302 and an operator interface panel 308. The power supply 302 receives AC power from a primary AC power source 306 and addresses/data/commands from the operator interface panel 308 and provides a control signal to a plurality of lighting fixtures 304 through the two-wire path 336.

The operator interface panel 308 comprises operator controls 310, such as selection buttons, knobs, and the like, which the user uses to input the desired lighting effects to the lighting system 200, and displays and indicators 312 to provide feedback to the user. The operator interface panel 308 further comprises a computer 314 and its associated memory 316. The microprocessor 314 interfaces with the operator controls 310 to send the addresses/data/commands to the power supply 302 and interfaces with the displays and indicators 312 to display information received from the power supply 302. The operator interface 308 can be buttons, virtual icons or buttons on a touch screen, voice controlled or any user interface recognizable to an artisan from the disclosure herein.

The computer 314 comprises, by way of example, processors, program logic, or other substrate configurations representing data and instructions, which operate as described herein. In other embodiments, the processors can comprise controller circuitry, processor circuitry, processors, general-purpose single-chip or multi-chip microprocessors, digital signal processors, embedded microprocessors, microcontrollers and the like. The memory 316 can comprise one or more logical and/or physical data storage systems for storing data and applications used by the computer 314. The memory 316 comprises, for example, RAM, ROM, EPROM, EEPROM, and the like.

The operator interface panel 308 further comprises a fixture programming port 318 to provide unique addresses, a lighting group, and/or zone number to each of the plurality of lighting fixtures 304, and a logic power supply 320 to provide a low voltage, such as +5 volts, for example, for the digital logic components of the operator interface panel 308.

The power supply 302 comprises a primary AC transformer 322, current sensing circuitry 324, phase detect and timing circuitry 326, driver circuitry 328, a synchronous fullwave rectifier 332, and a bridge 334. The power supply 302 further comprises a low power transformer 336 to provide a low voltage, such as 9 VAC, for example, to a logic power supply which creates a regulated DC voltage for the digital logic components of the power supply 302, and biasing circuitry 330 to provide the proper voltage levels to operate transistors in the rectifier 332 and the bridge 334.

The primary AC transformer 322 receives a primary AC power signal from the primary AC power source 306 and transforms the primary AC signal into lower voltage AC signal. In an embodiment, the primary AC signal is approximately a 120 volt 60 Hz power waveform. In other embodiments, the primary AC signal can be an approximately 110 volts 60 Hz, 220 volt 50 Hz, 220 volt 60 Hz, 230 volts 60 Hz, 240 volts 50 Hz, or the like, power waveform. In an embodiment, the primary AC transformer 322 is a primary AC to 12 VAC transformer 322, and transforms the primary AC signal into an approximately 12 VAC RMS power signal. In other embodiments, the transformer 322 is a primary AC transformer with several taps. In an embodiment, the transformer has taps at approximately 11 VAC up to approximately 14 VAC. In other embodiments, the transformer 322 transforms the AC signal into an approximately 24 VAC.

In an embodiment, the transformer 322 is a high wattage transformer, such as a 300 watt transformer, or the like, for example, in order to supply sufficient power to illuminate the plurality of lighting modules 304. The output of the transformer 322 electrically connects to the current sensing circuitry 324. The current sensing circuitry 324 senses the amount of current in the output of the transformer 322. The phase detect and timing circuitry 326 receives a signal proportional to the sensed current from the current sensing circuitry 324 and shuts off the power supply 302 when the sensed current exceeds a threshold. For example, if there is a short between the wires of the two-wire path 336, a 300 watt transformer can supply a large amount of power in the form of heat in a very short time. When the sensed current exceeds a threshold, the lighting controller 300 shuts off the power before the heat generated causes damage to the lighting system 200.

The phase detect and timing circuitry 326 further receives data and commands from the processor 314 and the power waveform from the transformer 322, and provides timing signals to the driver circuit 328. The timing signals control the driver circuitry 328 to encode a data signal onto the power signal by varying the polarity of the power waveform, as will be further discussed herein.

Further, the output of the transformer 322 electrically connects to the synchronous fullwave rectifier 332, which rectifies the power signal. The fullwave rectifier 332 electrically connects to the bridge 334 and the fullwave rectifier 332 and the bridge 334 electrically connect to the driver circuitry 328. Both the fullwave rectifier 332 and the bridge 334 receive drive signals from the driver circuitry 328. The bridge 334 receives the rectified power signal and outputs a control signal to the lighting fixtures 304. The control signal comprises a data encoded power waveform which provides power to illuminate the lighting fixtures 304 and address/data/commands to individually control the lighting fixtures.

Figure 4:
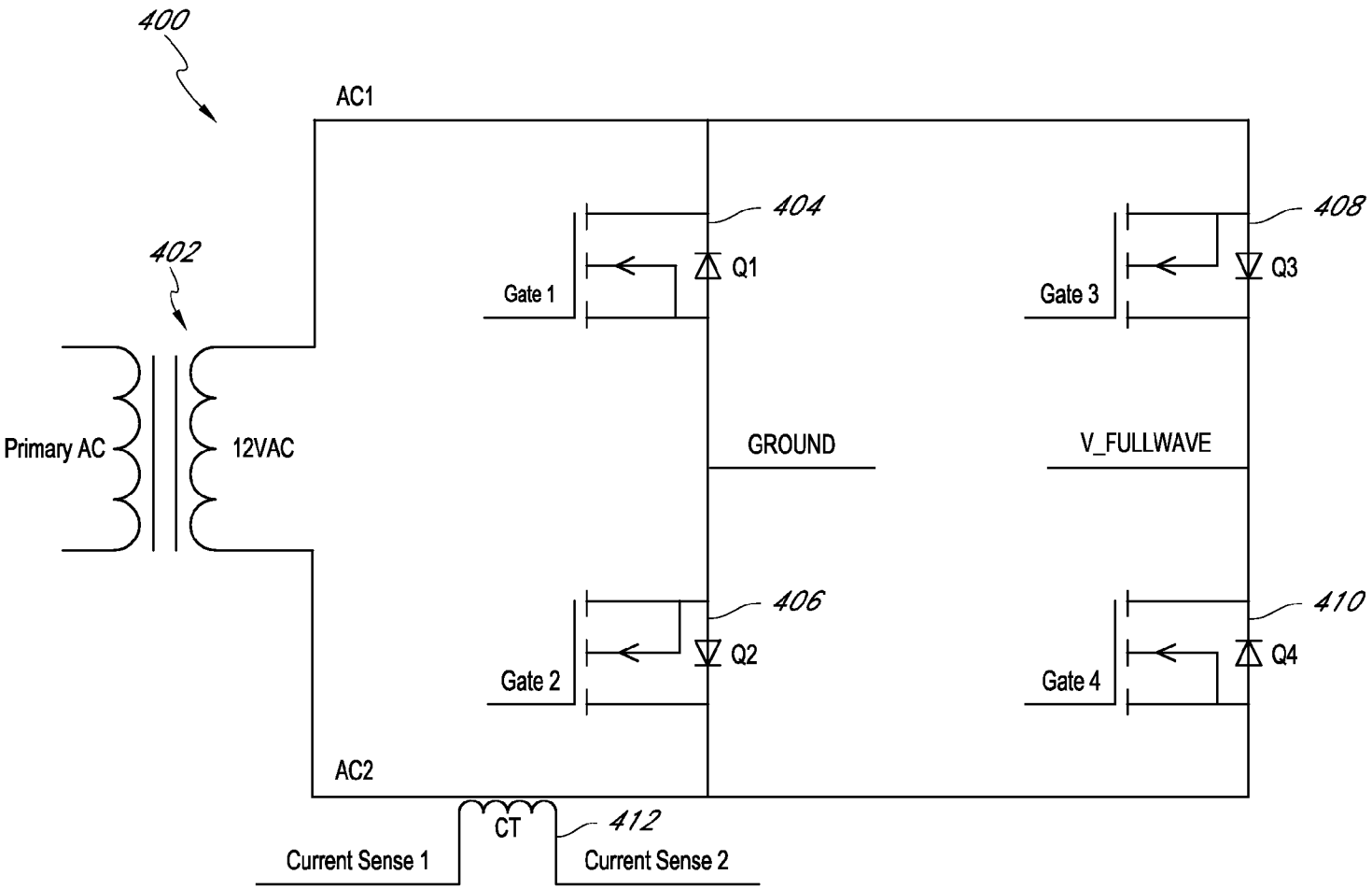
FIG. 4 is an exemplary schematic diagram of a rectifier circuit, according to certain embodiments.
Figure 5:
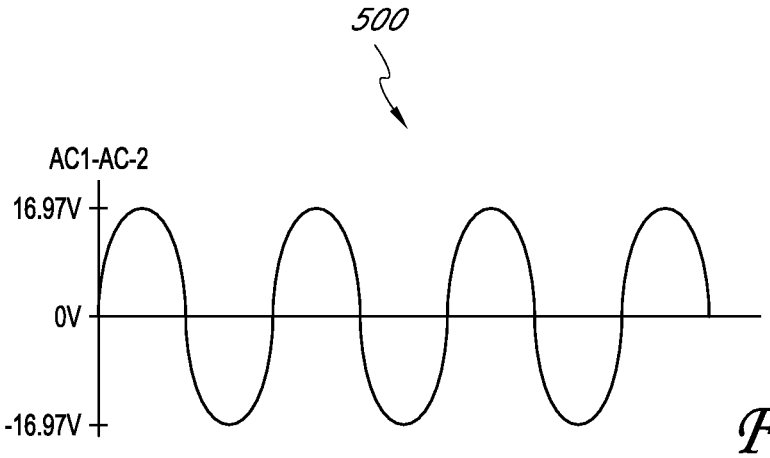
FIG. 5 depicts an exemplary power waveform, according to certain embodiments.

FIG. 4 is an exemplary schematic diagram of a synchronous rectifier circuit 400, according to an embodiment. The rectifier circuit 400 comprises a primary AC to 12 VAC transformer 402, a first transistor Q1 404, a second transistor Q2 406, a third transistor Q3 408, and a fourth transistor Q4 410. The primary AC to 12 VAC transformer 402 receives a primary AC power signal and outputs an approximately 12 VAC RMS power waveform having a first power waveform AC1 and a second power waveform AC2. FIG. 5 illustrates an exemplary 12 VAC RMS power waveform 500 having a peak-to-peak voltage of between approximately +16.97 volts to approximately −16.97 volts.

In an embodiment, the transistors Q1 404, Q2 406, Q3 408, Q4 410 are metal-oxide-semiconductor field-effect transistors (MOSFETs) with an integral body diode. The MOSFETs with the integral body diode advantageously function as a substantially loss-less switch when their gates are enabled at the appropriate point in time when their diodes would be conducting. For example, a MOSFET having a resistance of 1 milliohm conducting a current of 25 amps would attenuate a signal across it by approximately 25 millivolts. The synchronous rectifier 400 selectively turns on the MOSFETs when their body diodes would be conducting to create a highly efficient power supply 302.

In other embodiments, the transistors Q1 404, Q2 406, Q3 408, Q4 410 are P-channel or N-channel MOSFETs with or without an integral body diode. In yet other embodiments, transistors, such as Bipolar Junction Transistors (BJTs), Isolated Gate Bipolar Transistors (IGBTs), or the like, can be used.

In another embodiment, each transistor Q1 404, Q2 406, Q3 408, Q4 410 comprises more than one transistor connected in parallel. In another embodiment, multiple MOSFETs may be packaged in a single module.

The first transistor Q1 404 is coupled in series with the second transistor Q2 406 across AC1 and AC2, such that a drain of the first transistor Q1 404 connects to the first power waveform AC1, and a drain of the second transistor Q2 406 connects to the second power waveform AC2. Further, a source of first transistor Q1 404 connects to a source of the second transistor Q2 406 and forms a third power waveform GROUND.

The third transistor Q3 408 is coupled in series with the fourth transistor Q4 410 across AC1 and AC2, such that a source of the third transistor Q3 408 connects to the first power waveform AC1, and a source of the fourth transistor Q2 410 connects to the second power waveform AC2. Further a drain of the third transistor Q3 408 connects to a drain of the fourth transistor Q4 410 and forms a fourth power waveform V-FULLWAVE.

The series combination of the first transistor Q1 404 and the second transistor Q2 406 electrically couple in parallel with the series combination of the third transistor Q3 408 and fourth transistor Q4 410, such that the drain of the first transistor Q1 404 electrically couples to the source of the third transistor Q3 408, and the drain of the second transistor Q2 406 electrically couples to the source of the fourth transistor Q4 410.

Figure 6:
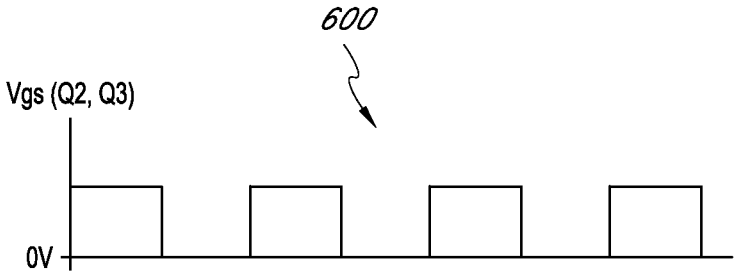
FIG. 6 depicts an exemplary waveform of the transistor gate signal for a rectifier circuit, according to certain embodiments.

Each transistor is associated with a gate signal and the gate signals electrically couple to an output of a comparator comparing the first and second power waveforms, AC1 and AC2, via driver circuitry. The gates of the second transistor Q2 406 and the third transistor Q3 408 enable when the first power waveform AC1 is greater than the second power waveform AC2. FIG. 6 depicts an exemplary waveform 600 of the transistor gate signal for the gates of the second transistor Q2 406 and the third transistor Q3 408, according to an embodiment. Referring to FIGS. 5 and 6, the gate signal Vgs (Q2,Q3) is enabled when AC1 is greater than AC2.

Further, the gates of the first transistor Q1 404 and the fourth transistor Q4 410 enable when the second power waveform AC2 is greater than the first power waveform AC1. FIG.

Figure 7:
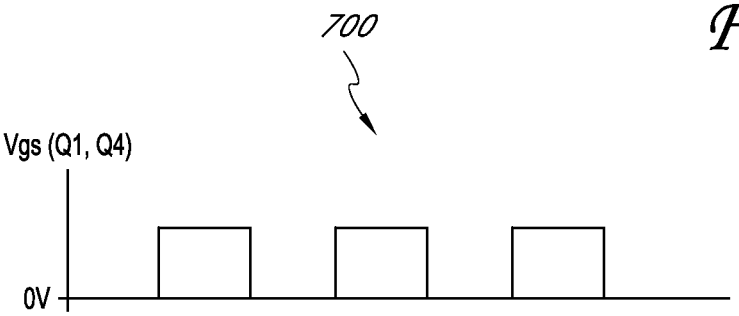
FIG. 7 depicts an exemplary waveform of another transistor gate signal for the rectifier circuit, according to certain embodiments.

7 depicts an exemplary waveform 700 for the gates of the first transistor Q1 404 and the fourth transistor Q4 410, according to an embodiment. Referring to FIGS. 5 and 7, the gate signal Vgs (Q1, Q4) is enabled when AC2 is greater than AC1.

Figure 8:
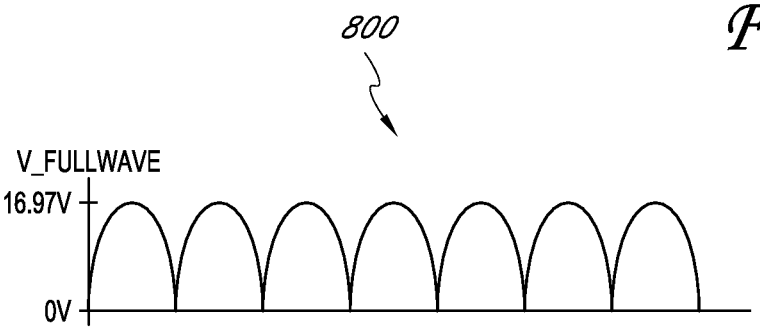
FIG. 8 depicts an exemplary rectified power waveform, according to certain embodiments.

The rectifier 400 full wave rectifies a 12 VAC RSM signal creating a the third power waveform GROUND and the fourth power waveform V-FULLWAVE. The rectified 12 VAC RMS signal, V-FULLWAVE, has a peak voltage of approximately 16.97 volts, which is approximately the same as the peak voltage of the power waveform at the output of the transformer 402. The small loss in signal is due to exemplary, but finite conduction of the transistors Q1 404, Q2 406, Q3 408, Q4 410 when their gates are enabled. FIG. 8 depicts an exemplary rectified 12 VAC RMS signal 800, according to an embodiment. As illustrated in FIG. 8, the rectifier 400 outputs a non-inverted 12 VAC RMS power waveform 800 when AC1 is greater than AC2 and outputs an inverted 12 VAC RMS waveform 800 when AC2 is greater than AC1.

Referring to FIG. 4, a current sensing element 412, such as a current transformer, magnetically couples to the wire/trace carrying the 12 VAC RMS power waveform. In one embodiment, the current transformer 412 magnetically couples to the wire/trace carrying the power waveform AC2. In another embodiment, the current transformer 412 magnetically couples to the wire/trace carrying the power waveform AC1. Current flowing through wire/trace carrying AC2, in the illustrated embodiment, produces a magnetic field in the core of the current transformer 412, which in turn induces a current in the winding wound around the core of the current transformer 412. The induced current is proportional to the current of the power waveform AC2, in the illustrated embodiment, or to the current of the power waveform AC1, in another embodiment. The current transformer 412 outputs signals, Current Sense1 and Current Sense 2, proportional to current flowing through the power waveforms AC1 or AC2. The signals Current Sense1 and Current Sense2 are used to determine when the current flowing in the power waveforms AC1 or AC2 is greater than a threshold value, such that power supply 302 can be disabled before damage to the circuitry occurs. Accordingly, the rectifier 400 of FIG. 4 advantageously produces the V-FULLWAVE waveform 800 of FIG. 8 with minimal power loss and correspondingly, minimal heat generation.

Figure 9:
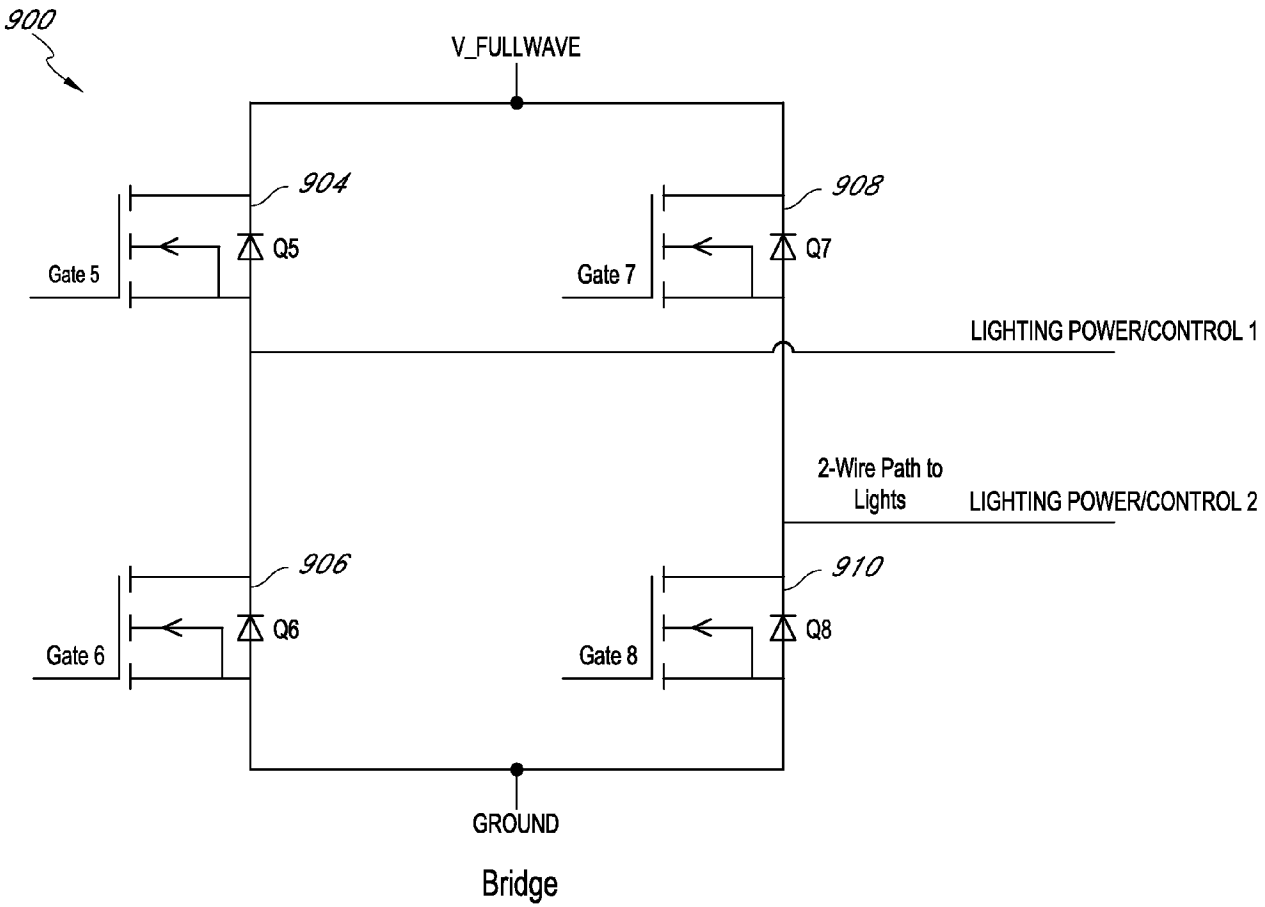
FIG. 9 is an exemplary schematic diagram of a bridge circuit, according to certain embodiments.

FIG. 9 is an exemplary schematic diagram of a bridge circuit 900, according to an embodiment. The bridge 900 comprises a fifth transistor Q5 904, a sixth transistor Q6 906, a seventh transistor Q7 908, and an eighth transistor Q8 910. The bridge 900 receives the rectified power waveforms V-FULLWAVE and GROUND from the rectifier 400. In the illustrated embodiment, V-FULLWAVE is an exemplary rectified 12 VAC RMS signal as shown in FIG. 8. Advantageously, in a disclosed embodiment, the bridge 900 selectively outputs the rectified power waveforms V-FULLWAVE, GROUND with either a positive polarity or a negative polarity. By doing so, data or intelligence can be added to the presently described power signal. Thus, the rectifier 400 and the bridge 900 combine to produce a power signal with embedded data or logic.

The positive or negative polarity of V-FULLWAVE is, for example, the control signals, LIGHTING CONTROL1, LIGHTING CONTROL2 on the two-wire path to the lighting modules 304. LIGHTING CONTROL1 and LIGHTING CONTROL2 comprise addresses/data/commands encoded within the power waveform V-FULLWAVE, to provide addresses/data/commands and power to the lighting modules 304.

In an embodiment, the transistors Q5 904, Q6 906, Q7 908, Q8 910 are metal-oxide-semiconductor field-effect transistors (MOSFETs) with an integral body diode. As described above, the MOSFETs with the integral body diode advantageously function as an almost or substantially loss-less switch when their gates are enabled at the appropriate point in time when their diodes would be conducting.

In other embodiments, the transistors Q5 904, Q6 906, Q7 908, Q8 910 are either P-channel or N-channel MOSFETs with or without an integral body diode. In yet other embodiments, transistors, such as Bipolar Junction Transistors (BJTs), Isolated Gate Bipolar Transistors (IGBTs), or the like, can be used.

In another embodiment, each transistor Q5 904, Q6 906, Q7 908, Q8 910 comprises more than one transistor connected in parallel. In another embodiment, multiple MOSFETs may be packaged in a single module.

The fifth transistor Q5 904 is coupled in series with the sixth transistor Q6 906 across V-FULLWAVE and GROUND, such that a drain of the fifth transistor Q5 904 connects to the power waveform V-FULLWAVE, and a source of the sixth transistor Q6 906 connects to the power waveform GROUND. Further, a source of the fifth transistor Q5 904 connects to a drain of the sixth transistor Q6 906 and forms the first control signal, LIGHTING POWER/CONTROL1.

The seventh transistor Q7 908 is coupled in series with the eighth transistor Q8 910 across V-FULLWAVE and GROUND, such that a drain of the seventh transistor Q7 908 connects to the power waveform V-FULLWAVE, and a source of the eighth transistor Q8 910 connects to the power waveform GROUND. Further a source of the seventh transistor Q7 908 connects to a drain of the eighth transistor Q8 910 and forms the second control signal, LIGHTING POWER/CONTROL2.

The series combination of the fifth transistor Q5 904 and the sixth transistor Q6 906 electrically couple in parallel with the series combination of the seventh transistor Q7 908 and eighth transistor Q8 910, such that the drain of the fifth transistor Q5 904 electrically couples to the drain of the seventh transistor Q7 908, and the source of the sixth transistor Q6 906 electrically couples to the source of the eighth transistor Q8 910.

Each transistor Q5 904, Q6 906, Q7 908, Q8 910 is associated with a gate signal. The gate signals electrically couple, via driver circuitry, to a control signal comprising data from the processor 314 associated with the operator interface panel 308 and the output of the comparator comparing the power waveforms AC1, AC2. The gates of the fifth transistor Q5 904 and the eighth transistor Q8 910 are enabled when the control signal is in a first state. When the gates of the fifth transistor Q5 904 and the eighth transistor Q8 910 are enabled, the bridge 900 outputs the power waveforms V-FULLWAVE and GROUND having a first polarity on the two-wire path as signals LIGHTING POWER/CONTROL1 and LIGHTING POWER/CONTROL2. The gates of the sixth transistor Q6 906 and the seventh transistor Q7 908 are enabled when the control signal is in a second state. When the gates of the sixth transistor Q6 906 and the seventh transistor Q7 908 are enabled, the bridge 900 outputs the power waveforms V-FULLWAVE and GROUND having a second polarity on the two-wire path as signals LIGHTING POWER/CONTROL1 and LIGHTING POWER/CONTROL2.

For example, in one embodiment, when the gates of the fifth transistor Q5 904 and the eighth transistor Q8 910 are enabled, the signals LIGHTING POWER/CONTROL1 and LIGHTING POWER/CONTROL2 comprise the power waveforms V-FULLWAVE and GROUND having a positive polarity. Further, when the gates of the sixth transistor Q6 906 and the seventh transistor Q7 908 are enabled, signals LIGHTING POWER/CONTROL1 and LIGHTING POWER/CONTROL2 comprise the power waveforms V-FULLWAVE and GROUND having a negative polarity.

In another embodiment, the polarities can be reversed, such that the signals LIGHTING POWER/CONTROL1 and LIGHTING POWER/CONTROL2 comprise power waveforms V-FULLWAVE and GROUND having a negative polarity when gates of the fifth transistor Q5 904 and the eighth transistor Q8 910 are enabled and comprise power waveforms V-FULLWAVE and GROUND having a positive polarity when the gates of the sixth transistor Q6 906 and the seventh transistor Q7 908 are enabled.

As discussed above, the gate signals electrically couple, via driver circuitry, to a control signal comprising data from the processor 314 associated with the operator interface panel 308 and the output of the comparator comparing the power waveforms AC1, AC2. When there is no data present, the control signal follows the output of the comparator comparing the power waveforms AC1, AC2.

Figure 10:
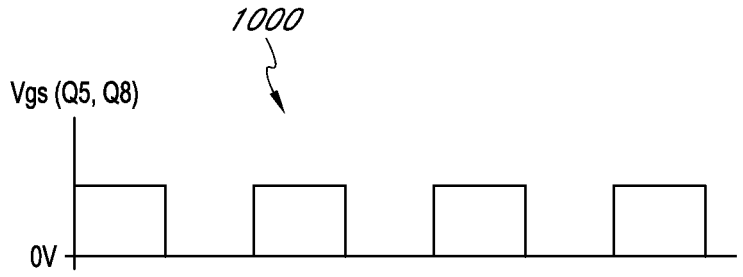
FIG. 10 depicts an exemplary waveform of the transistor gate signal for a bridge circuit, according to certain embodiments.

FIG. 10 depicts an exemplary waveform 1000 of the transistor gate signal for the gates of the fifth transistor Q5 904 and the eighth transistor Q8 910 with no data present. As shown in FIGS. 5 and 10, the gate signal Vgs (Q5,Q8) is enabled when AC1 is greater than AC2.

Figure 11:
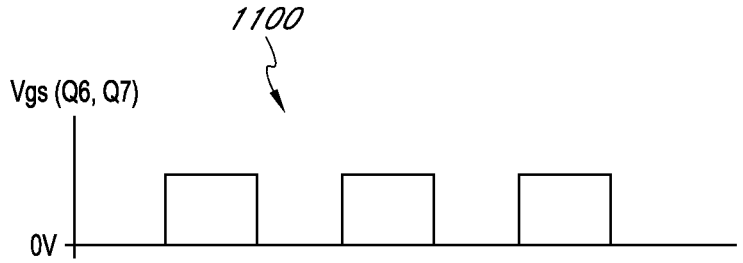
FIG. 11 depicts an exemplary waveform of another transistor gate signal for the bridge circuit, according to certain embodiments.

FIG. 11 depicts an exemplary waveform 1100 of the transistor gate signal for the gates of the sixth transistor Q6 906 and the seventh transistor Q7 908 with no data present. As shown in FIGS. 5 and 11, the gate signal Vgs (Q5,Q8) is enabled when AC2 is greater than AC1.

Figure 12:
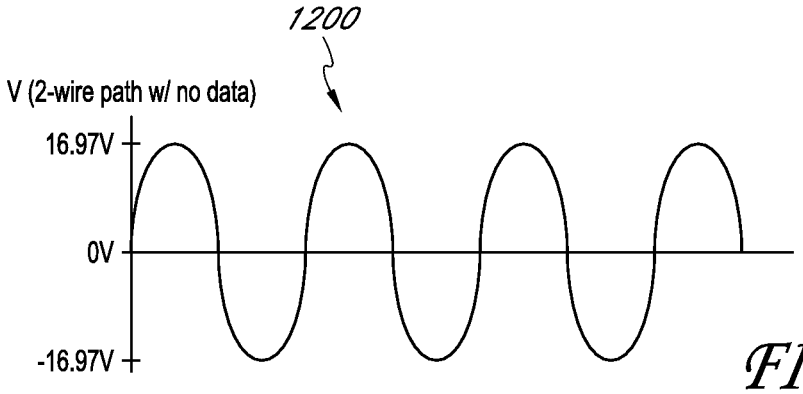
FIG. 12 depicts an exemplary power/data waveform without data, according to certain embodiments.

FIG. 12 depicts an exemplary bridge output waveform 1200 when there is no data present from the processor 314, in one embodiment. As illustrated in FIGS. 10, 11, and 12, the bridge 900 outputs V-FULLWAVE with a positive polarity when the gates of the fifth transistor Q5 904 and the eighth transistor Q8 910 are enabled and outputs V-FULLWAVE with a negative polarity when the gates of the sixth transistor Q6 906 and the seventh transistor Q7 908 are enabled, generating approximately a sine wave. As shown, without data on the power signal for the lights, the rectifier 400 and the bridge 900 take the 12 VAC RMS output of the transformer 402, which is illustrated as its 16.97 VAC peak-to-peak waveforms AC1 and AC2 in FIG. 5, fullwave rectify it, and change it back to its original form using substantially or almost loss-less circuitry. However, as described herein, the same rectifier 400 and bridge 900 accept control signals from the processor 314 according to user programming to selectively control one or more fixtures 104, 204 in one or more zones 106, 206. The control signals activate the gates with the same or substantially similar almost loss-less process in a manner that embeds logic or data on the power signal 1200 of FIG. 12.

Figure 13:
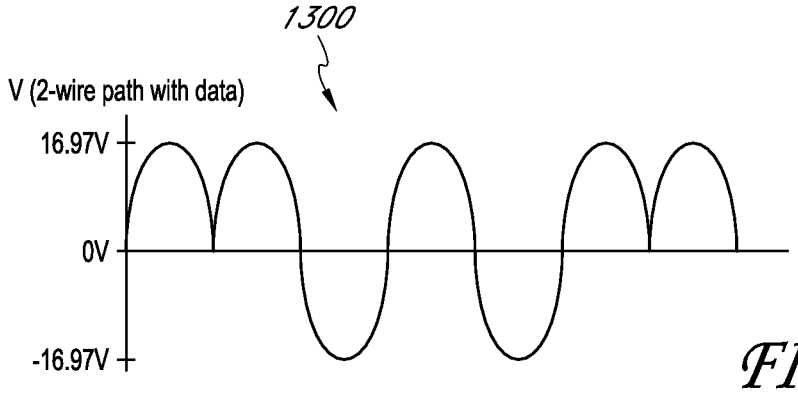
FIG. 13 depicts an exemplary power/data waveform with data, according to certain embodiments.

For example, when the control signal controlling the transistor gates comprises data from the processor 314 associated with the operator interface panel 308, the bridge 900 encodes the data onto the signals LIGHTING POWER/CONTROL1 and LIGHTING POWER/CONTROL2 such that the bridge 900 outputs V-FULLWAVE having one polarity when the control signal is in a first sate and outputs V-FULLWAVE having the opposite polarity when the control signal is in the second state. FIG. 13 depicts an exemplary power/data waveform 1300 with data, according to an embodiment. FIG. 13 illustrates a start bit comprising 1, 1, followed by the data bits, 0, 1, 0, 1, 1. In other embodiments, other configurations of start bits can be used and opposite polarities can be used to represent the 0 and 1 data bits. For instance, the control signal may change state at the peaks or any point of V-FULLWAVE as opposed to at the point V-FULLWAVE is zero. In summary, the bridge 900 is used synchronously with the VAC power waveform from the transformer 302 to select either a positive or a negative peak or half-cycle of the power waveform and apply the selected half-cycle to the output signals, LIGHTING POWER/CONTROL1 and LIGHTING POWER/CONTROL2 to encode data within the power waveform for transmission to the lighting modules 304.

In an embodiment where the transformer 402 produces approximately a 12 VAC 60 hertz power waveform, the data rate is approximately 120 bits per second. In another embodiment, the lighting modules 304 comprise a comparator comparing the signals LIGHTING POWER/CONTROL1, LIGHTING POWER/CONTROL2 to detect the data and a full wave rectifier to rectify the signals LIGHTING POWER/CONTROL1, LIGHTING POWER/CONTROL2 to provide power to the lighting elements.

In an embodiment, the transistors Q5 904, Q6 906, Q7, 908, Q8, 910 are turned on at the zero crossing of the controls signal because advantageously, the lighting modules 304 draw less power. At that time, there is less voltage or current flowing and less EMI noise is generated. In other embodiments, the transistors Q5 904, Q6 906, Q7, 908, Q8, 910 are turned on and off at other than the zero crossing of the control signal.

Another advantage of sending the data as either a positive polarity or a negative polarity rectified power wave form is there is no DC bias on the two-wire data/power path. If a DC bias is present, moisture seeping through the wires can produce unwanted galvanic corrosion.

Figure 14:
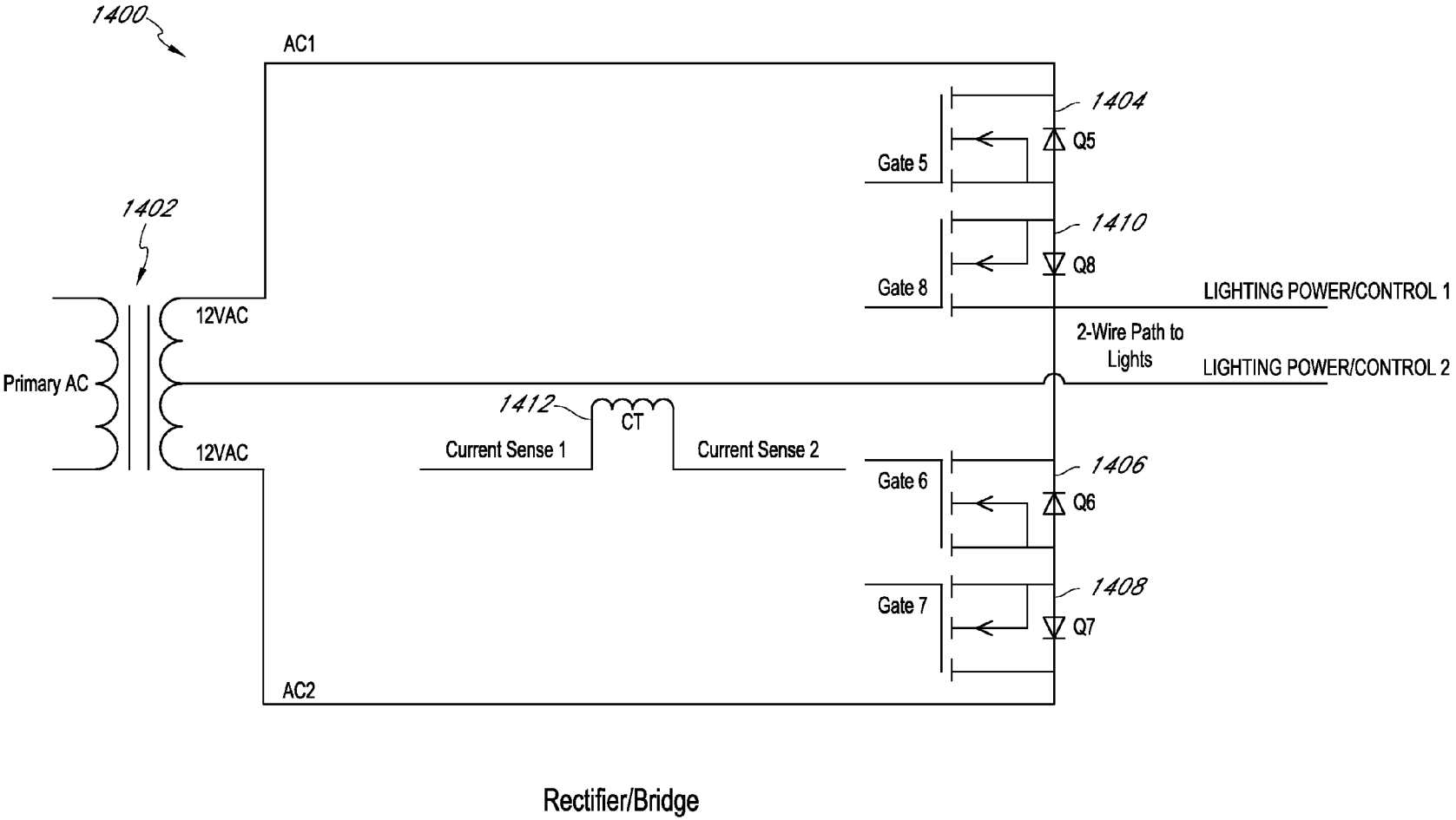
FIG. 14 is an exemplary schematic diagram of a rectifier/bridge circuit, according to certain embodiments.

FIG. 14 is an exemplary schematic diagram of a rectifier/bridge circuit 1400, according to an embodiment, which is also capable of producing a power signal with embedded data the same or similar to those disclosed above. The rectifier/bridge circuit 1400 comprises a primary AC to 24 VAC center-tapped transformer 1402, a current transformer 1412, a fifth transistor Q5 1404, a sixth transistor Q6 1406, a seventh transistor Q7 1408, and an eighth transistor Q8 1410. The current transformer 1412 senses the current in the center tap of the transformer 1402 as described above with respect to FIG. 4.

The primary AC to 24 VAC transformer 1402 receives a primary AC power signal and outputs an approximately 12 VAC RMS between each end tap and the center tap. This waveform being a power waveform having the first power waveform AC1 and the second power waveform AC2. Referring to FIG. 5, the exemplary 12 VAC RMS power waveform 500 has a peak-to-peak voltage of between approximately +16.97 volts to approximately −16.97 volts. Further, the center tap of transformer 1402 electrically couples to one wire of the two-wire path and forms the signal LIGHTING POWER/CONTROL2.

In an embodiment, the transistors Q5 1404, Q6 1406, Q7 1408, Q8 1410 are metal-oxide-semiconductor field-effect transistors (MOSFETs) with an integral body diode. In other embodiments, the transistors Q5 904, Q6 906, Q7 908, Q8 910 are either P-channel or N-channel MOSFETs with or without an integral body diode. In another embodiment, each transistor Q5 904, Q6 906, Q7 908, Q8 910 comprises more than one transistor connected in parallel. In another embodiment, multiple MOSFETs may be packaged in a single module.

The transistors Q5 904, Q6 906, Q7 908, Q8 910 are coupled in series such that a source of the fifth transistor Q5 1404 connects to a source of the eighth transistor Q8 1410, a drain of the eighth transistor Q8 1410 connects to a drain of the sixth transistor Q6 1406 and couples to the other wire of the two-wire path and forms the signal LIGHTING POWER/CONTROL1, and a source of the sixth transistor Q6 1406 connects to a source of the seventh transistor Q7 1408. The series combination of the transistors Q5 1404, Q8 1410, Q6 1406, Q7 1408 connects to the power waveforms AC1, AC2 such that a drain of the fifth transistor Q5 electrically connects to AC1 and a drain of the seventh transistor Q7 1408 electrically connects to AC2.

Each transistor Q5 1404, Q6 1406, Q7 1408, Q8 1410 is associated with a gate signal. The gate signals electrically couple, via driver circuitry, to the control signal comprising data from the processor 314 associated with the operator interface panel 308 and the output of the comparator comparing the power waveforms AC1, AC2, as described above with respect to FIG. 9.

As shown in FIG. 14, one of the wires in the two-wire path to the lighting modules is the center tap of the transformer 1402. Depending on whether the gates of transistors Q5 1404 and Q8 1410 or Q6 1406 and Q7 1408 are enabled, the positive half-cycle or the negative half-cycle of the power waveform AC1, AC2 is sent on the other wire of the two-wire path to the lighting modules 304. In this manner, the data from the controller 314 can be encoded within the power waveform sent to the lighting modules 304. The rectifier/bridge 1400 can transmit the same data and power to the lighting modules 304 as the combination of the rectifier 400 and the bridge 900, but advantageously with fewer MOSFETs.

Figure 15:
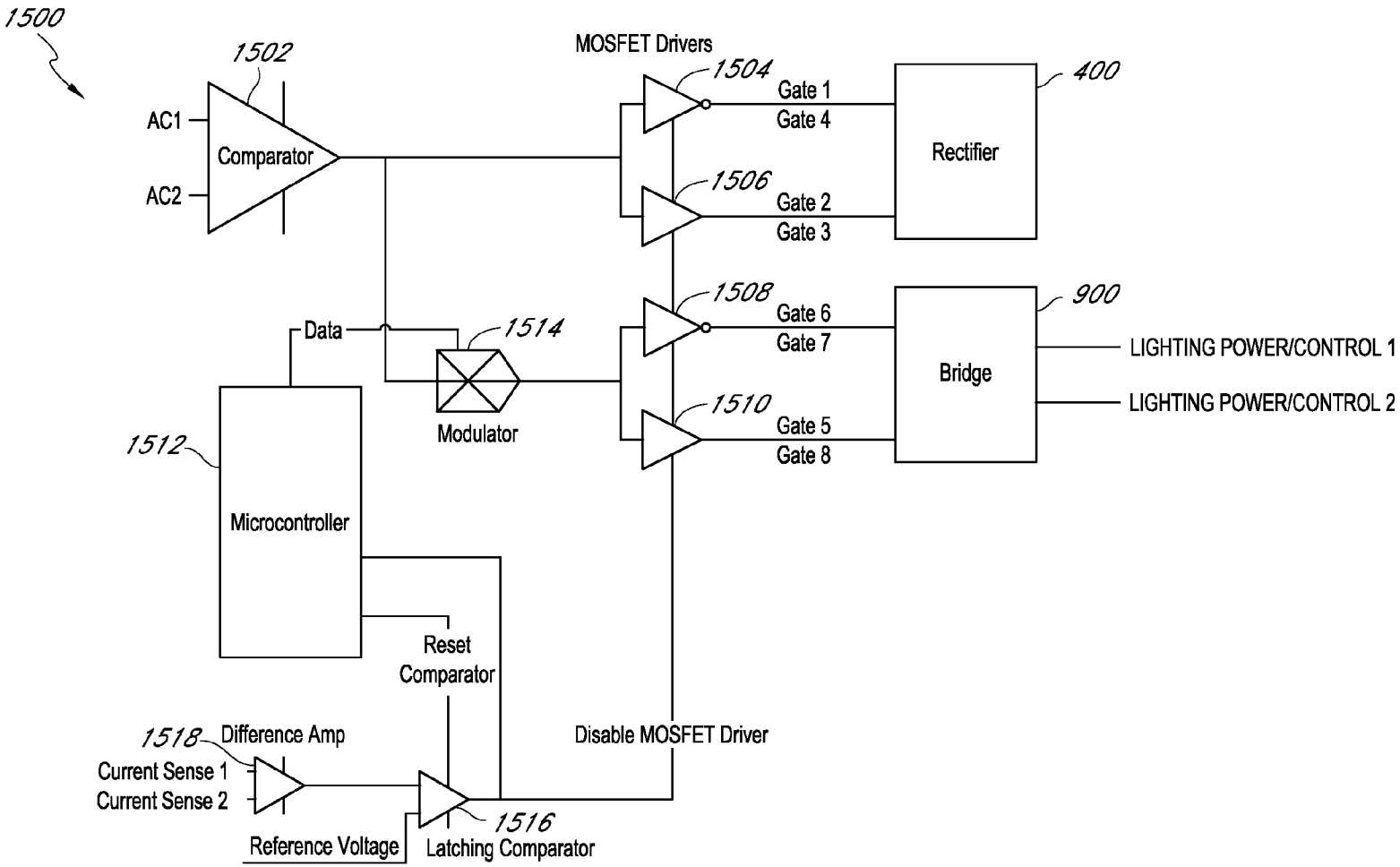
FIG. 15 is an exemplary schematic diagram of circuitry for phase detect, timing generation and drivers, according to certain embodiments.

FIG. 15 is an exemplary schematic diagram of circuitry 1500 comprising phase detect circuitry, timing generation circuitry, driver circuitry, and over current protection circuitry, according to certain embodiments. The circuitry 1500 comprises a comparator 1502, MOSFET drivers 1504, 1506, 1508, 1510, a computer 1512, a modulator 1514, a difference amplifier 1518, and a latching comparator 1516.

The comparator 1502 receives the power waveforms AC1, AC2 and electrically couples an output to the gates of the transistors Q1 404, Q2 406, Q3 408, Q4 410 in the rectifier 400 via the drivers 1504, 1506. The power waveforms AC1, AC2 received by the comparator 1502 have been preconditioned as is known to one of skill in the art to be within the acceptable input voltage range for the comparator 1502. The comparator 1502 compares AC1 and AC2 and, in one embodiment, outputs a positive pulse when AC1 is greater than AC2 and outputs a ground or negative pulse when AC2 is greater than AC1. While the input to the comparator is a sine wave, as shown in FIG. 5, the output is a square wave. The output of the comparator 1502 couples to the input of the inverting driver 1504, and the input of the non-inverting driver 1506.

The output of the non-inverting driver 1506 couples to the gates of transistors Q2 406 and Q3 408 on the rectifier 400. The waveform 600, in FIG. 6, illustrates an example of the transistor gate signal for the gates of the second transistor Q2 406 and the third transistor Q3 408. Referring to FIGS. 5 and 6, the output of the comparator, which is the input to the driver 1506, is positive and the gate signal Vgs (Q2,Q3) is enabled when AC1 is greater than AC2. Further, the output of driver 1504 is low and the transistors Q1 404 and Q4 410 are off when AC1 is greater than AC2.

The output of the inverting driver 1504 couples to the gates of transistors Q1 404 and Q4 410 on the rectifier 400. The waveform 700, in FIG. 7, illustrates an example of the transistor gate signal for the gates of the first transistor Q1 404 and the fourth transistor Q4 410. Referring to FIGS. 5 and 7, the output of the comparator 1502, which is the input to the inverting driver 1504, is negative or ground, and the gate signal Vgs (Q1, Q4) is enabled when AC2 is greater than AC1. Further, the output of driver 1506 is low and the transistors Q2 406 and Q3 408 are off when AC2 is greater than AC1.

The modulator 1514 receives the output of the comparator 1502 and receives a data signal from the computer 1512. The data signal comprises addresses/data/commands from the operator interface panel 308. In an embodiment, computer 1512 is computer 314. In another embodiment, computer 314 and computer 1512 are different computers. The computer 1512 comprises, by way of example, those devices or structures similar to computer 314.

An output of the modulator 1514 connects to the input of inverting driver 1508 and to the input of non-inverting driver 1510. The modulator 1514 passes the output of the comparator 1502 to the drivers 1508, 1510 when no data is present. The signal on the two-wire path to the lighting modules 304 is the sine wave 1200, shown in FIG. 12, when no data is present.

The output of the non-inverting driver 1510 couples to the gates of transistors Q5 904, 1404 and Q8 910, 1410 on the bridge 900 or the rectifier/bridge 1400. The waveform 1000, in FIG. 10, illustrates an example of the transistor gate signal for the gates of the fifth transistor Q5 904, 1404 and the eighth transistor Q8 910, 1410. Referring to FIGS. 5 and 10, the gate signal Vgs (Q5, Q8) is enabled when AC1 is greater than AC2 and data is absent.

The output of the inverting driver 1508 couples to the gates of transistors Q6 906, 1406 and Q7 908, 1408 on the bridge 900 or the rectifier/bridge 1400. The waveform 1100, in FIG. 11, illustrates an example of the transistor gate signal for the gates of the sixth transistor Q6 906, 1406 and the seventh transistor Q7 908, 1408. Referring to FIGS. 5 and 11, the gate signal Vgs (Q6, Q7) is enabled when AC2 is greater than AC1 and data is absent.

As shown, without data on the power signal for the lights, the rectifier/bridge 1400 takes the center tap of the transformer 1402, as one wire of the two-wire path to the lighting fixtures 104, 204. Depending on whether Q5 1404 and Q8 1410, or Q6 1406 and Q7 1408 are enabled, the rectifier/bridge 1400 sends the positive half-cycle or the negative half-cycle of the 12 VAC RMS output of the transformer 1402, which is illustrated as its 16.97 VAC peak-to-peak waveforms AC1 and AC2 in FIG. 5 on the other wire of the two-wire path, using substantially or almost loss-less circuitry. However, as described herein, the same rectifier/bridge 1400 accept control signals from the processor 314 according to user programming to selectively control one or more fixtures 104, 204 in one or more zones 106, 206. The control signals activate the gates with the same or substantially similar almost loss-less process in a manner that embeds logic or data on the power signal 1200 of FIG. 12.

When data is present, the modulator functions as a selective inverter, in an embodiment. The data signal inverts the signal between the comparator 1502 and the drivers 1508, 1510. For example, when the data is high, the modulator acts as an inverter and inverts the signal from the comparator 1502 before the signal is received by the drivers 1508, 1510. When the data is low, the modulator passes the output of the comparator 1502 to the drivers 1508, 1510. This permits the phase of the signals LIGHTING POWER/CONTROL1, LIGHTING POWER/CONTROL2 output from the bridge 900 or rectifier/bridge 1400 on the two-wire path to the lighting modules 304 to be adjusted on a half-cycle basis to encode the data within the power waveform. Referring to FIG. 13, the waveform 1300 illustrates an example of a data encoded power waveform comprising a start sequence, 1, 1, followed by data bits 0, 1, 0, 1, 1.

Referring to FIG. 15, the difference amplifier 1518 receives the signals, CURRENT SENSE1, CURRENT SENSE2, from the current transformer 412, 1412, which are proportional to the current flowing out of the transformer 402. The difference amplifier 1518 subtracts CURRENT SENSE1, CURRENT SENSE2 to create a single ended current protection signal. The latching comparator 1516 receives the output of the difference amplifier 1518 and compares the current protection signal to a reference voltage or threshold. The output of the latching comparator 1516 couples to an enable signal common to the drivers 1504, 1506, 1508, 1510. When the peak voltage of the current protection signal exceeds the threshold, the output of the latching comparator 1516 disables the drivers 1504, 1506, 1508, 1510 to prevent an overcurrent event from damaging the circuitry.

Further, processor 1512 receives the latched output of the latching comparator 1516 and the latching comparator 1516 receives a reset signal from the processor 1512. In an embodiment, the processor 1512 can reset the latching comparator 1516. In another embodiment, the processor 1512 can alert the user to the overcurrent event through communication with the processor 314. The processor 314 could then display the information on the display 312.

Figure 16:
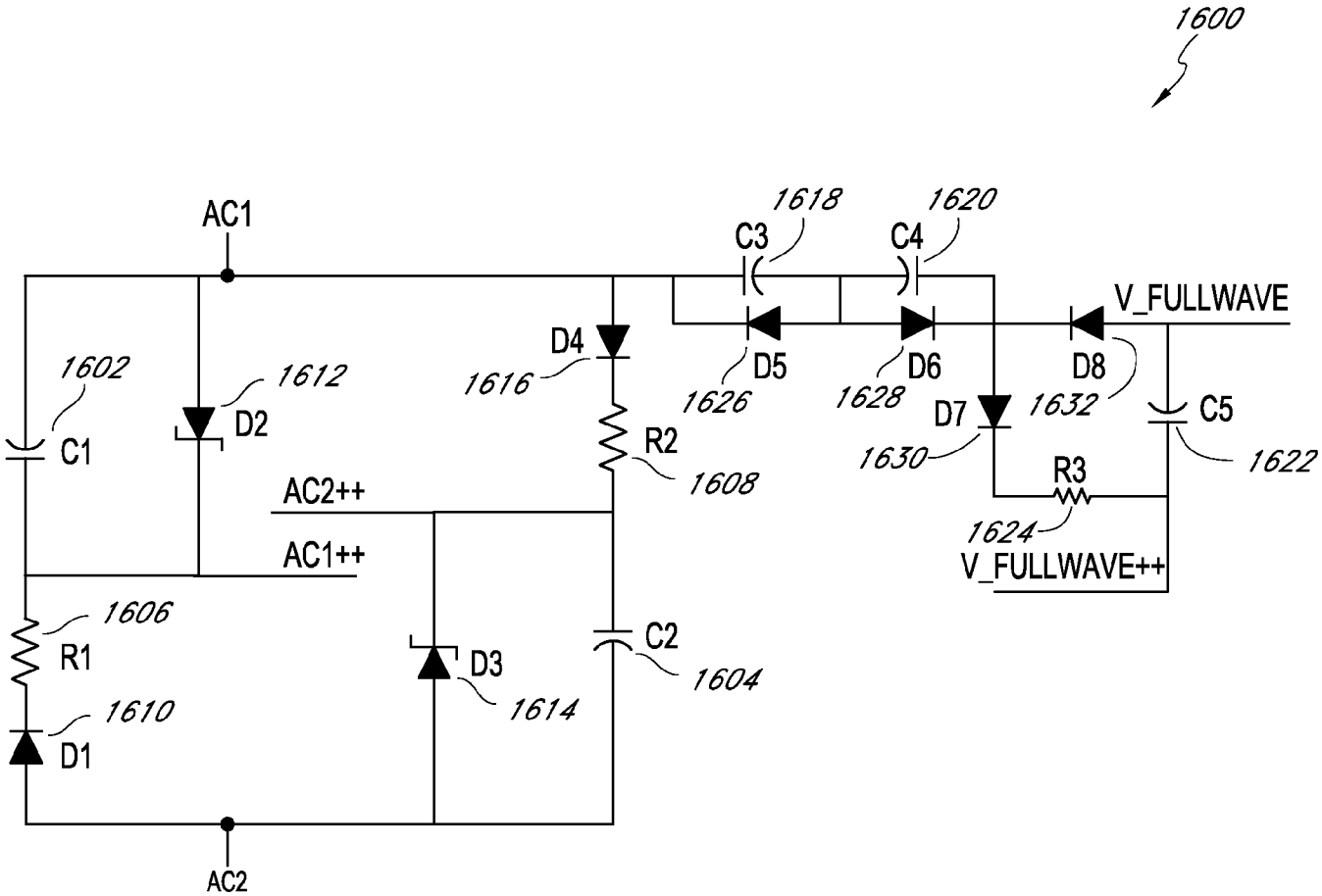
FIG. 16 is an exemplary schematic diagram of a bias circuit, according to certain embodiments.

FIG. 16 is an exemplary schematic diagram of a bias circuit 1600, according to an embodiment. In embodiments of the rectifier 400, the bridge 900 and the rectifier/bridge 1400, the sources of some of the transistors Q1-Q8 are electrically connected to one of the two AC outputs, AC1, AC2, of the transformer 402, 1402 or to the rectified power waveform V-FULLWAVE. When the transistor or MOSFET is turned on, nominally the gate voltage should be approximately 5 volts +/− about 4 volts to approximately 10 volts +/− about 5 volts more positive than the source voltage, for proper operation, as is known to one of skill in the art from the disclosure herein. However, this is a higher voltage than is present at the output of the transformer 402, 1402. The bias circuitry 1600 functions to provide the transistors Q1-Q8 in the rectifier 400, the bridge 900 and the rectifier/bridge 1400 with the higher gate voltage.

The bias circuit 1600 receives the power waveforms AC1, AC2 from the transformer 402, 1402 and generates the power waveforms AC1++, AC2++ that are at a higher DC level than AC1, AC2, but follow the AC1, AC2 waveforms, respectively. For example, AC1++ and AC2++ may have a DC offset of about 10 volts to about 20 volts above AC1, AC2, as they move up and down with AC1, AC2. AC1++, AC2++ power the MOSFET driver integrated circuits 1508, 1510 that provide the gate signals for the MOSFETs Q5 904, Q6 406, Q7 908, Q8 910, in the bridge 900 and the MOSFETs Q5 1404, Q6 1406, Q7 1408, Q8 1410 in rectifier/bridge 1400.

The bias circuit 1600 comprises capacitors C1 1602, C2 1604, resistors R1 1606, R2 1608, and diodes D1 1610, D2 1612, D3 1614, D4 1616. AC2 electrically couples to an anode of diode D1 1610 and the series combination of diode D1 1610 and resistor R1 1602 half-wave rectify AC2 with respect to AC1 and capacitor C1 1602 stores the voltage. An anode of diode D2 1612 couples to an end of capacitor C1 1602. Diode D2 1612 is a zener or clamping diode and clamps the voltage at the clamping value. In an embodiment, diode D2 1616 is an +18 volt zener diode. A cathode of diode D2 1612 provides the power waveform AC1++.

Similarly, AC1 electrically couples to an anode of diode D4 1616 and the series combination of diode D4 1616 and resistor R2 1608 half-wave rectify AC1 with respect to AC2 and capacitor C2 1604 stores the voltage. An anode of diode D3 1614 couples to an end of capacitor C2 1604. Diode D3 1614 is a zener or clamping diode and clamps the voltage at the clamping value. In an embodiment, diode D3 1614 is an +18 volt zener diode. A cathode of diode D3 1614 provides the power waveform AC2++. In other embodiments, Diodes D2 1612, D3 1614 can have clamping values at other than +18 volts.

The bias circuit 1600 further receives the power waveform AC1 from the transformer 402 and V-FULLWAVE from the rectifier 400 and generates the power waveform V-FULLWAVE++. V-FULLWAVE++ is approximately AC1 half-wave rectified and at a DC level that is no lower than approximately one diode drop below V-FULLWAVE. V-FULLWAVE powers the MOSFET driver integrated circuits 1504, 1506 that provide the gate signals for the MOSFETs Q1 404, Q2 406, Q3 408 Q4 410 in the synchronous rectifier 400.

The bias circuit further comprises capacitors C3 1618, C4 1620, C5 1622, resistor R3 1624, and diodes D5 1626, D6 1628, D7 1630, D8 1632. AC1 electrically couples to a first end of capacitor C3 1618 and a cathode of diode D5 1626. A second end of capacitor C3 1618 connects to a first end of capacitor C4 1620, an anode of diode D5 1626 and an anode of diode D6 1628. A second end of capacitor C4 1620 and a cathode of diode D6 1628 couple to an anode of diode D7 1630 and a cathode of diode D8 1632. Capacitors C3 1618, C4 1620, diode D5 1626, and diode D6 1628 form a charge pump circuit using the power waveform AC1. An anode of diode D8 1632 electrically couples to V-FULLWAVE and clamps the AC signal passing through the capacitors C3 1618, C4 1620 at approximately one diode drop below V-FULLWAVE at the cathode of diode D8 1632. The series combination of diode D7 1630 and resistor R3 1624 half-wave rectify the clamped V-FULLWAVE signal with respect to V-FULLWAVE and capacitor C5 1622 stores the voltage. An end of capacitor C5 1622 couples to an end of resistor R3 1624 and provides the power waveform V-FULLWAVE++.

Figures 1, 17A:
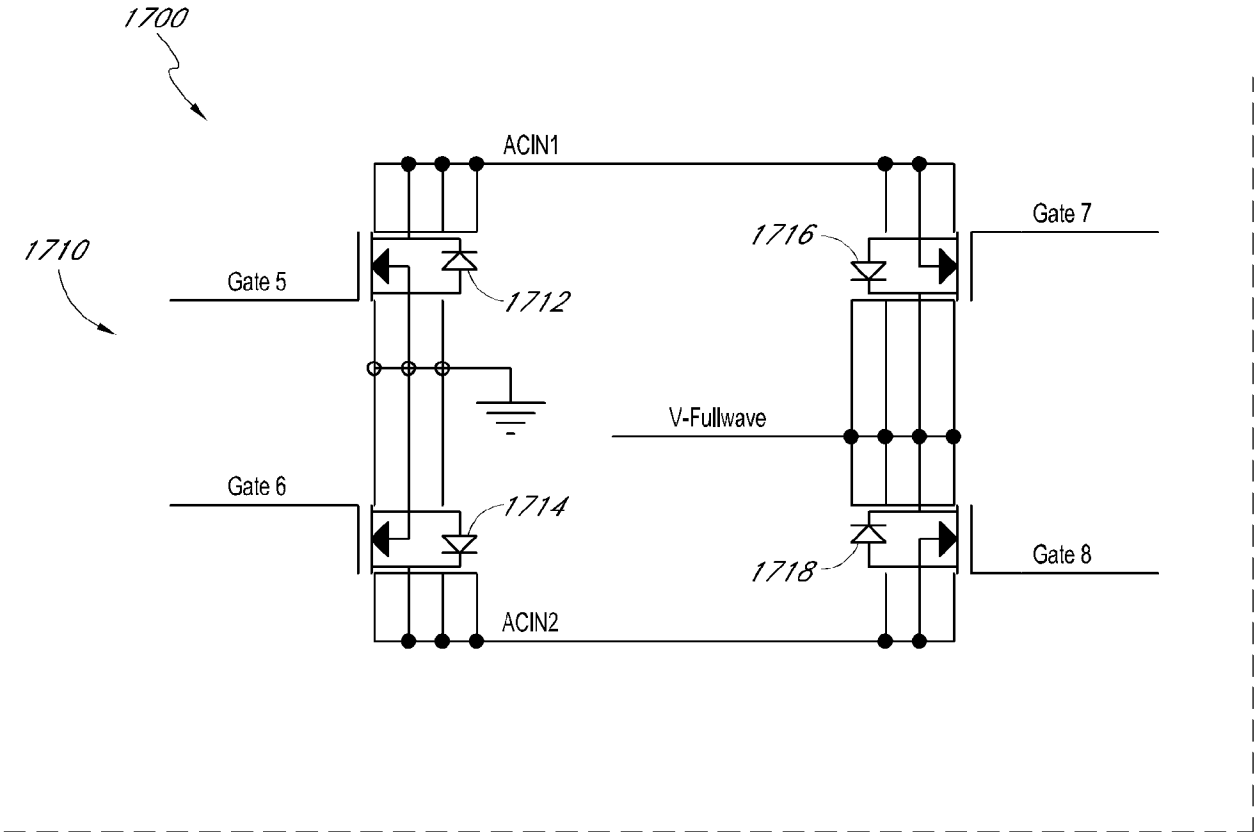
FIG. 17A comprising 17A1-17A4 and 17B comprising 17B1-17B4 are exemplary circuit diagrams for a lighting controller, according to one embodiment.
Figures 2, 17A:
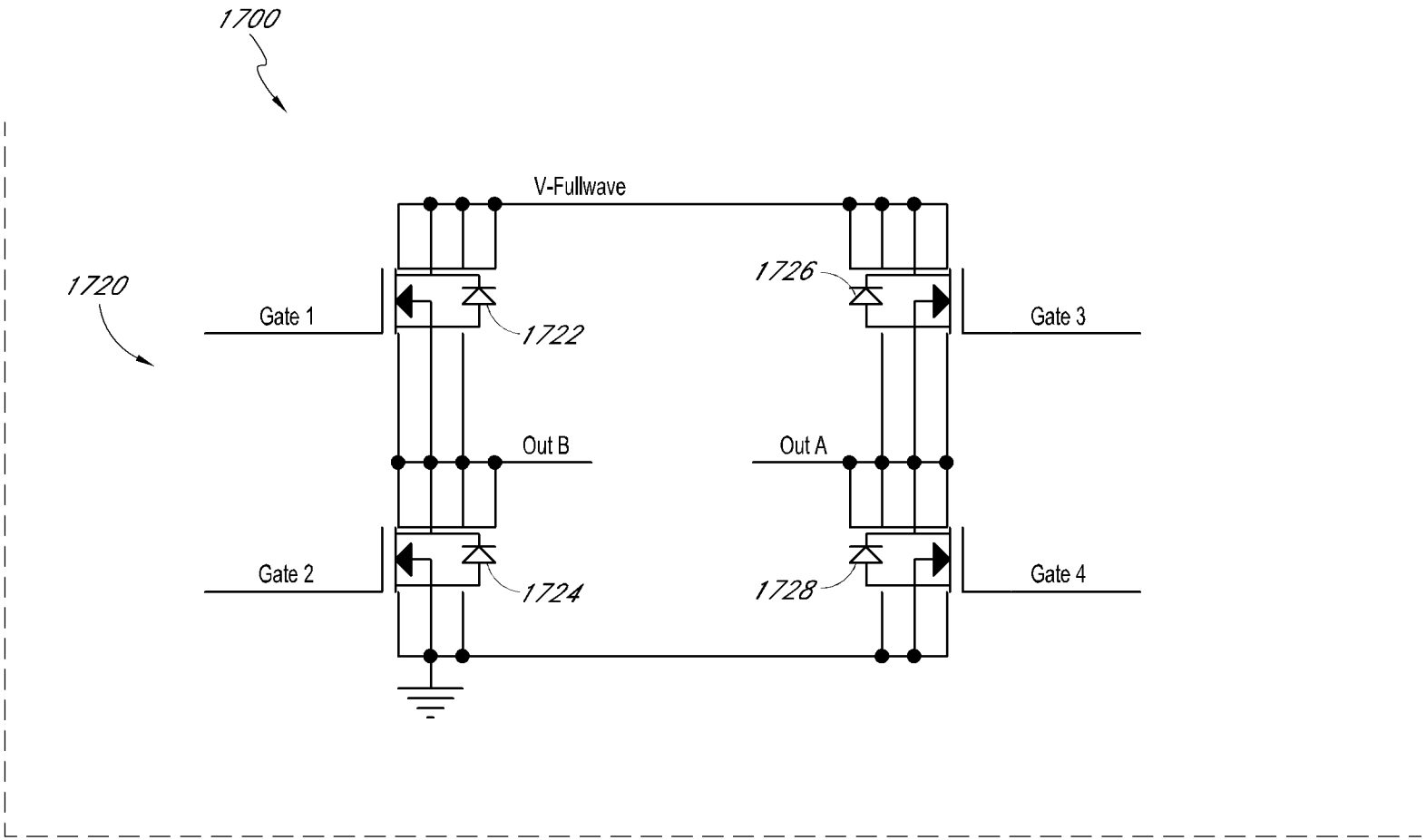
Figures 3, 17A:
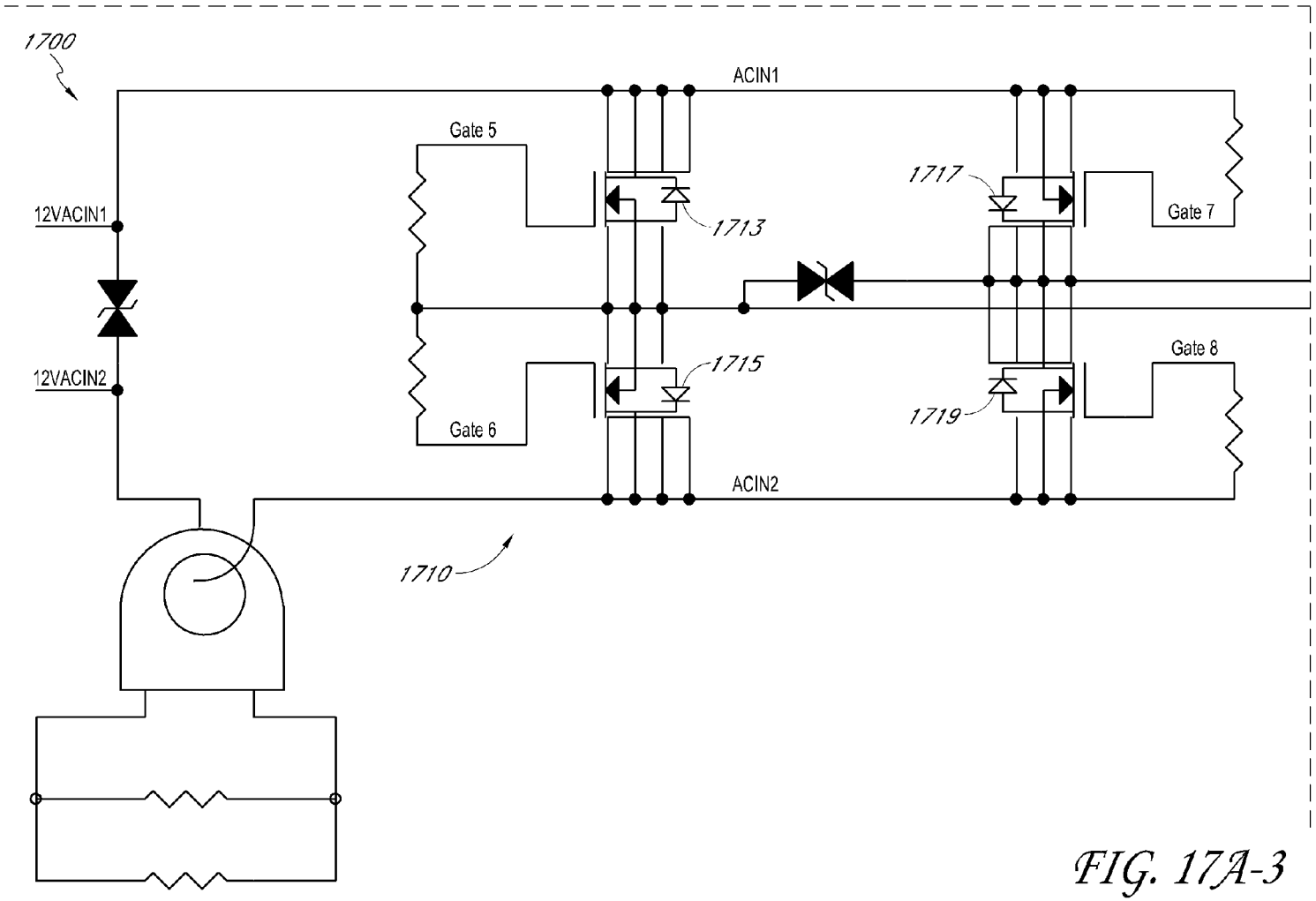
Figures 4, 17A:
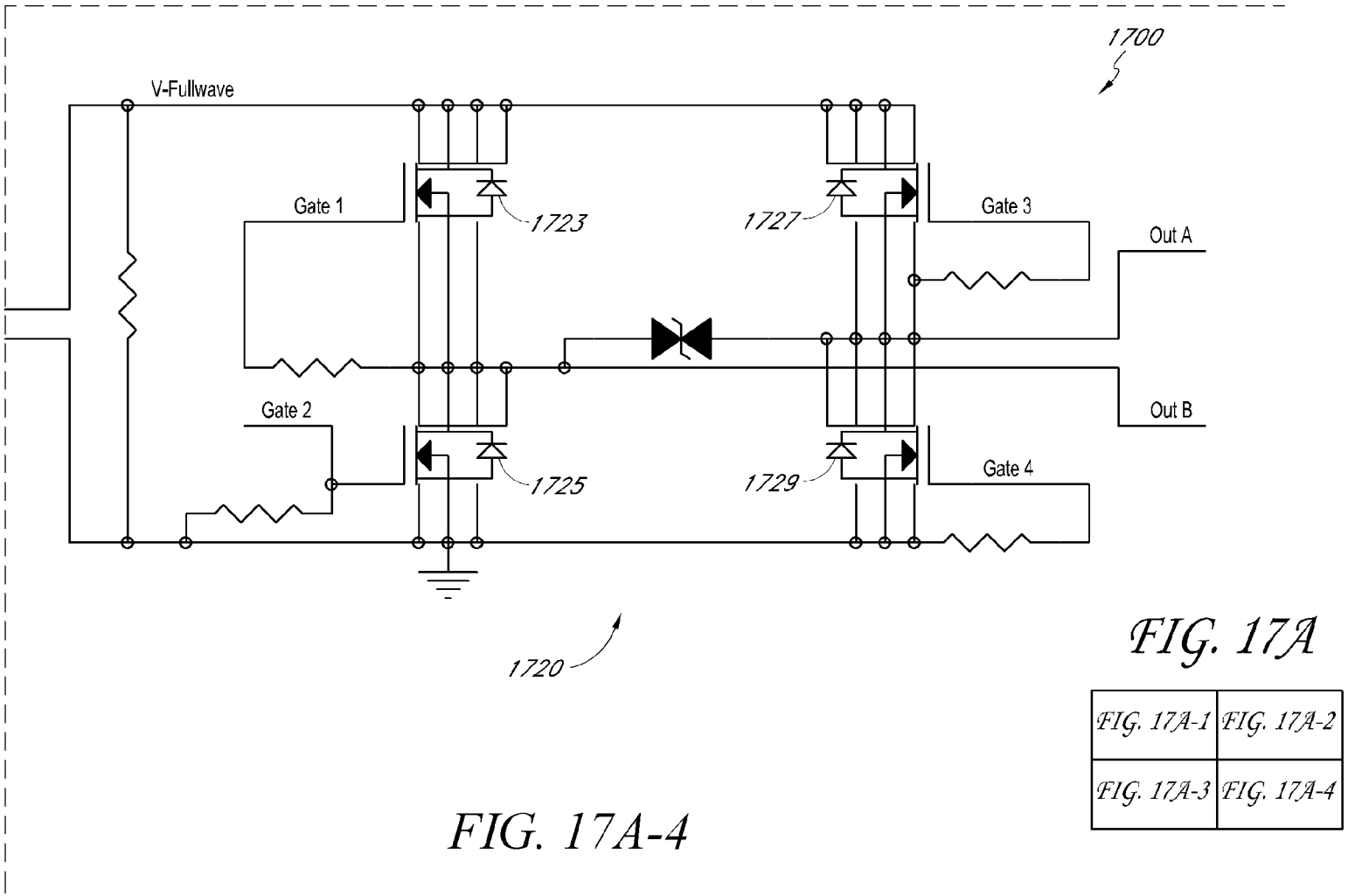
Figures 1, 17B:
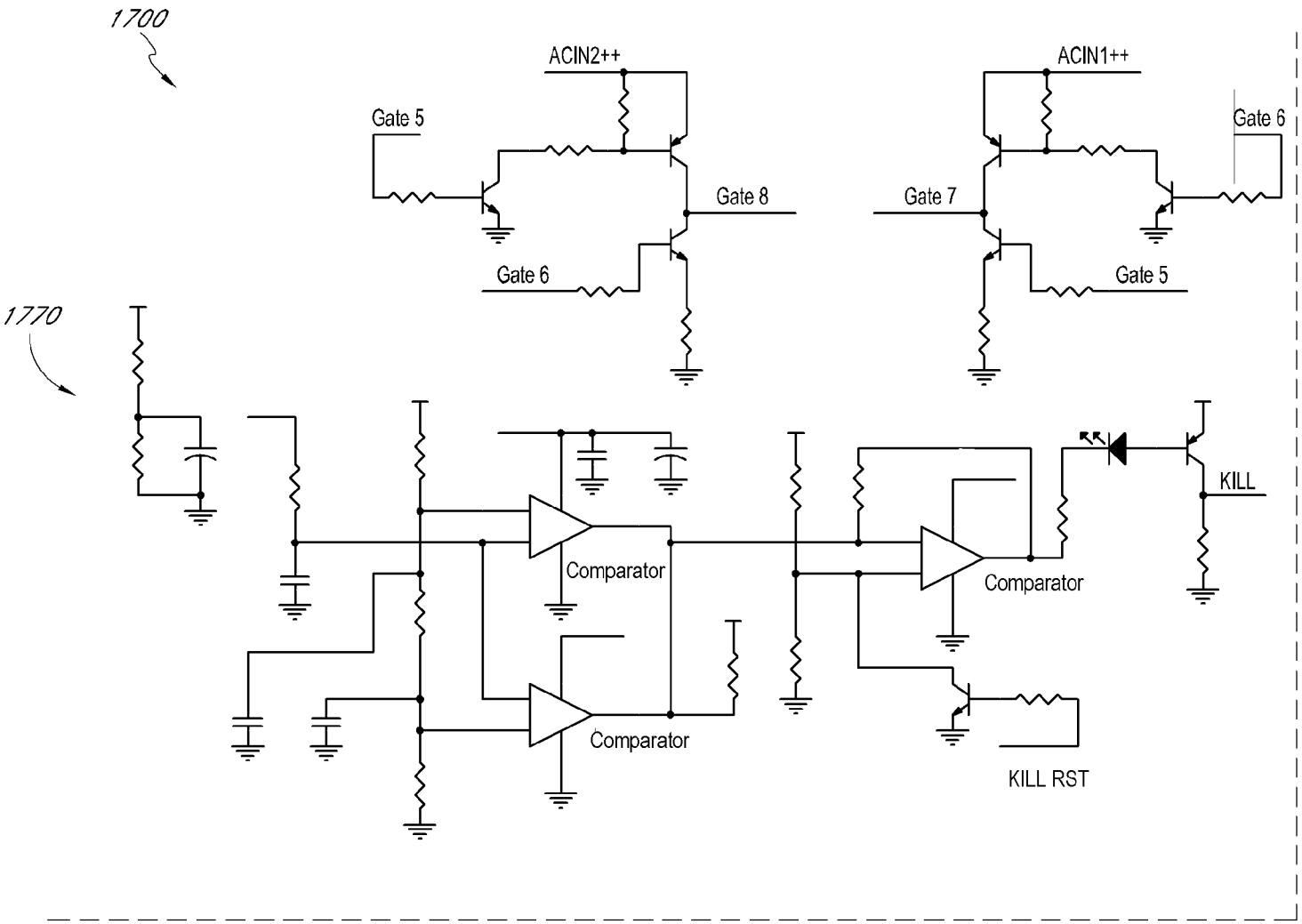
Figures 2, 17B:
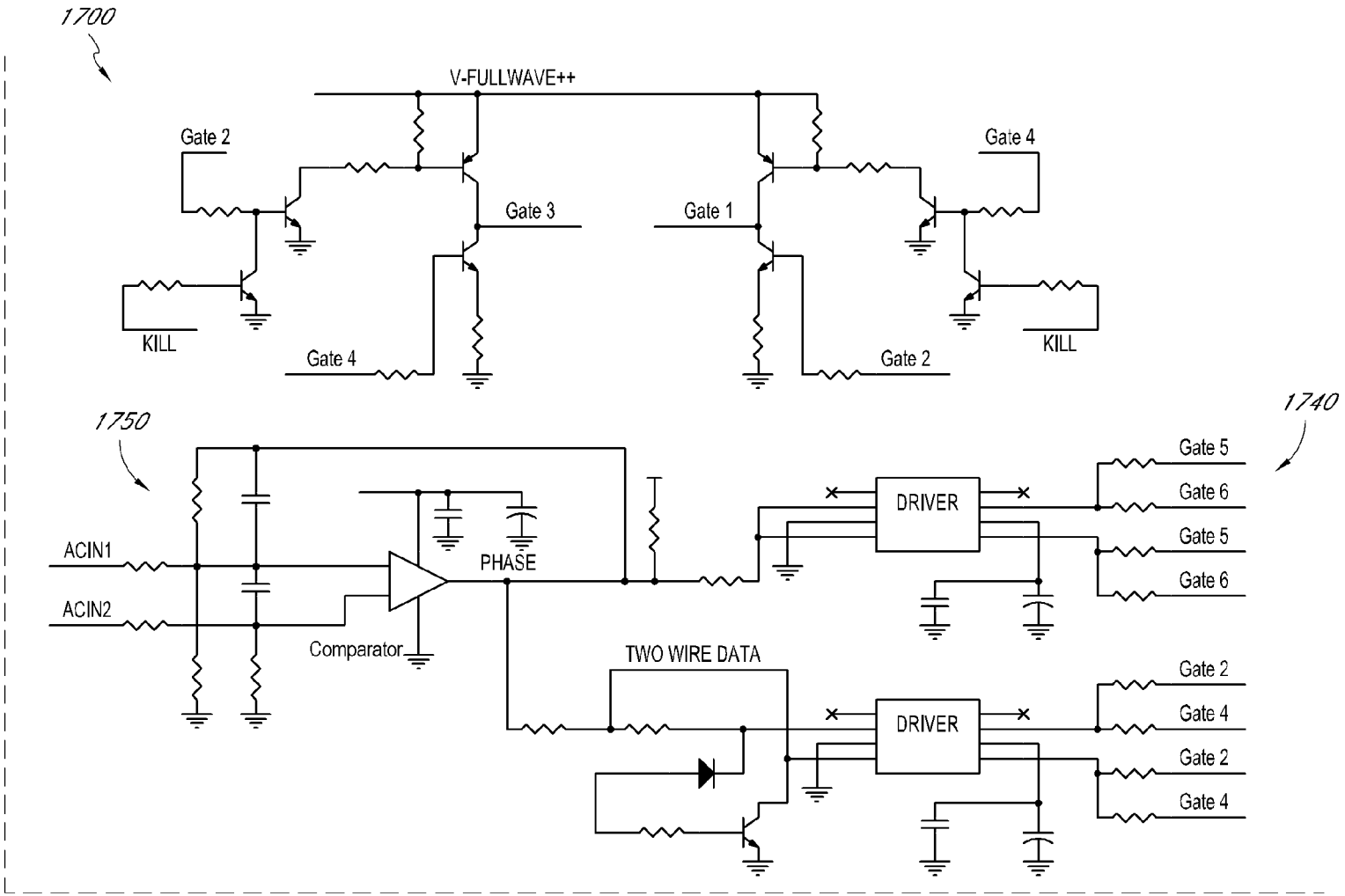
Figures 3, 17B:
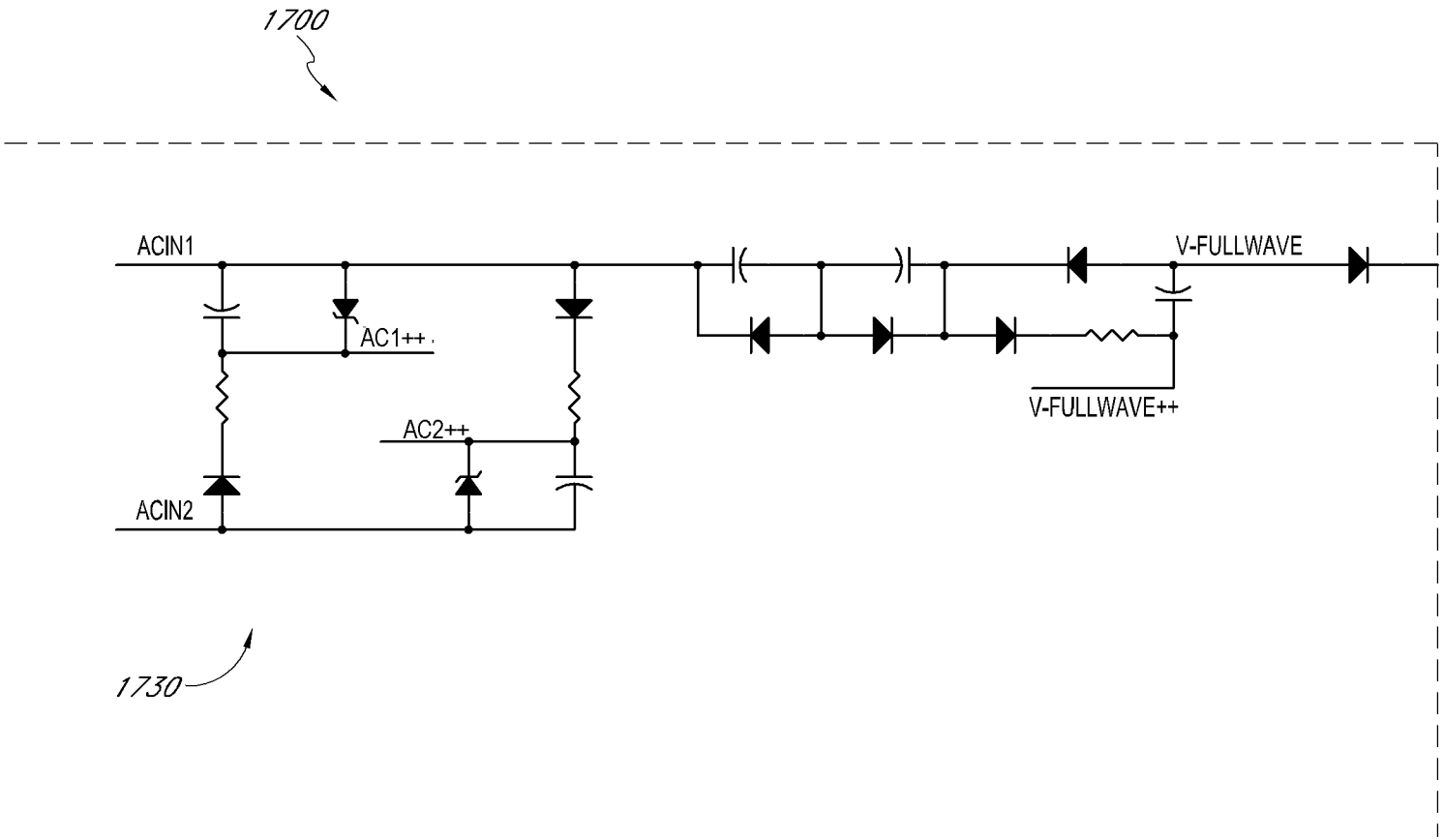
Figures 4, 17B:
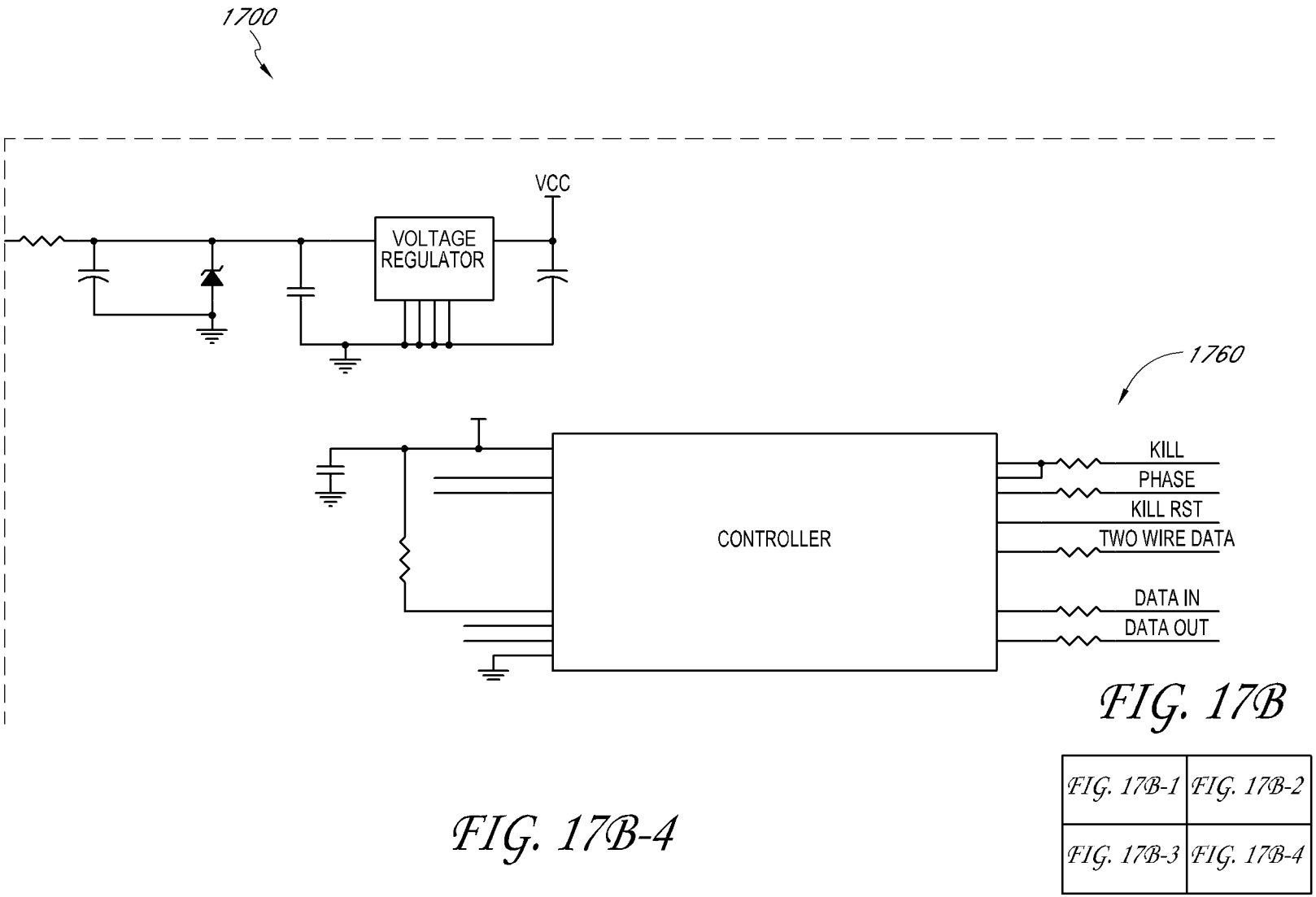

FIGS. 17A1-17A4 and 17B1-17B4 are exemplary circuit diagrams for a lighting controller 1700, according to one embodiment. FIGS. 17A1 and 17A3 are an example of a rectifier circuit 1710 where the MOSFETs 1712, 1714, 1716, 1718 of FIG. 17A1 electrically couple in parallel with the MOSFETs 1713, 1715, 1717, 1719 having the corresponding gate signals Gate5, Gate6, Gate7, Gate8 of FIG. 17A3 for increased current drive. FIGS. 17A2 and 17A4 are an example of a bridge circuit 1720 where the MOSFETs 1722, 1724, 1726, 1728 of FIG. 17A2 electrically couple in parallel with the MOSFETs 1723, 1725, 1727, 1729 having the corresponding gate signals Gate1, Gate2, Gate3, Gate4 of FIG. 17A4 for increased current drive. FIGS. 17B1-17B4 are examples of a bias circuit 1730, driver circuit 1740, phase detection circuit 1750, timing generation circuit 1760, and a current protection circuit 1770.

Figure 18:
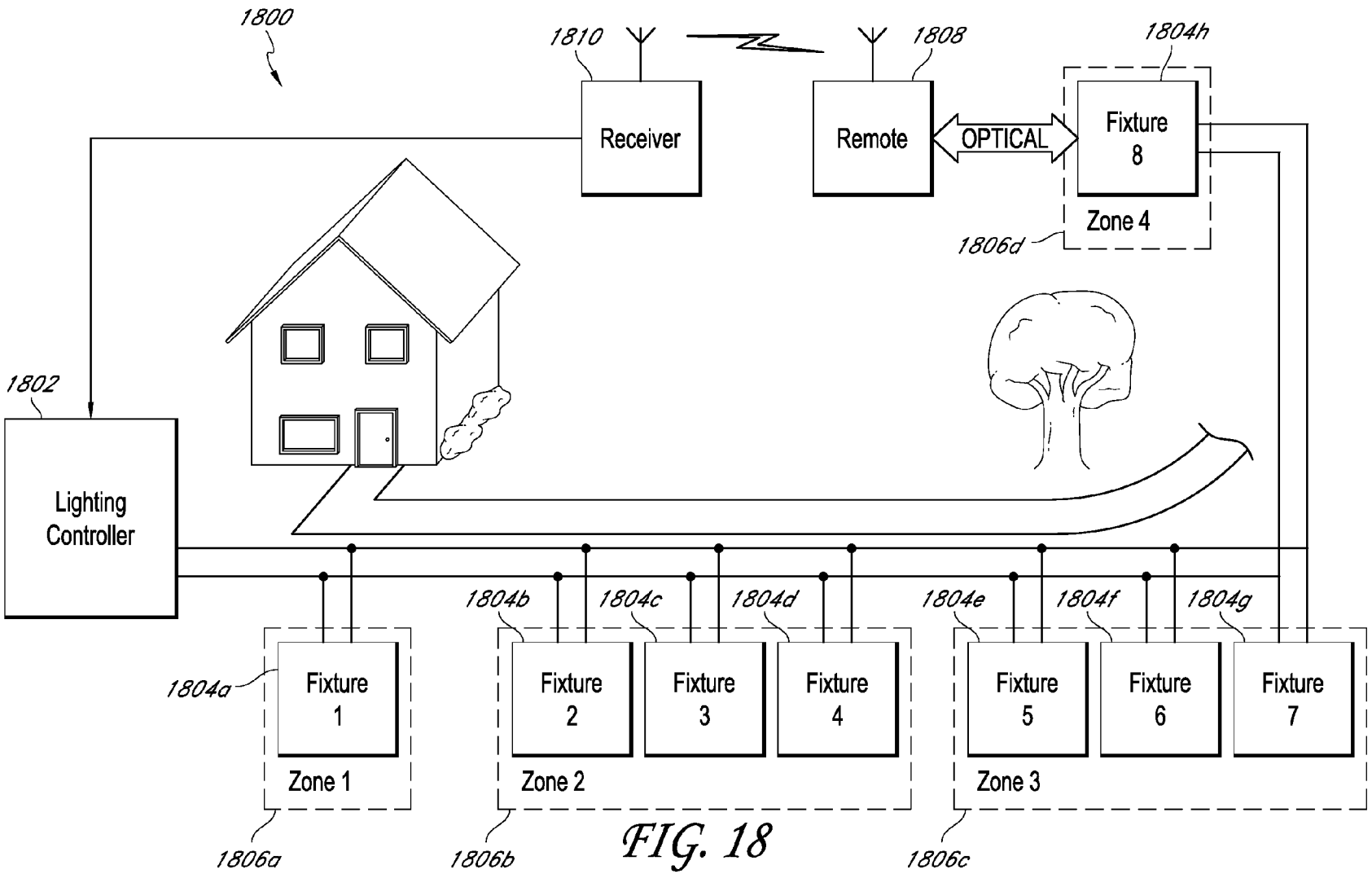
FIG. 18 illustrates an exemplary lighting system for controlling and reassigning lighting zones using a remote device, according to certain embodiments.

FIG. 18 illustrates an exemplary lighting system 1800. The lighting system 1800 comprises a lighting controller 1802 connected to a plurality of lighting modules 1804 through a two-wire interface. The lighting controller 1802 comprises the power supply 302 and the user interface panel 308, the same or similar to that as described above. The lighting fixtures 1804 are grouped into zones 1806.

In the example illustrated in FIG. 18, zone 1 1806*a* comprises lighting fixture 1804*a*, zone 2 1806*b* comprises lighting fixtures 1804*b*, 1804*c*, 1804*d*, zone 3 1806*c* comprises lighting fixtures 1804*e*, 1804*f*, 1804*g*, and zone 4 1806*d* comprises lighting fixture 1804*h*. In other embodiments, the lighting system 1800 can be configured with more or less zones 1806 and/or with more or less lighting fixtures 1804 in each zone 1806. Additional fixtures need not be wired to the end of the line. Instead, the user may elect to "branch" or "T" connect another leg of lights anywhere along the 2-wire path.

The lighting system 1800 further comprises a remote device 1808 and a wireless receiver 1810 to send addresses/ data/commands to the lighting modules 1804. In an embodiment, the remote 1808 can be a digital device, a smart phone, an iPhone, an application for a smartphone, an application for an iPhone, or the like. The wireless receiver 1810 wirelessly connects to the remote 1808 through radio frequency (RF) transmissions and electrically connects through a wire to the lighting controller 1802.

In an embodiment, the remote 1808 sends addresses/data/commands to the receiver 1810 using a standard wireless protocol, such as, for example, Zigbee or Bluetooth. The receiver 1810, in an embodiment, operates in a license or a license-free band of frequencies. Examples of license-free bands in the United States are 270 MHz to 460 MHz; and the Industrial, Scientific, and Medical Band, 902 MHz to 928 MHz, and 2.4 GHz. The receiver 1810 can be a single or a dual-conversion receiver disclosed with reference to wireless technology as is known to one of skill in the art recognized from the disclosure herein. Other communication possibilities, like cell phone, applications for a cell phone or personal digital assistant (PDA) or other personal computing device, optical, wired, satellite or the like, can be used to communicate with the remote 1808.

The receiver 1810 receives the addresses/data/commands from the remote 1808 and transmits them to the lighting controller 300 via wire or other communication medium. The lighting controller 300 receives the addresses/data/commands from the receiver 1810, processes the commands and sends data and commands on the two-wire path to the addressed lighting modules 1804, where the commands are decoded and performed by the addressed lighting modules 1804.

For example, an operator can be standing in front of a lighting module 1804 or a zone 1806 can turn the lighting modules 18040N or OFF, adjust the brightness, determine what hue from the lights looks best, and the like. As the operator enters commands, the commands are translated to allow the program at the lighting controller 1802 to be responsive. The lighting controller 1802 then sends data embedded in the power signal to the fixtures 1804 or the zones 1806. Thus, the remote 1808 works interactively with the power supply 302, for example, via the receiver 1810, to mix the red, green, and blue coefficients of any particular lighting module 1804 or group of lighting modules 1806.

In another embodiment, the homeowner talks on the phone to a remote programmer who enters the information in a computing device, such as a browser or application, which through known Internet or other communication protocols, updates the lighting module behavior. Although disclosed with reference to several embodiments, a skilled artisan would know from the disclosure herein many possible interactive methods of using remote computing devices to program module behavior.

Figure 19:
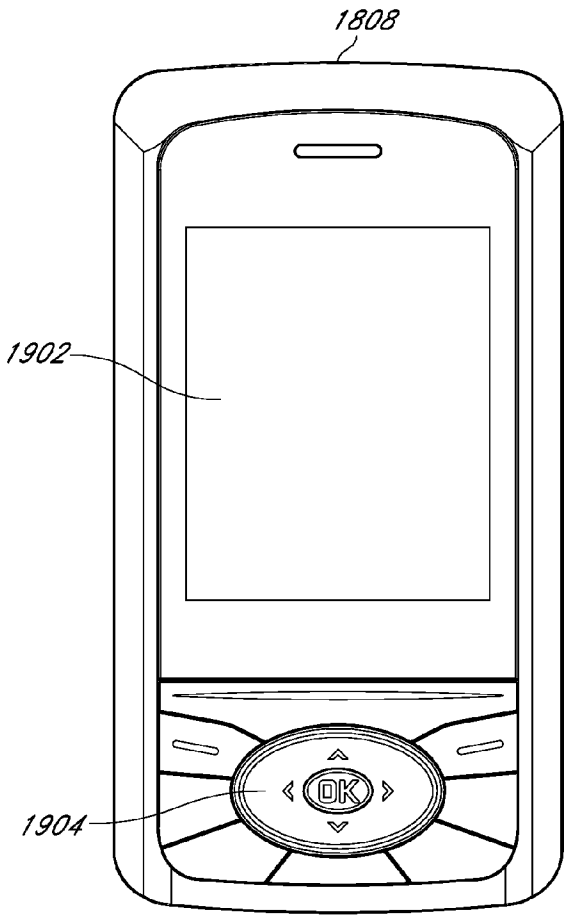
FIG. 19 depicts a remote device, according to certain embodiments.

FIG. 19 depicts an embodiment of the remote device 1808. In one embodiment, the remote 1808 is a key fob type device. In another embodiment, the remote 1808 is a larger hand-held device. The remote 1808 comprises a display 1902 to provide operator feedback and input buttons 1904 to receive operator input.

Figure 20:
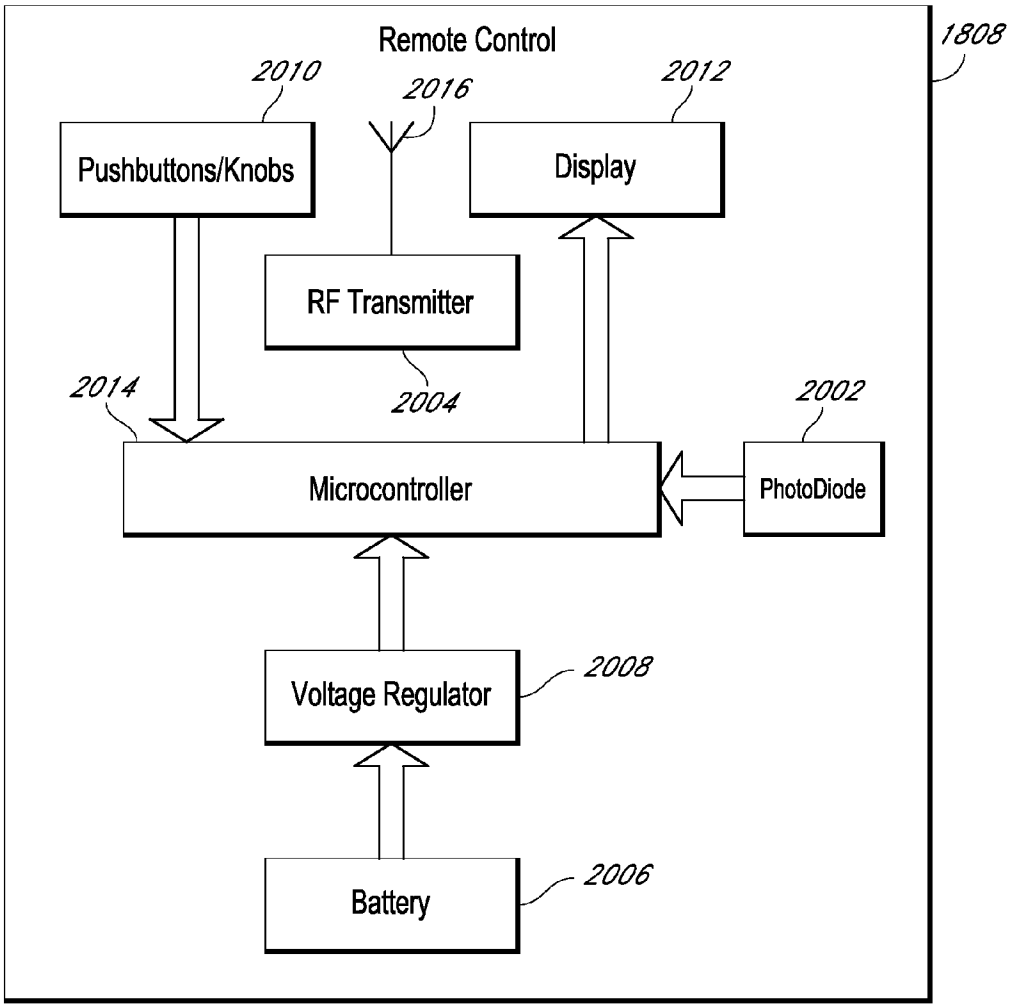
FIG. 20 is a block diagram of an exemplary remote device, according to certain embodiments.

FIG. 20 is a block diagram of an exemplary remote device 1808, according to an embodiment. The remote 1808 comprises a photo diode 2002, an RF transmitter 2004, a battery 2006, a voltage regulator 2008, an operator interface 2010, a display 2012, and a computer 2014 with associated memory (not shown). In an embodiment, the operator interface 2010 comprises button, knobs, and the like, although touch screen, voice or other user interaction could be implemented. The photo diode 2002 optically couples to the lighting module 1802 and electrically communicates to the processor 2014. The processor 2014 also electrically communicates with the operator interface 2010, the display 2012 and the RF transmitter 2004.

In an embodiment, the photo diode is a PDB-C134 available from Advanced Photonix Inc, or the like. A phototransistor could also be used, but would have a slower response time. The RF transmitter 2004 is a CC1050 available from Texas Instruments, or the like.

The computer 2014 comprises devices similar to those disclosed in the foregoing.

The battery 2006 provides a power signal to the voltage regulator 2008, which provides the proper power waveform to power the circuitry within the remote 1808, as is known to one of skill in the art.

Often, the lighting fixtures 1804 are assigned their address or their lighting zone 1806 before they are placed in a location. The fixture programming port 318 on the operator interface panel 308 can be used to program an address and/or zone 1806 into the lighting module 1804. Once the fixtures are located, such as in the ground, mounted to a wall, or the like, it can be cumbersome to disconnect or uninstall the fixture 1804 to bring it proximate to the fixture programming port 318 for zone reallocation. In an embodiment, the optical interface between the lighting modules 1804 and the remote 1808 can advantageously be used to change the lighting group 1806 of the fixtures 1804 with disconnecting or uninstalling it.

In an embodiment, the lighting modules 1804 comprise at least one light emitting diode (LED). The user sends a command to the lighting controller 300 to instruct every lighting module 1804 to flash or strobe its address using its at least one LED by selecting the appropriate button or knob on the remote's operator interface 2010.

Each lighting module 1804 comprises a unique address in addition to a group or zone number. In one embodiment, the lighting module address comprises a 16-bit address, having approximately 65,000 unique values. Other embodiments of the lighting module address can have more or less bits. Commands from the remote 1808 can target a specific lighting module 1804 using the unique address or a group of lighting modules 1804 using a zone address to turn the module 1804 ON/OFF, dim, brighten, adjust the color, adjust the hue, adjust the intensity, or the like.

As described above, the remote 1808 transmits the command to the wireless receiver 1810 using the wireless protocol. The wireless receiver 1810 receives the command and converts the signal which is then electrically sent to the power supply 302. In an embodiment, the receiver 1810 converts the RF signal to a baseband signal. The power supply 302 receives and interprets the command, and electrically sends a command to the lighting modules 1804 over the two-wire path to flash their addresses. For example, the LED could turn ON to represent a 1 address bit and turn OFF to represent a 0 address bit.

The user selects a lighting module 1804 to assign to a different zone 1806 by pointing the remote 1808 at the selected lighting module 1804 such that the photo diode 2002 receives the optical address from the flashing LED. The photo diode converts the optical address into an electrical signal and sends the address to the processor 2014.

In an embodiment where the remote 1808 is a smart phone comprising a camera, an iPhone comprising a camera, an application for a smartphone comprising a camera, an application for an iPhone comprising a camera, or the like, the camera receives the optical address from the flashing LED. The smartphone or iPhone and associated circuitry known to one of skill in the art from the disclosure herein converts the optical address into an electrical signal and sends the address to the processor 2014.

The processor sends the address to the RF transmitter 2004, where it is up converted and transmitted via an antenna 2016 on the remote 1808 to the wireless receiver 1810. The wireless receiver 1808 receives the RF transmission, down converts it and transmits the address to the lighting controller 300. The power supply 302 in the lighting controller 300 receives the address and transmits a command to the selected lighting module 1804 to change its zone 1806. When the selected lighting module 1804 receives and executes the command, the lighting modules 1804 stop flashing their addresses.

Alternatively, in another embodiment, the module 1804 is numbered and the operator manually enters the number into the remote 1808. In yet another embodiment, where the remote 1808 is a smart phone comprising a camera, an iPhone comprising a camera, an application for a smartphone comprising a camera, an application for an iPhone comprising a camera, or the like, the address of the module 1804 is bar coded and the smartphone or iPhone camera reads the bar code from the module 1804.

In another embodiment, the lighting modules 1804 comprise a photo diode and the remote 1808 comprises an LED in addition to the RF transmitter 2004, the operator interface 2010, the display 2012, the processor 2014, the voltage regulator 2008 and the battery 2006. The remote 1808 optically sends commands and data by flashing or strobing its LED, which are received by the photo diode in the lighting module, similar to the way a TV receives a signal from a handheld TV remote. The flashing would typically be so rapid, that it would not be perceived by the human eye. The remote 1808 also transmits data and commands to the RF receiver 1810 using the wireless protocol, which in turn sends the messages via wire to the lighting controller 300, as described above.

Figure 21:
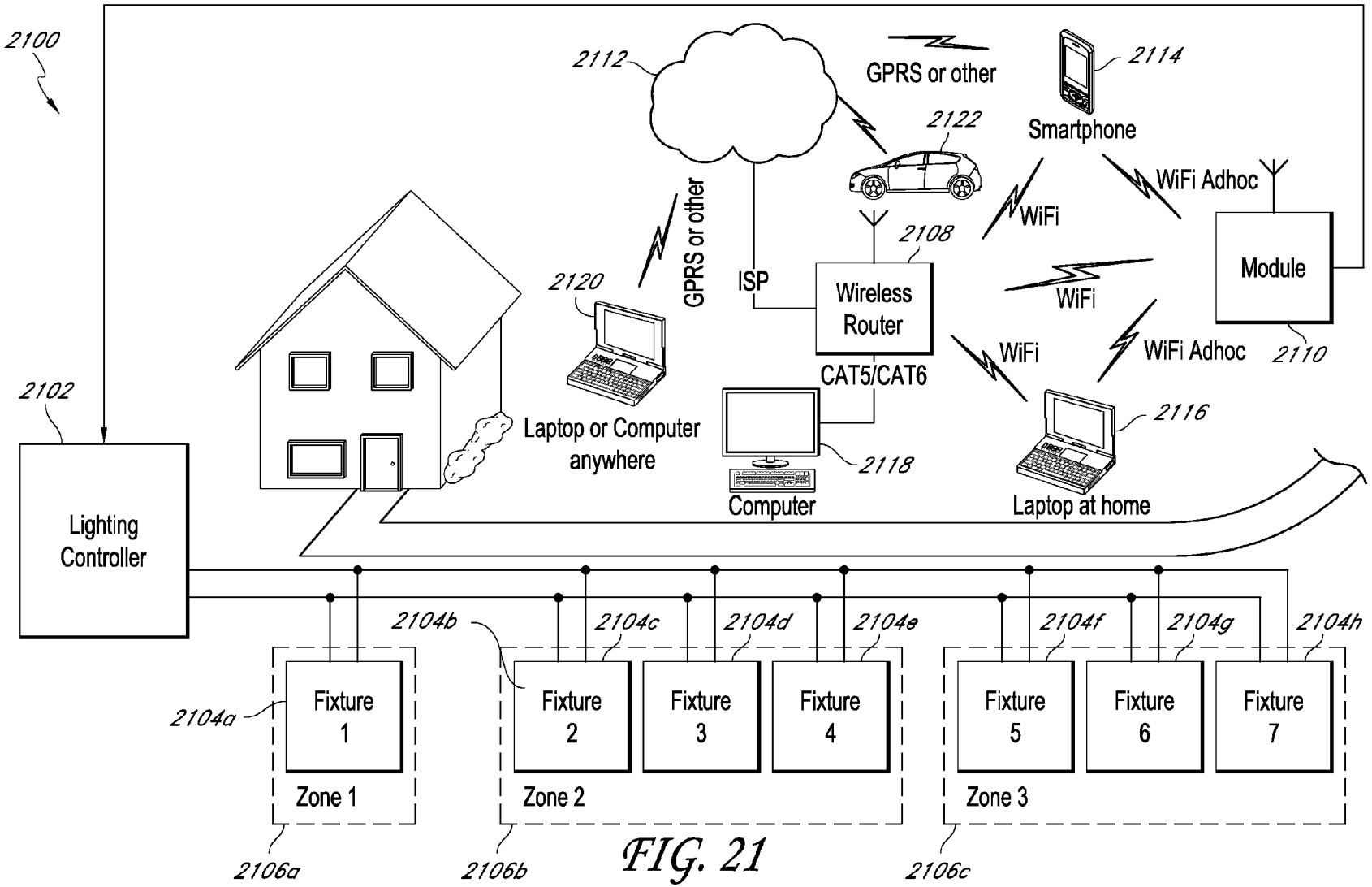
FIG. 21 illustrates an exemplary lighting system controlled remotely, according to certain embodiments.

FIG. 21 illustrates an exemplary lighting system 2100 controlled remotely, according to an embodiment. The lighting system 2100 comprises a lighting controller 2102, and a plurality of lighting modules 2104 configured into a plurality of zones 2106. In the illustrated embodiment, zone 1 2106*a* comprises one lighting fixture 2104*a*; zone 2 2106*b* comprises three lighting fixtures 2104*b*, 2104*c*, 2104*d*, and zone 3 2106*c* comprises three lighting fixtures 2104*f*, 2104*g*, 2104*h*. The lighting controller 2102 comprises the power supply 302 and the operator interface 308. The lighting controller 2102 sends the data encoded power waveform to the plurality of lighting modules 2104 on the two-wire path, as described above.

The lighting system 2100 further comprises a wireless module 2110, which electrically couples, via wire or other mediums, to the lighting controller 2102. The wireless module 2110 communicates wirelessly to devices, such as a smartphone 2114, a laptop computer 2116, and other devices that have WiFi™ connection capability using an ad hoc communication mode. In the ad hoc communication mode, custom software, firmware, applications, programs, or the like, are written for both the wireless module 2010 and the communicating device 2114, 2116. In an embodiment, this proprietary communication approach is not constrained by conventional standards, such as the 802.11 standard and its versions, for example.

The user can send commands from the smart phone 2114, the laptop computer 2116, or other communicating devices within the range of the wireless module 2110 to control the remote lighting system 2100. For example, the user can send commands to turn ON/OFF, adjust the brightness, adjust the color, adjust the hue, and the like for the lighting system 2100, a zone 2106, or a specific lighting module 2104 from the remote device 2114, 2116. In an embodiment, the user views the web page being served by the wireless module 2110 by, for example, opening up the Internet Explorer® on the smartphone 2114 or the laptop 2116. The user then interacts with the web page to control the lighting system 2100. In another embodiment, the web page is served from the computer in the lighting controller, and the wireless module 2110 provides the RF connectivity.

The wireless module 2110 wirelessly receives the commands using the ad hoc protocol, electrically converts the signal and sends the lighting commands, via wire, to the lighting controller 2102. In an embodiment, the module 2110 converts the signal to base band. The lighting controller 2102 receives the commands and send the message to the addressed lighting modules 2104 or the lighting modules 2104 in the specified zones 2106 via the two-wire path.

In another embodiment, the lighting system further comprises a wireless router 2108 and the wireless module 2110 is a WiFi™ enabled device. WiFi™ enabled wireless devices, such as laptops or computers 2116, 2120, smartphones 2114, WiFi™ enabled automobiles 2122, or the like, communicate with the router 2108 using a standard communication protocol, such as 802.11. In other embodiments, a device, such as a computer 2118 is electrically connected, via wire or a cable, to the router 2108. The user uses the devices 2114, 2116, 2118, 2120, 2122 to send commands to the lighting system 2100. The devices 2114, 2116, 2118, 2120, 2122 send the commands through the router 2108 using a standard router protocol. The router 2108 connects to the World Wide Web 2112 using an Internet Service Provider (ISP) and an Internet connection. In another embodiment, the smartphone 2114 communicates through the Internet using a general packet radio service (GPRS) protocol.

In one embodiment, the wireless module 2110 comprises the router 2108. In another embodiment, the lighting controller 2102 comprises the router 2108.

The devices 2114, 2116, 2118, 2120, 2122 access the WiFi™ enabled wireless module 2110 through its Internet Protocol (IP) address. The module 2110 sends the commands to the lighting controller 2102, where the lighting controller sends the command to the lighting modules 2104 through the two-wire path. In this manner, a user can access the lighting system 2100 from anywhere there is an Internet connection.

Figure 22:
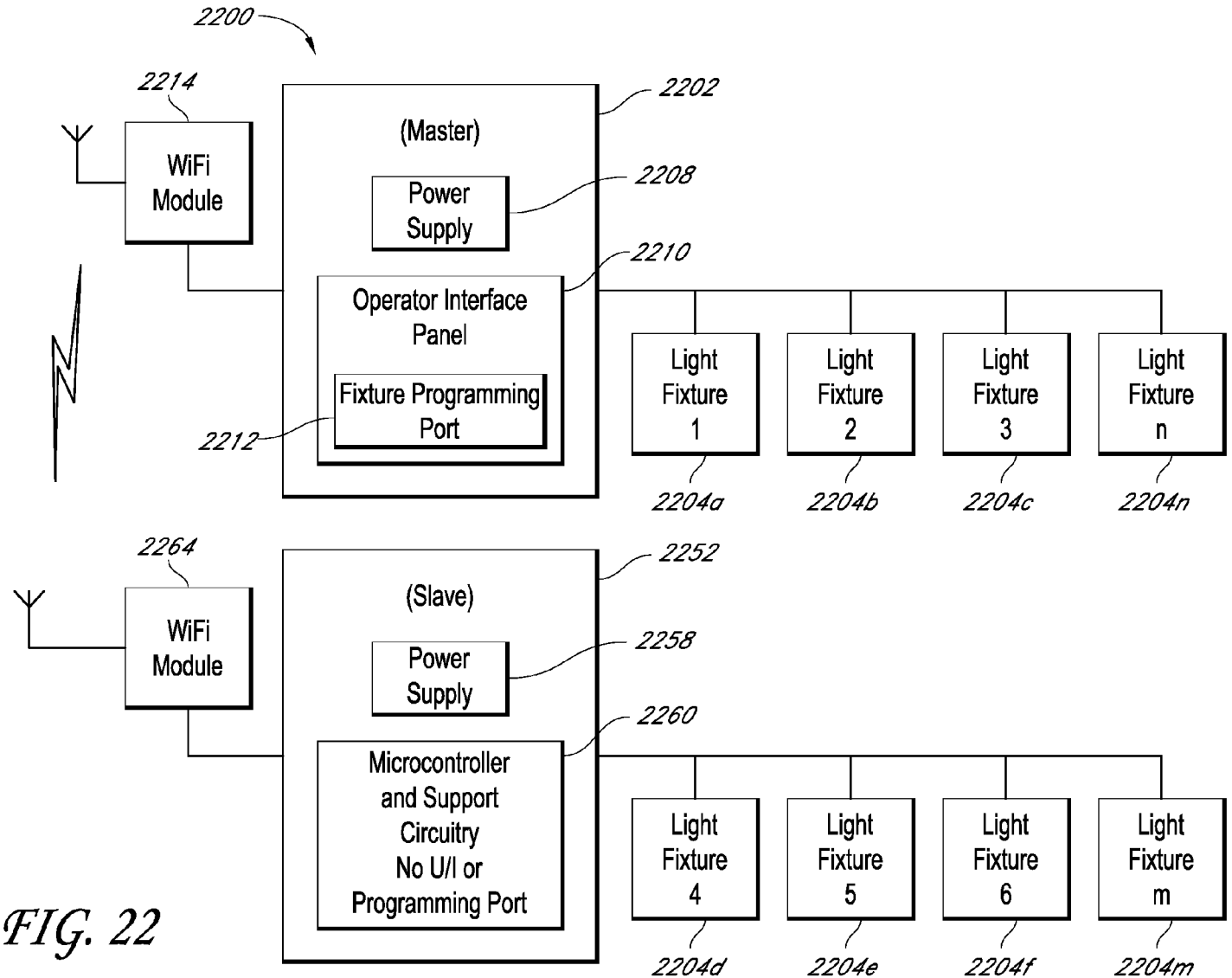
FIG. 22 is a block diagram of an exemplary lighting system with a master/slave configuration, according to certain embodiments.

FIG. 22 is a block diagram of an exemplary lighting system 2200 with a master/slave configuration, according to an embodiment. The lighting system 2200 comprises a first lighting controller 2202 and at least a second lighting controller 2252. Lighting Controller 2202 operates as a master controller and comprises a power supply 2208, an operator interface 2210, and a fixture programming port 2212. Lighting Controller 2252 operates as a slave to the master controller 2202 and comprises a power supply 2258 and a slave control panel 2260. The slave control panel 2260 comprises the processor 314 and support circuitry, such as the memory 316, the logic power supply 320, and the display and indicators 312. In an embodiment, the slave control panel 2260 may not have the fixture programming port 2212 and the operator interface devices, such as the buttons and knobs 310. In other embodiments, the slave controller 2252 is electrically the same or similar to the master controller 2202.

Each lighting controller 2202. 2252 electrically connects to a plurality of lighting modules 2204 and to a WiFi™ enabled module 2214, 2264, respectively. In the illustrated embodiment, master controller 2202 electrically connects to lighting modules 2204*a*, 2204*b*, 2204*c*, and up to 2204*n*, and electrically connects to module 2214. Slave controller 2252 electrically connects to lighting modules 2204*d*, 2204*e*, 2204*f*, and up to 2204*m*, and electrically connects to module 2264.

In one embodiment, the WiFi™ enabled modules 2214, 2264 communicate with each other through an ad hoc protocol, as described above with respect to FIG. 21. In another embodiment, the WiFi™ enabled modules 2214, 2264 can communicate with each other through a router 2108, also as described above with respect to FIG. 21.

For example, a user may have a lighting system 2200 that uses more than one lighting controller 2202 to control the lighting modules 2204. This may be caused by the transformer 322, 402 not being able to supply enough power to illuminate the plurality of lighting modules 2204. In this case, the user would connect some of the lighting modules to a first controller 2202 and others to a second controller 2252. In one embodiment, the first and second controllers 2202, 2252 each control the lighting modules 2204 associated with it, independent of the other controller 2202, 2252.

However, in another embodiment, the program to control all of the lighting modules 2204 executes in one lighting controller 2202, which acts as the master controller and communicates with the slave controller 2252. The master controller 2202 sends commands for the slave controller 2252 to the module 2214. Module 2214 communicates wirelessly with the module 2264 and module 2264 receives the commands from the module 2214 and sends the commands to the slave controller 2252. The slave controller 2252 receives the commands and sends the commands to the addressed lighting modules 2204 associated with it. Advantageously, the user can access all of the lighting modules 2204 by entering commands from the operator interface 2210 on the master controller 2202 or by communicating to the IP address of only the master controller 2202 instead of having to access two lighting controllers 2202, 2252. Another advantage is the reduced cost of the slave controller 2252, which does not include the button and knobs 310, the fixture programming port 2212, and other features not being used in the slave controller 2252.

In another embodiment, the lighting system 1800, 2100, 2200 further comprises a motion detector. The motion detector may be battery powered and communicate with the receiver/modules 1810, 2110, 2214. When the motion detector senses motion, it could send a message to the lighting controller 1802, 2102, 2202, which then turns ON the appropriate lighting modules 1804, 2104, 2204, as programmed by the user. In one embodiment, the motion detector receives power over the two-wire path connecting the plurality of lighting modules 1804, 2104, 2204.

In another embodiment, the data sent to the lighting controllers 300, 1802, 2102, 2202 is encrypted. In one embodiment, a proprietary encryption scheme is used. In another embodiment, a standard encryption protocol, such as TCP/IP, IPX/SPX, OSI, DLC, SNAP, exclusive or, and the like, is used to encode the data and commands.

Figure 23:
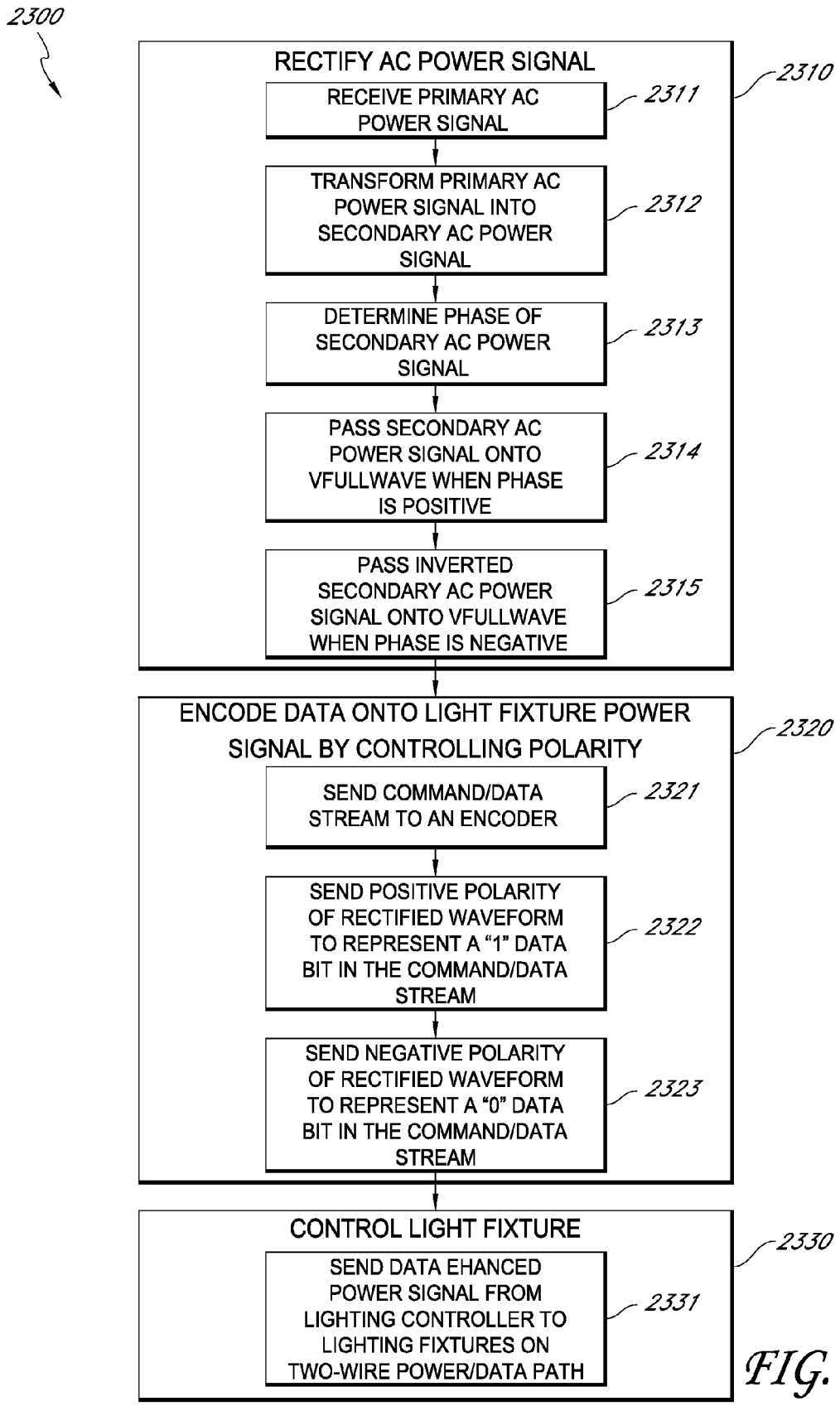
FIG. 23 is a flowchart of an exemplary process for encoding data bits onto a power signal for lighting modules.

FIG. 23 is a flowchart of an exemplary process 2300 for encoding data onto a power signal for lighting modules 304, 1804, 2104, 2204. Beginning at block 2310, the process 2300 rectifies an AC power signal to form a secondary VAC power waveform.

At block 2320, the process 2300 encodes the data onto the rectified power signal by controlling the polarity of the rectified power signal, such that at least a portion of the rectified power waveform with a first polarity represents a 1-data bit and at least portion of the rectified power waveform with a second polarity represents a 0-data bit.

At block 2330, the process 2300 sends the data encoded power waveform through the two-wire path to the lighting modules 304, 1804, 2104, 2204. The addressed lighting modules 304, 1804, 2104, 2204 decode the commands and perform the lighting functions, such as turn ON/OFF, dim/brighten, change color/hue, and the like.

Looking at the process 2300 in more detail, at block 2311 the lighting controller 300, 1802, 2102, 2202 receives the primary AC power signal. At block 2312, the process 2300 transforms the primary AC power signal into a secondary VAC power signal. In an embodiment, the secondary VAC power signal is between approximately 11 VAC and 14 VAC. The process 2300 determines the phase of the secondary AC power signal at block 2313. At blocks 2314 and 2415, the process 2300 sends the secondary AC power waveform onto V-FULLWAVE when the phase is positive and sends the inverted secondary AC power waveform onto V-FULLWAVE when the phase is negative to generate the rectified secondary VAC power waveform.

At block 2321, the process transmits the data stream as well as the phase information, to an encoder/modulator. The data stream comprises addresses, data, and commands. The bridge circuit 900 passes the rectified secondary power waveform onto the two-wire path to the lighting modules 304, 1804, 2104, 2204 when the data bit from the data stream has a first state. Further, the bridge circuit inverts the rectified secondary waveform when the data bit has a second state. When no data is present, the bridge circuit reconstructs the sine wave of the secondary VAC power waveform from the rectified secondary waveform and sends the reconstructed secondary VAC power waveform.

At block 2331, the process 2300 transmits the data enhanced power signal from the lighting controller 300, 1802, 2102, 2202 to the plurality of lighting fixtures 304, 1804, 2104, 2204 on the two-wire path. The addressed lighting modules 304, 1804, 2104, 2204 receive the data encoded power waveform. An embodiment of a lighting module 304, 1804, 2104, 2204, its functionality, and its operation, is disclosed in FIGS. 13-22 and accompanying disclosure of U.S. application Ser. No. 12/564,840, filed Sep. 22, 2009, entitled "Low Voltage Outdoor Lighting Power Source and Control System", and are incorporated herein by reference. Other embodiments are described below in FIGS. 26-29.

This waveform is first scaled and filtered, and is then passed through a comparator to determine the phase of the incoming signal which is used to decode the data bits and perform the requested command. The data encoded power waveform is also rectified and used to power the lighting module. It should be noted that it is possible to store energy in the lighting module such that no power is being supplied at those instances in time when the actual bits of data are received.

Figure 24:
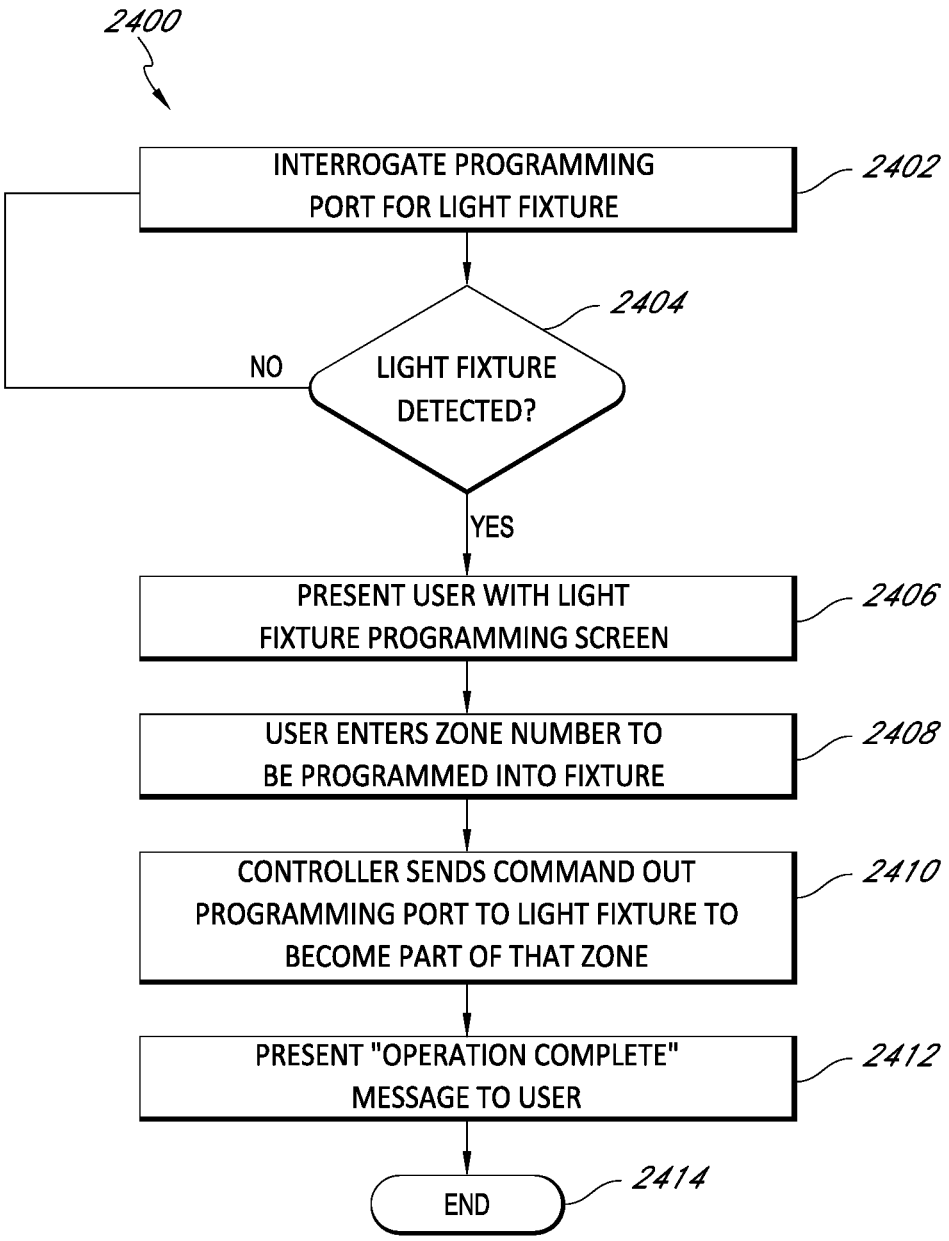
FIG. 24 is a flowchart of an exemplary process for assigning zones to addressable lighting modules in a networked lighting system, according to certain embodiments.

FIG. 24 is a flowchart of an exemplary process 2400 for assigning zones 106, 206, 1806, 2106, 2206 to addressable lighting modules 104, 204, 1804, 2104, 2204 in the networked lighting system 100, 200, 1800, 2100, 2200, according to an embodiment. In one embodiment, the user assigns the zone numbers into each lighting fixture 300, 1802, 2102, 2202 through the fixture programming port 212, 318, 2212. In one embodiment, the zone numbers comprises 8 bits and there can be up to 256 zones 106, 206, 1806, 2106, 2206. In other embodiments, the zone numbers comprises more or less than 8 bits and there can be more or less than 256 zones 106, 206, 1806, 2106, 2206.

At block 2402 and 2404, the lighting controller periodically queries the programming port attempting to detect a lighting fixture that has been connected. At block 2406, the lighting controller has detected a light fixture on the programming port and has presented the Lighting Fixture Programming screen to the user via the operator interface panel 210, 308, 2210 on the lighting controller 300, 1802, 2102, 2202. Next, at block 2408, the user enters the zone number of the lighting fixture 104, 204, 1804, 2104, 2204 to be added to the entered zone 106, 206, 1806, 2106.

At block 2410, the process 2400 sends a command to assign the lighting fixture 104, 204, 1804, 2104, 2204 to the entered zone 106, 206, 1806, 2106, 2206.

At block 2412, the user is notified that the programming has completed and he removes the fixture from the programming port.

Figure 25:
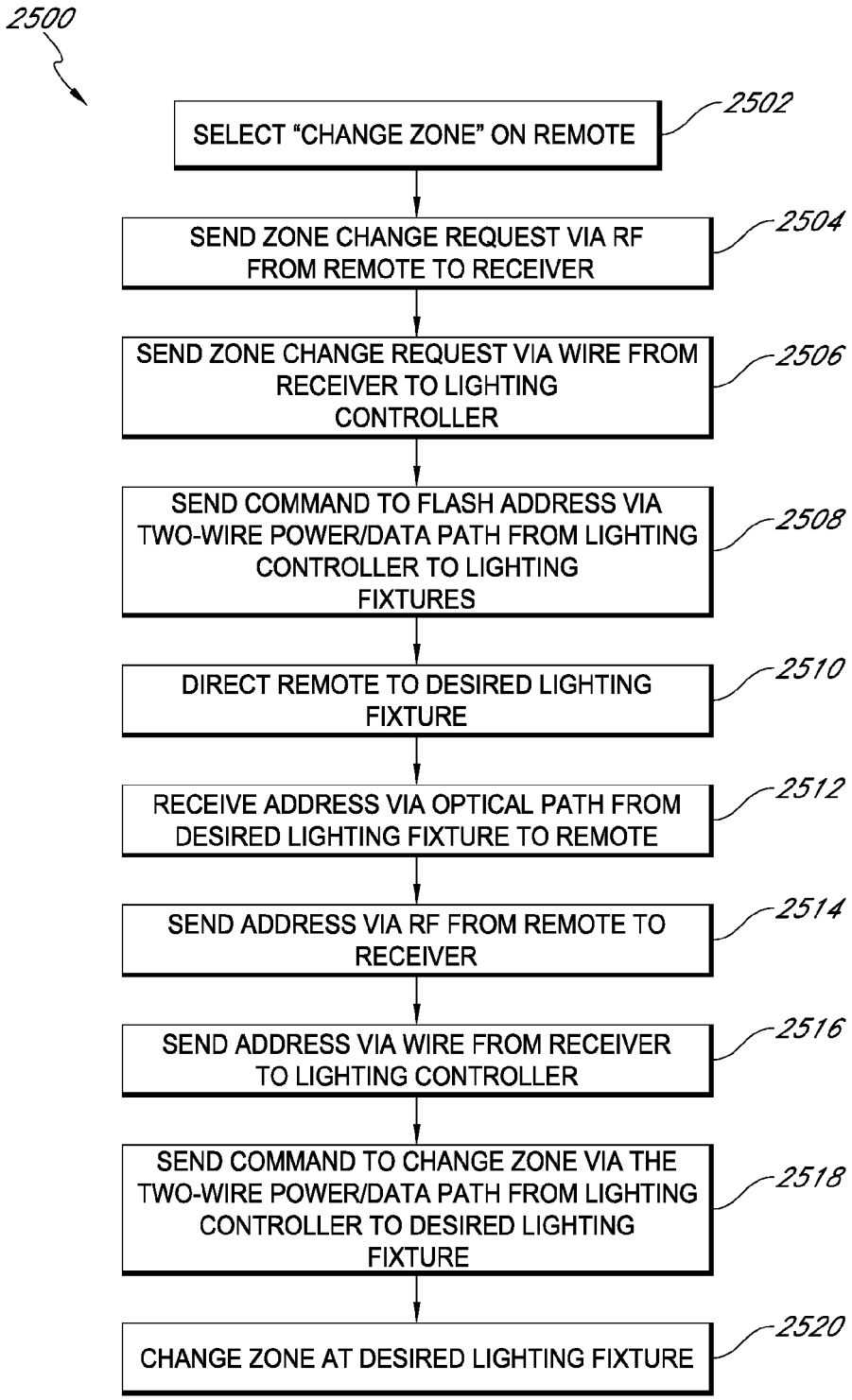
FIG. 25 is a flowchart of an exemplary process for modifying assigned zones in a lighting system using a remote controller, according to certain embodiments.

FIG. 25 is a flowchart of an exemplary process 2500 for modifying assigned zones 1806 in the lighting system 1800 using the remote controller 1808, according to an embodiment. At block 2502 and referring to FIG. 18, the user selects the change zone selection on the remote 1808, and enters the new zone number.

At block 2504, the remote 1808 transmits the zone change request to the receiver 1810 via RF. The receiver 1810 sends the zone change request, via wire or other medium, to the lighting controller 1802 at block 2506. At block 2508, the lighting controller 1802 sends a command to the lighting modules 1804 via the two-wire path to begin flashing their addresses. The command is encoded onto the power waveform supplying power to the lighting modules 1804. After receiving the command, each lighting module 1804 flashes its address using an LED on the lighting fixture 1804.

At block 2510, the user directs the remote 1808 to the selected lighting fixture 1804. The selected lighting fixture 1804 is the lighting fixture that the user wants to rezone. At block 2512, the remote 1808 receives the address of the selected lighting fixture, via the optical path. The remote 1808 sends the address of the selected lighting module 1804 to the receiver 1810 via RF at block 2514.

At block 2516, the receiver 1810 sends the selected address to the lighting controller 1802 via a wired path. The lighting controller 1802 receives the selected address and sends a command to the selected lighting fixture 1804 via the two-wire path. The command is encoded onto the power waveform sent via the two-wire path.

At block 2520, the lighting fixture 1804 decodes the command and changes it zone 1806 to the new zone address.

In an embodiment, the lighting fixtures 104, 204, 1804, 2104, 2204 are advantageously constructed with a drive circuit, supervising functions, communication reception, and the like, within the fixture 104, 204, 1804, 2104, 2204 on a single printed circuit board to lessen the need for water tight splices, sealing, and other reliability concerns.

In another embodiment, the command protocol supports queued commands as well as immediate commands. The queued commands allow synchronized changes across multiple lighting groups or zones 106, 206, 1806, 2106, 2206. Several different queued commands could be sent to different lighting zones 106, 206, 1806, 2106, 2206. The lighting module 104, 204, 1804, 2104, 2204 remember the command but do not act on it until an "apply queued" command is received.

In a further embodiment, an accessory device having an optical sensor monitors the lighting fixtures when the fixtures are flashing or strobing their addresses. The accessory device reads the address and displays the address to the user. This is useful because while the fixtures would be marked with their address, the marking could be worn off or not visible after installation.

In a yet further embodiment, the lighting controller takes inventory of the lighting modules attached by sending, either one by one for each of the possible 65,000 unique addresses, or for a particular range of addresses, a command to turn ON lighting modules. Then the lighting controller monitors the current after the command is sent to determine whether a fixture responded to the command. Finally, the controller compiles a list of the fixture addresses detected to be presented to the user.

In another embodiment, the power supply has a detachable front panel with a slot designed to accept the accessory device. When the accessory device is installed, the user detaches the front panel, now powered and in communication with the accessory device, and walks around the yard. The user can perform more complex remote operations using the larger display and operator interface of the front panel. These operations relay back to the power supply via the RF transmitter of the accessory device. In this embodiment, the power supply comprises a second microcontroller to receive the RF commands and act on them.

In another embodiment, the lighting controller comprises two microcontrollers, where a first microcontroller is located in the power supply chassis and a second microcontroller is located in the operator panel. The two microcontrollers communicate via a wired link while the operator panel is installed in the power supply. When the operator panel is removed from the power supply chassis, the two microcontrollers communicate via a wireless link. In one embodiment, the operator panel is battery powered and portable. In another embodiment, a small plug-in power supply powers the operator panel. In this case, the panel could be mounted in a location that is more convenient for the user to access, such as a house's interior wall, for example, rather than the typical and less convenient exterior wall.

For years, landscape lighting systems have consisted of large, bulky and heavy transformers wired to 12 VAC incandescent bulbs. Typically the transformer also has a timer either built into its enclosure, or next to it. The timer is used to switch power to the transformer ON and OFF to control all of the lights simultaneously. Recently, LEDs have begun to be used in landscape lights, but simply as long-life replacements for the incandescent bulbs that have historically been used.

In contrast, in an embodiment of the present disclosure, a lighting fixture receives the polarity controlled, sinusoidal power signal from the lighting controller 202, 300, 1802, 2102, 2202, 2252, decodes and performs the encoded commands, and uses the signal for power. In another embodiment, historical landscape lights could be fitted with special circuitry to receive this communications signal and use the information to control some aspect of the light.

In a further embodiment, the light fixture comprises and controls LEDs of white, red, green, and blue color, or any subset. To control individual LED brightness levels, the controller receives a target brightness level. The brightness level is applied to the particular LED after several correction factors. First, the lighting controller applies the temperature correction factor. As the temperature of the printed wiring board of the lighting module increases, the light output of the LED changes. The relative color change depends on the color of the LED. If color mixing is done, an individual temperature correction factor is applied to each color LED or the overall hue will change as temperature changes. Second, the lighting controller applies an aging correction factor. The lighting module determines how many total hours of use of each LED and under the type of driving conditions. As LEDs age, their light output decreases. If color mixing is done, an individual age correction factor is applied to each LED or the overall hue will change as the LEDs age. The third correction factor is a temperature throttling factor that cuts back power to all LEDs when the printed circuit board temperature exceeds a predetermined threshold.

In yet a further embodiment, the lighting fixture uses a pulse width modulation (PWM) signal to dim the LEDs, where the PWM signal is synchronized to the incoming AC power signal. The synchronization is important to prevent the detrimental effect high PWM frequencies have on dimming linearity while maintaining a frequency high enough to avoid the visible flickering of the LEDs due to the PWM.

Figure 26:
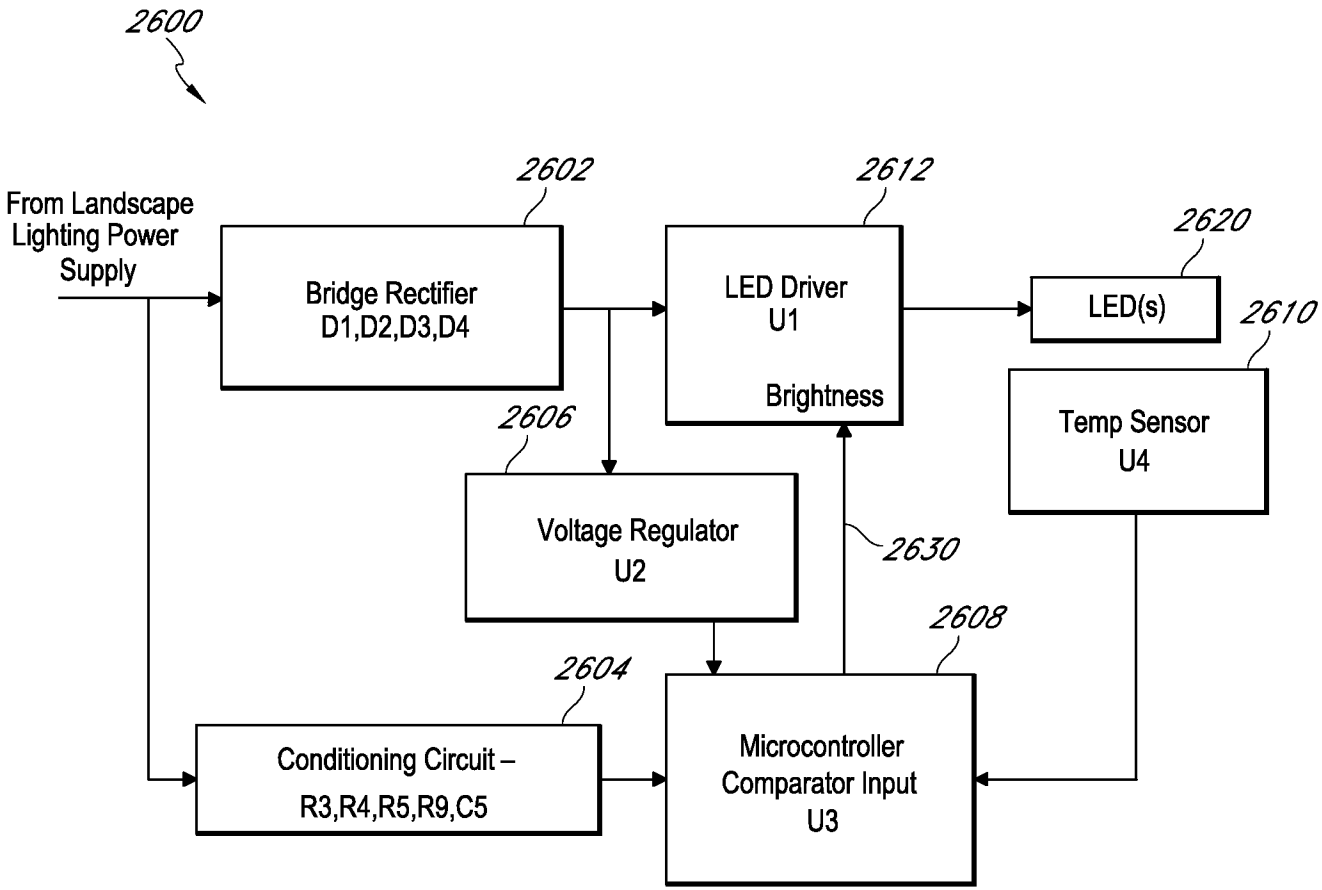
FIG. 26 is a block diagram of an exemplary single channel lighting module, according to certain embodiments.

FIG. 26 is a block diagram of an exemplary single channel lighting module 2600 that can be used with the lighting controller 202, 300, 1802, 2102, 2202, 2252 capable of encoding data on the power line. The lighting module 2600 comprises a bridge rectifier 2602, a conditioning circuit 2604, a voltage regulator 2606, a microcontroller 2608, a temperature sensor 2610, an LED driver 2612, and one or more lamps 2620. In the illustrated embodiment, the lamps 2620 comprise LEDs 2620. In other embodiments, the lamps 2620 can be other light emitting devices, such as, for example, incandescent bulbs, florescent bulbs, or the like.

The bridge rectifier 2602 receives the encoded power wave forms, LIGHTING CONTROL1 and LIGHTING CONTROL2 from the bridge 900 or the bridge/rectifier 1400. The bridge rectifier 2602 comprises a plurality of diodes, such as, for example. Schottky Rectifiers, part number SBR2A40P1 available from Diodes Inc., or the like. The bridge rectifier 2602 converts an input signal of any polarity into a DC signal to power the other circuits on the lighting board. This DC signal is fed into the LED Driver 2612, which can be a driver integrated circuit, part number AL8805 available from Diodes Inc., or an equivalent. The driver integrated circuit uses an efficient Buck Switching topology to generate a regulated output current which is used to power the LED(s) 2620. In an embodiment, the LED 2620 can be a high-power LED, such as, for example, a CREE XP-E or an equivalent.

The DC voltage output from the bridge rectifier 2602 is also used to create a regulated logic supply voltage from the voltage regulator 2606. In an embodiment, the voltage regulator 2606 can be a 3-Volt regulator, such as, for example, part number TPS71530 available from Texas Instruments, or the like. The voltage regulator 2606 supplies power to the microcontroller 2608, such as, for example, part number PIC16F1824 available from Microchip Technology, or the like. The microcontroller 2608, and firmware that resides inside it, comprise a receiver for the data being sent from the lighting controller 202, 300, 1802, 2102, 2202, 2252. A conditioning network comprising a plurality of resistor and capacitors couples data from the power supply 302 to the microcontroller's comparator input while simultaneously limiting current into the microcontroller 2608. The output of the comparator (within the microcontroller 2608) is used to determine the nature of the data. The microcontroller 2608 then generates a signal 2630 which is coupled to the LED Driver 2612. This signal 2630 is used to vary the intensity of the light 2620 based on data received from the power supply 302.

In an embodiment, part of the data received is an address that is used to determine if the information being sent is intended for this light 2620, as each light will have a unique address. In other embodiments, it is also possible for certain commands to be intended for lighting "groups". A group may be defined as a certain type of light, for instance, a path light, or a group may be all lights in a certain location. In yet other embodiments, commands may be intended for all lights 2620. Therefore, using this addressing technique, commands may affect an individual light, a group of lights, or all lights. In another embodiment, the power supply 302 communicates an intensity pattern to the light 2620. This could be a pre-orchestrated pattern of varying intensities, for example. In an embodiment, the pattern may be "canned" or preset inside the lighting fixture, or for the details of it to be communicated from the lighting controller 202, 300, 1802, 2102, 2202, 2252. This feature may be useful, for example, for lighting "effects" which may be synchronized to music.

The output of the comparator (within the microcontroller 2608) also contains the phase information for the incoming power signal, LIGHTING CONTROL1. LIGHTING CONTROL2. In an embodiment, this is important because the brightness of the LED 2620 is determined by a pulse width modulation (PWM) waveform from the microcontroller 2608. Unless this PWM waveform is synchronized with the incoming power, visible "flickering" may be seen as these two signals (power and PWM) are "mixed". Therefore it is important for the microcontroller 2608 to know the phase of the incoming power, and periodically reset a PWM counter in order to synchronize the PWM signal to the power signal.

In another embodiment, the microcontroller 2608 protects the light 2600 from overheating. In general, high-power LEDs 2620 generate heat. In an embodiment, the lighting fixture 2600 comprises the temperature sensor 2610 on the printed circuit board of the lighting fixture 2600. the temperature sensor 2610 can be, for example, part number MCP9700 available from Microchip Technology, or the like. The temperature sensor's output is an analog voltage which is read by an ND converter in the microcontroller 2608. The microcontroller 2608 uses this information to "throttle back" the power to the LED 2620 when the temperature rises above threshold temperature. In an embodiment, the threshold temperature is chosen to keep the internal junction temperature of the LED 2620 within its rated specification. The throttling is achieved the same way the intensity variation is achieved, as described above.

Although this embodiment illustrates a single LED, other embodiments of the lighting fixture 2600 drive a plurality of LEDs 2620.

Figure 27:
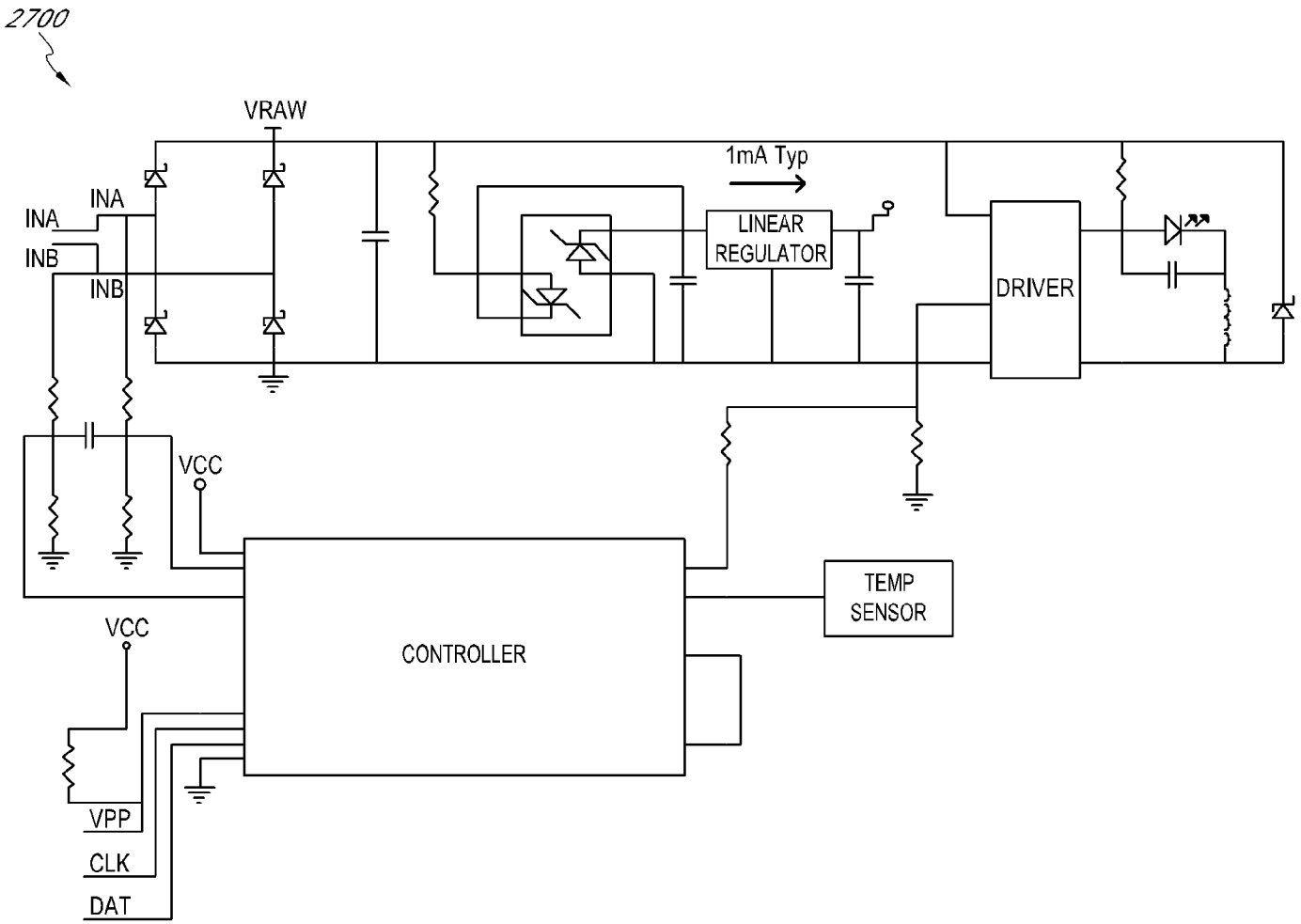
FIG. 27 is an exemplary schematic diagram of a single channel lighting module, according to certain embodiments.

FIG. 27 is an exemplary schematic diagram of a single channel lighting module 2700, according to one embodiment.

Figure 28:
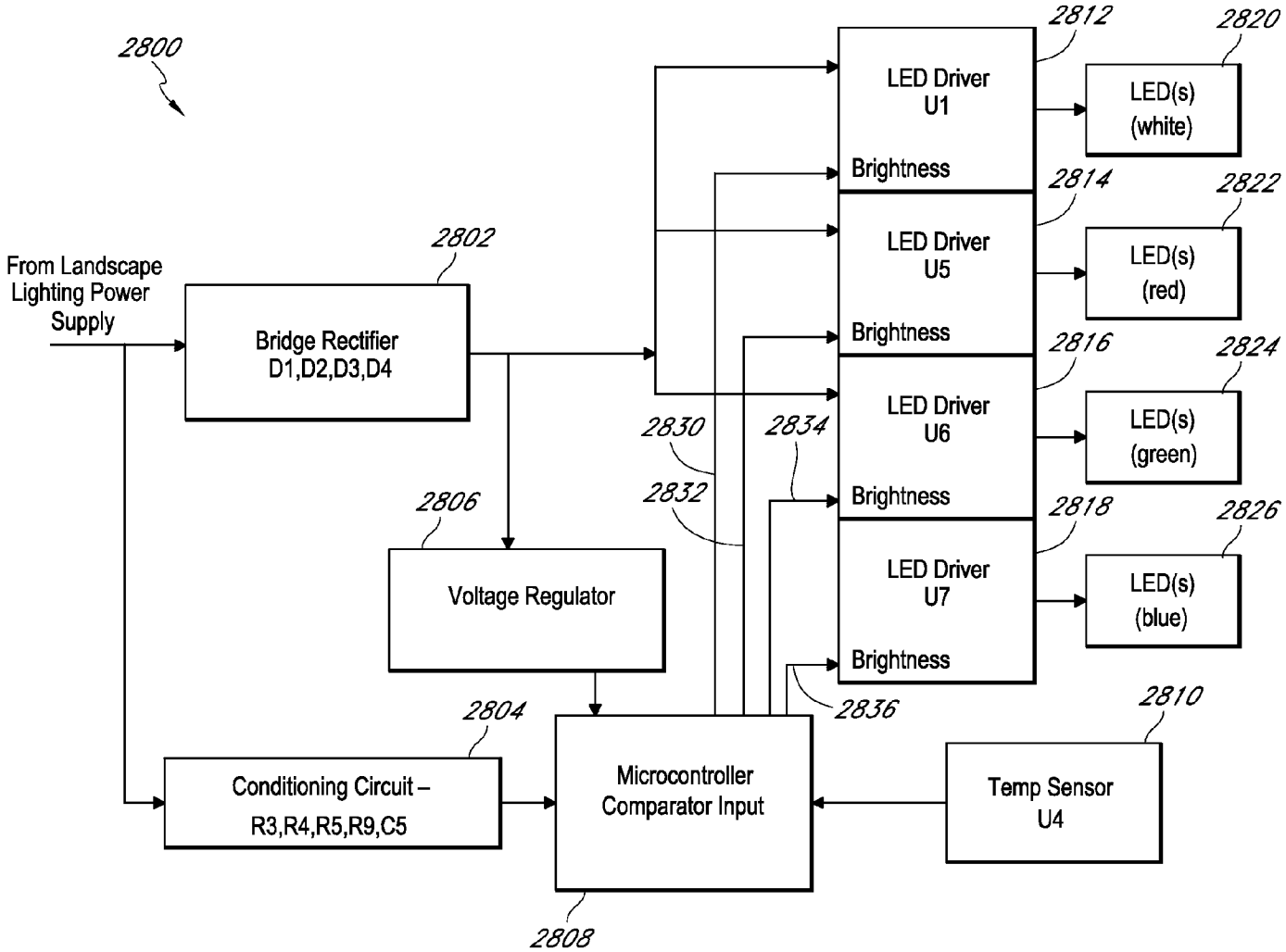
FIG. 28 is a block diagram of an exemplary multichannel lighting module, according to certain embodiments.

FIG. 28 is a block diagram of an exemplary multichannel lighting module 2800, which receives the polarity controlled, sinusoidal power signal from the lighting controller 202, 300, 1802, 2102, 2202, 2252, decodes and performs the encoded commands, and uses the signal for power. The lighting module 2800 comprises a bridge rectifier 2802, a conditioning circuit 2804, a voltage regulator 2806, a microcontroller 2808, a temperature sensor 2810, a plurality of LED drivers 2812, 2814, 2816, 2818, and one or more LEDs 2820, 2822, 2824, 2826. Each LED 2820, 2822, 2824, 2826 may comprise one or more LEDs. The illustrated embodiment is a four channel lighting module 2800, although other embodiments may have more or less than four channels.

The bridge rectifier 2802, the conditioning circuit 2804, and the voltage regulator 2806 are similar in construction and operation to the bridge rectifier 2602, the conditioning circuit 2604, and the voltage regulator 2606 of the single channel lighting fixture 2600, respectively, as described above.

The four channel embodiment 2800 approximately quadruples the LEDs 2620 and LED driver 2612 on the single-channel embodiment 2600 with respect to the LEDs 2820, 2822, 2824, 2826 and the LED drivers 2812, 2814, 2816, 2818 for the four channel lighting fixture 2800. Thus each LED 2820, 2822, 2824, 2826 and each LED driver 2812, 2814, 2816, 2818 is similar in construction and operation to the LED 2620 and LED driver 2612 of the single channel lighting fixture 2600, respectively, as described above. Similarly, the microcontroller 2808 is similar in construction and operation to the microcontroller 2608 of the single channel lighting fixture 2600, as described above, except the microcontroller 2808 controls multiple channels instead of a single channel. In conjunction with the microcontroller 2808, the LED drivers 2812, 2814, 2816, 2818 allow independent brightness control to four separate channels of LEDs. In a similar manner to microcontroller 2608, which generates the signal 2630 to control the intensity of LED 2620, microcontroller 2806 generates signals 2830, 2832, 2834, and 2836 to control the intensities of LEDs 2820, 2822, 2824, and 2826, respectively. Each string of LEDs 2820, 2822, 2824, 2826 may comprise one or more LEDs. In other embodiments, this approach could be used to add more channels, or to change the number of LEDs in each string. In yet other embodiments, each LED 2820, 2822, 2824, 2826 may comprise several LED dies in a single package with a single lens, such as, for example, the CREE MC series of LEDs or the like.

Like the single-channel embodiment 2600, the lighting fixture 2800 uses the microcontroller 2808 to receive information from the lighting controller 202, 300, 1802, 2102, 2202, 2252 and vary the LED intensity based on this information. Since each of the four channels can be independently controlled, the commands to a four-channel lighting fixture 2800 contains intensity level information for each of the four channels.

Advantageously, in the multi-channel embodiment 2800, each channel may comprise a different color LED 2820, 2822, 2824, 2826. For instance, if the first channel comprises one or more WHITE LEDs, the second comprises one or more RED LEDs, the third comprises GREEN LEDs and the fourth comprise BLUE LEDs, then a plurality of lighting colors could be generated by mixing the intensities in the correct ratios. For example, the white channel could create a brighter white light for general lighting needs, or slightly "wash out" the color created by the RED, BLUE, and GREEN LEDs. This allows the user to formulate any color of light desired, and to vary that color, either abruptly, or by a gradual blending technique. Outdoor lights could also be modified to match a particular season or holiday. For instance, red, white, and blue colored lights could be use on the 4th of July; red and green lights could be used around Christmas; and orange lights could be used for Halloween and Thanksgiving.

In another embodiment, the multi channel lighting fixture 2800 allows the user to adjust the shade of a white light. Perhaps, for example, the user is more of a "purest" and simply prefers white lights. The term "white" encompasses a wide range of shades from the more "blue" cool whites, to the more "yellow" warm whites. White LEDs by their nature are cool white. This is because a white LED is actually a blue LED with phosphor coating that glows white. For most people this is acceptable, but for some, a warmer white may be desired. If one of the three channels were populated with a RED or YELLOW LED, then by varying the intensity of that channel, the user could vary the warmth, or color temperature as it is technically called, of the light. This is also important because different color temperatures are better at illuminating certain subject hues than others.

Control of individual lights or individual channels of LEDs within a single light is advantageous. Even more advantageous is to be able to achieve this control using the same set of wires that deliver power to the light. Lastly, integrating all of the decoder circuitry 2802, 2804, 2806, 2808, the driver circuitry 2812, 2814, 2816, 2818, and the temperature throttling 2810 on a single printed circuit board within the lighting fixture 2800, results in a highly integrated, self-contained intelligent light fixture 2800 which is no harder to install than a tradition landscape light.

Figure 29:
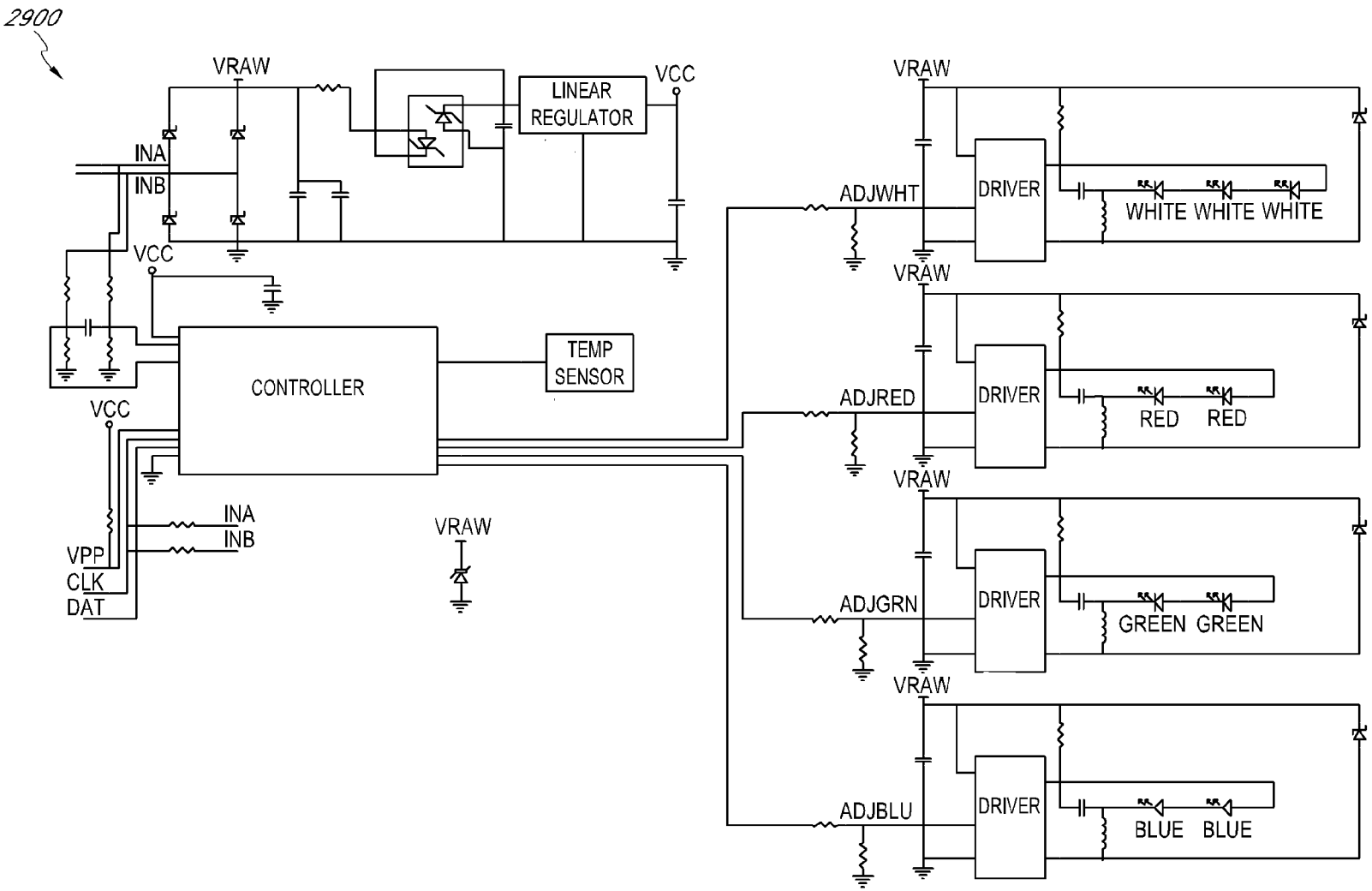
FIG. 29 is an exemplary schematic diagram of a multichannel lighting module, according to certain embodiments.

FIG. 29 is an exemplary schematic diagram of a multichannel lighting module 2900, according to one embodiment.

Depending on the embodiment, certain acts, events, or functions of any of the algorithms described herein can be performed in a different sequence, can be added, merged, or left out all together (e.g., not all described acts or events are necessary for the practice of the algorithm). Moreover, in certain embodiments, acts or events can be performed concurrently, e.g., through multi-threaded processing, interrupt processing, or multiple processors or processor cores or on other parallel architectures, rather than sequentially.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable storage medium known in the art. An exemplary storage medium can be coupled to the processor such that the processor can read information from, and write information to, the storage medium. In the alternative, the storage medium can be integral to the processor. The processor and the storage medium can reside in an ASIC.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A lighting system for controlling and powering at least one lighting module, the system comprising:

a lighting controller electrically connected to at least one lighting module through a two-wire path, the lighting controller creating and providing a data encoded power signal to the at least one lighting module through the two-wire path, each lighting module being addressable; and a user-operated remote device in communication with a selected lighting module of the at least one lighting module and the lighting controller, the remote device configured to receive a unique address of the selected lighting module from the selected lighting module and to instruct the lighting controller to encode the unique address onto the data encoded power signal in order to assign the selected lighting module to a selected lighting zone of at least one lighting zone without disconnecting the selected lighting module from the two-wire path each lighting zone being addressable, each lighting module storing its unique address and its lighting zone address.

2. The lighting system of claim 1, wherein the remote device communicates with the selected lighting module through an optical communication path.

3. The lighting system of claim 1, wherein the remote device communicates with the lighting controller through a radio frequency (RF) communication path.

4. The lighting system of claim 1 wherein the remote device comprises a digital device.

5. The lighting system of claim 1 wherein the data encoded power signal forms a sinusoidal waveform between zero crossings.

6. The lighting system of claim 2, wherein the remote device comprises a smartphone executing one or more appropriate applications.

7. The lighting system of claim 2, wherein the selected lighting module includes at least one light emitting diode (LED) and the remote device includes an optical receiver, the at least one LED flashes an address of the selected lighting module and the optical receiver detects the address of the selected lighting module from the flashing at least one LED.

8. The lighting system of claim 2, wherein the selected lighting module includes an optical receiver and the remote device includes an LED, and the remote device optically sends commands and data to the selected lighting module by strobing the LED, the optical receiver of the selected lighting module receives the commands and data from the remote.

9. The lighting system of claim 6, wherein the selected lighting module includes at least one light emitting diode (LED) and the smartphone includes a camera, the at least one LED flashes an address of the selected lighting module and the camera reads the address of the selected lighting module from the flashing at least one LED.

10. The lighting system of claim 6, wherein the selected lighting module includes a bar code and the smartphone includes a camera, the bar code encoded with the unique address of the selected lighting module and the camera reads the bar code to determine the unique address of the selected lighting module.

11. The lighting system of claim 9 wherein a rate of flashing of the at least one LED is less than approximately 30 Hz.

12. A method for controlling and powering at least one lighting module, the method comprising:

connecting lighting modules in a lighting system to a two wire path;

providing a data encoded power signal to at least one lighting module through said two-wire path;

assigning the at least one lighting module to a first lighting zone, each lighting module and each lighting zone being addressable;

receiving a unique address of a selected lighting module of the at least one lighting module with a user-operated remote device, the selected lighting module storing its unique address;

encoding the unique address onto the data encoded power signal; and sending the data encoded power signal including the encoded address through the two-wire path to reassign the selected lighting module to a second lighting zone without disconnecting the selected lighting module from the two-wire path, the selected lighting module storing its lighting zone address.

13. The method of claim 12, wherein communicating with the selected lighting module comprises communicating with the selected lighting module through an optical communication path.

14. The method of claim 12, wherein communicating with the selected lighting module comprises communicating with the selected lighting module through a radio frequency (RF) communication path.

15. The method of claim 12, wherein the remote device comprises a digital device.

16. The method of claim 12 wherein the data encoded power signal forms a sinusoidal waveform between zero crossings.

17. The method of claim 13, wherein the remote device comprises a smartphone executing one or more appropriate applications.

18. The method of claim 13, wherein the selected lighting module includes at least one light emitting diode (LED) and the remote device includes an optical receiver, the method further comprises flashing with the at least one LED an address of the selected lighting module, and detecting with the optical receiver the address of the selected lighting module from the flashing at least one LED.

19. The method of claim 13, wherein the selected lighting module includes an optical receiver and the remote device includes an LED, the method further comprises strobing the LED to optically send commands and data to the selected lighting module, and optically receiving with the optical receiver the commands and data from the remote device.

20. The method of claim 17, wherein the selected lighting module includes at least one light emitting diode (LED) and the smartphone includes a camera, the method further comprises flashing with the at least one LED an address of the selected lighting module, and reading with the camera the address of the selected lighting module from the flashing at least one LED.

21. The method of claim 17, wherein the selected lighting module includes a bar code and the smartphone includes a camera, the method further comprises:

encoding the bar code with a unique address of the selected lighting module;

reading with the camera the bar code; and determining the unique address of the selected lighting module from the bar code read by the camera.

22. The method of claim 20 wherein a rate of flashing of the at least one LED is less than approximately 30 Hz.

23. A remote programming device for programming a lighting system including a lighting controller electrically connected to at least one lighting module, the lighting controller creating and providing a power signal through a two-wire path to the at least one lighting module, the at least one lighting module configured to be assigned to a lighting zone, each lighting module comprising a unique module address and each lighting zone comprising a zone address, the remote programming device comprising:

a portable housing;

a user interface housed by said portable housing; and a processor housed within said portable housing and responsive to the user interface, the processor configured to wirelessly communicate with a selected lighting module of the at least one lighting module and the lighting controller, and configured to receive the unique module address of the selected lighting module from the selected lighting module and to instruct the lighting controller to encode the unique module address onto the data encoded power signal in order to reassign the selected lighting module to a selected lighting zone without disconnecting the selected lighting module from the lighting controller, each lighting module storing its unique module address and its zone address.

24. The method of claim 23 wherein the power signal forms a sinusoidal waveform between zero crossings.

25. An lighting system configured to be controlled by a user through online interactivity, the system comprising:

a lighting controller electrically serially communicating with a plurality of lighting modules, the lighting controller outputting a data encoded power signal to the plurality of lighting modules, said data encoded power signal forming a sinusoidal waveform between zero crossings, each lighting module being responsive to data encoded in said data encoded power signal when said data is addressed to said lighting module; and a webserver serving webpages to a digital device interacting with a user, said digital device receiving user input related to desired behavior of one or more of said lighting modules, wherein said lighting controller receives said user input and outputs said data encoded power signal causing said one or more of said lighting modules to be responsive to said user input.

26. The lighting system of claim 25, wherein said lighting controller comprises said webserver.

27. The lighting system of claim 25, comprising a module communicating with said lighting controller, said module comprising said webserver.

28. A method of encoding data onto a power signal for a lighting system, said data responsive to online interaction from a user, the method comprising:

serving online information to a user operated digital device;

receiving user input from said digital device, said user input related to desired behavior of lighting modules of a light system;

communicating the received user input to a lighting controller; and outputting to said lighting modules a data encoded power signal responsive to said user input, said data encoded power signal forming a sinusoidal waveform between zero crossings, said data encoded power signal configuring said modules to behave according to said user input.

29. The method of claim 28, wherein said lighting controller serves said online information.

30. The method of claim 28, wherein a module communicating with said lighting controller serves said online information.

31. A lighting system for controlling and powering at least one lighting module, the system comprising:

a plurality of lighting modules organized into at least two lighting zones;

at least one of said plurality of lighting modules configured to store its unique address and its lighting zone; and a lighting controller electrically connected to the plurality of lighting modules through a two-wire path, the lighting controller creating and providing a data encoded power signal to the at least one lighting module of said plurality of lighting modules through the two-wire path, and configured to encode the unique address of the at least one lighting module on the two-wire path in order to change the lighting zone of the at least one lighting module without affecting a lighting zone of other lighting modules on the two-wire path and without disconnecting the at least one lighting module from the two-wire path.

32. The lighting system of claim 31, comprising a remote programming device, the remote programming device in communication with said lighting controller and configured to receive the unique address of the at least one lighting module and to instruct the lighting controller to encode the unique address onto the data encoded power signal to affect said change of said lighting zone.

* * * * *

UNITED STATES PATENT AND TRADEMARK OFFICE

CERTIFICATE OF CORRECTION

PATENT NO. : 8,710,770 B2
APPLICATION NO. : 13/230665
DATED : April 29, 2014
INVENTOR(S) : Woytowitz It is certified that error appears in the above-identified patent and that said Letters Patent is hereby corrected as shown below:

In the Specification:

In column 11 at line 6, Change “a the” to --the--.

In column 19 at line 34, Change “18040N” to --1804 ON--.

In the Claims:

In column 33 at line 39, In Claim 23, change “reassign” to --assign--.

Signed and Sealed this
Thirtieth Day of September, 2014

Michelle K. Lee

Michelle K. Lee
*Deputy Director of the United States Patent and Trademark Office*